US008459451B2

(12) United States Patent
Lau

(10) Patent No.: US 8,459,451 B2
(45) **Date of Patent: *Jun. 11, 2013**

(54) INTEGRATED TABBED NOTE AND FASTENER

(76) Inventor: Janet K. Lau, Union City, CA (US)

( * ) Notice: Subject to any disclaimer, the term of this patent is extended or adjusted under 35 U.S.C. 154(b) by 69 days.

This patent is subject to a terminal disclaimer.

(21) Appl. No.: 12/973,720

(22) Filed: Dec. 20, 2010

(65) Prior Publication Data

US 2011/0168583 A1 Jul. 14, 2011

Related U.S. Application Data

(63) Continuation of application No. 11/534,625, filed on Sep. 22, 2006, now Pat. No. 7,857,127, and a continuation-in-part of application No. 29/243,774, filed on Nov. 29, 2005, now abandoned, and a continuation-in-part of application No. 29/243,730, filed on Nov. 29, 2005, now abandoned, and a continuation-in-part of application No. 29/246,502, filed on Apr. 19, 2006, now abandoned, and a continuation-in-part of application No. 29/246,503, filed on Apr. 19, 2006, now abandoned, and a continuation-in-part of application No. 29/246,504, filed on Apr. 19, 2006, now abandoned, and a continuation-in-part of application No. 29/247,938, filed on Jul. 20, 2006, now Pat. No. Des. 541,346, and a continuation-in-part of application No. 29/247,962, filed on Jul. 21, 2006, now Pat. No. Des. 540,849, and a continuation-in-part of application No. 29/248,033, filed on Jul. 26, 2006, now abandoned.

(60) Provisional application No. 60/596,458, filed on Sep. 23, 2005.

(51) Int. Cl.
*B65D 69/00* (2006.01)

(52) U.S. Cl.
USPC ..... 206/223; 206/575

(58) Field of Classification Search
USPC ..... 206/223, 575, 224, 38, 215, 371, 206/459.5, 447; 40/359, 360, 641; 283/37, 283/39, 41
See application file for complete search history.

(56) References Cited

U.S. PATENT DOCUMENTS

| | | | |
|---|---|---|---|
| 332,327 | A | 12/1885 | Clark |
| 863,265 | A | 8/1907 | Crouse |
| 876,252 | A | 1/1908 | Baker |

(Continued)

FOREIGN PATENT DOCUMENTS

| | | | |
|---|---|---|---|
| JP | 09-071065 | A | 3/1997 |
| JP | 2001-353992 | A | 12/2001 |

*Primary Examiner* — David Fidei
(74) *Attorney, Agent, or Firm* — Aka Chan LLP

(57) ABSTRACT

Methods and apparatus for securely but removably tabbing one or more sheets of paper are disclosed. According to another aspect of the present invention, a kit includes a container and a first tabbed note assembly. The container includes at least a first compartment, and the first tabbed note assembly includes a first tabbed note and a first fastener. The first tabbed note has a first opening defined therein, and the first fastener is at least partially disposed in the first opening. The first tabbed note is positioned, or otherwise contained, at least partially in the first compartment. In one embodiment, the kit includes a divider that is inserted at least partially in the container such that the first compartment and a second compartment are defined at least partially by the divider.

26 Claims, 95 Drawing Sheets

U.S. PATENT DOCUMENTS 962,397 A 6/1910 Whitmore
1,052,505 A 2/1913 Munger et al.
1,123,008 A 12/1914 Rice
1,158,940 A 11/1915 Litt et al.
1,178,113 A 4/1916 Turton et al.
D50,594 S 4/1917 Voges
1,345,365 A 7/1920 Hutchison
1,465,576 A 8/1923 Biggs
1,501,067 A 7/1924 Schaffert
1,524,478 A 1/1925 Hunter
1,587,335 A 6/1926 Kline
1,661,165 A 3/1928 Cameron
1,778,031 A 10/1930 Kinch
1,802,980 A 4/1931 Marsh
1,826,580 A 10/1931 Spinney
1,840,604 A 1/1932 Randall
1,843,687 A 2/1932 Lovell
1,894,906 A 1/1933 Henry
1,914,671 A 6/1933 O'Neil
1,976,465 A 10/1934 Thomson
1,977,096 A 10/1934 Straubel
1,985,866 A 12/1934 Lankenau
1,997,894 A 4/1935 Woodley
2,008,019 A 7/1935 Horlick, Jr.
D104,956 S 6/1937 Baker
2,118,043 A 5/1938 Goza
2,156,743 A 5/1939 Skrebba
2,232,939 A 2/1941 Cohen
2,248,317 A 7/1941 Van Cleef
2,323,552 A 7/1943 Marion
D136,639 S 11/1943 Hoffman
2,362,445 A 11/1944 Blodgett
2,415,248 A 2/1947 Kenna et al.
2,420,021 A 5/1947 Straubel
2,623,311 A 12/1952 Condon
2,695,026 A 11/1954 Broneer
3,073,046 A 1/1963 Condon
3,123,924 A 3/1964 Roberts
3,225,469 A 12/1965 Chase
3,247,602 A 4/1966 Hamilton et al.
3,290,810 A 12/1966 Morena
3,313,408 A 4/1967 Gilbert
3,347,361 A 10/1967 Lindeke
3,360,877 A 1/1968 Estep
3,361,252 A 1/1968 Wise
D299,571 S 12/1973 Fearing
3,910,412 A 10/1975 Vargo
3,934,368 A 1/1976 Fearing
D241,342 S 9/1976 Carroll
D268,848 S 5/1983 Lorber
4,384,417 A 5/1983 Thompson
4,425,724 A 1/1984 Scott
4,646,455 A 3/1987 Gardner
4,691,458 A 9/1987 Scott
D295,540 S 5/1988 Rabig
4,878,302 A 11/1989 Jowsey
4,951,408 A 8/1990 Banks
D314,012 S 1/1991 Klodt
D327,183 S 6/1992 Meyer
5,161,712 A 11/1992 Olson
5,170,535 A 12/1992 Strong
5,199,203 A 4/1993 Jones
5,445,272 A 8/1995 Crisp
5,481,784 A 1/1996 Sinaiko
D382,405 S 8/1997 Ohayon
D383,789 S 9/1997 Shyu
5,695,219 A 12/1997 Crawford
D409,245 S 5/1999 Wolff
5,947,302 A 9/1999 Miller
D416,040 S 11/1999 Kasom et al.
5,996,130 A 12/1999 Verhines
D465,525 S 11/2002 Dilday
D476,172 S 6/2003 Bourne, Sr.
7,857,127 B2 * 12/2010 Lau ..... 206/223
2002/0072723 A1 6/2002 Ronn et al.
2004/0099717 A1 5/2004 Lee
2005/0217078 A1 10/2005 Groch et al.
2005/0257408 A1 * 11/2005 Black ..... 40/641
2006/0000133 A1 1/2006 Windorski
2009/0301919 A1 * 12/2009 Pascale ..... 206/459.1

* cited by examiner

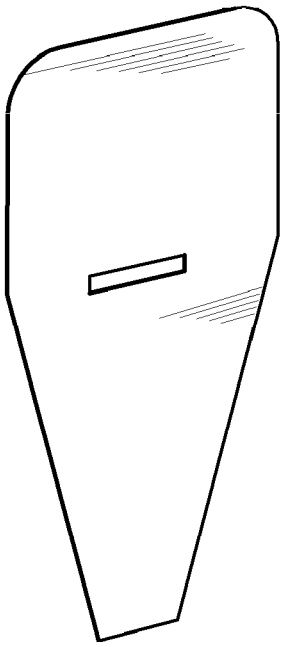
FIG. 34A
FIG. 34D
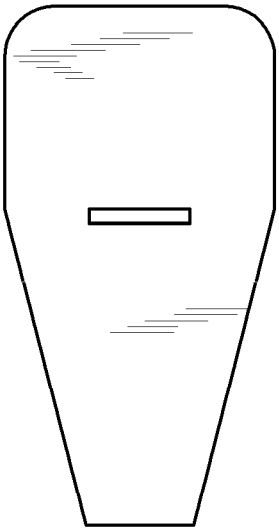
FIG. 34B
FIG. 34C

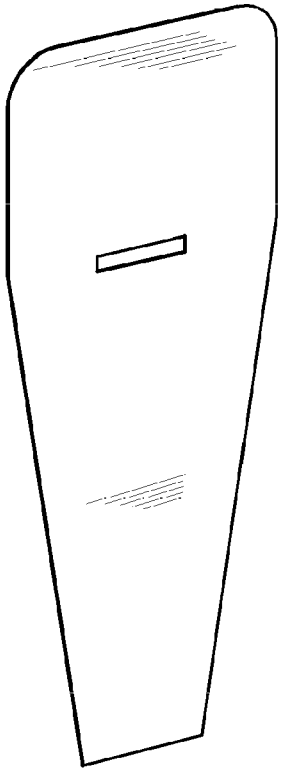
FIG. 35A
FIG. 35D
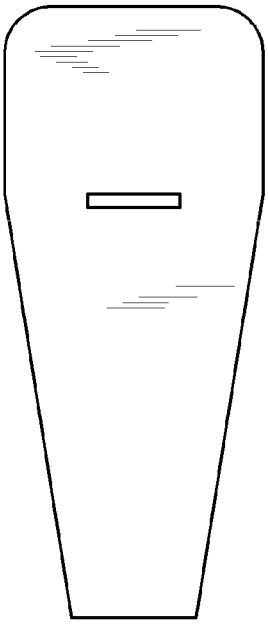
FIG. 35B
FIG. 35C

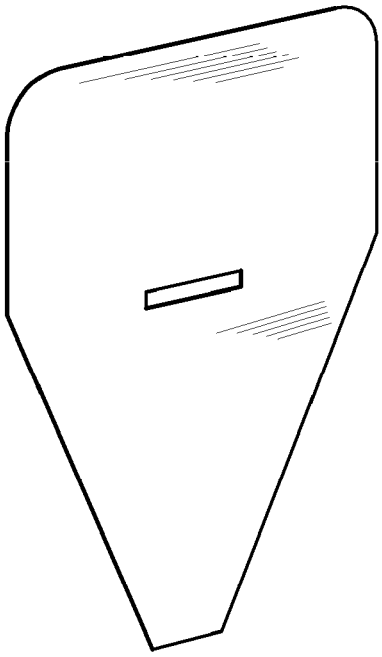
FIG. 36A
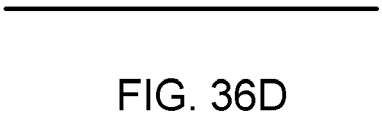
FIG. 36D
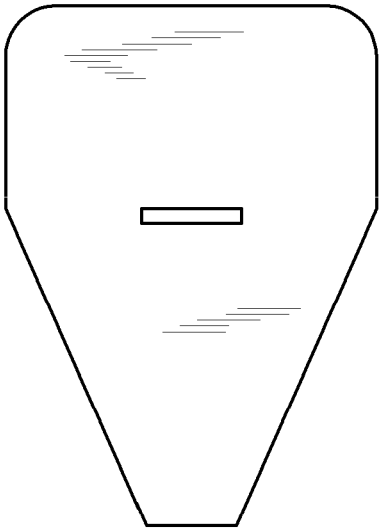
FIG. 36B
FIG. 36C

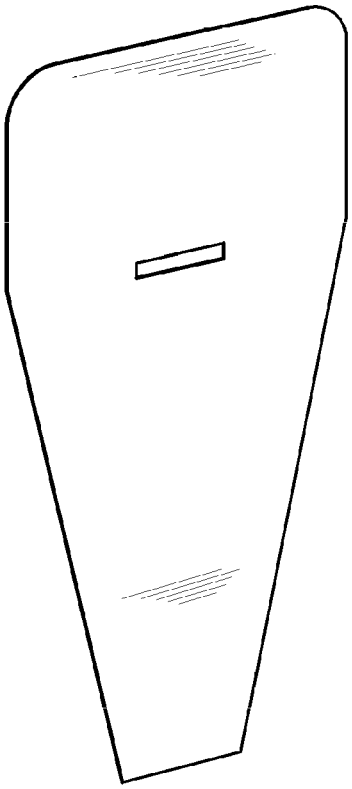
FIG. 37A
FIG. 37D
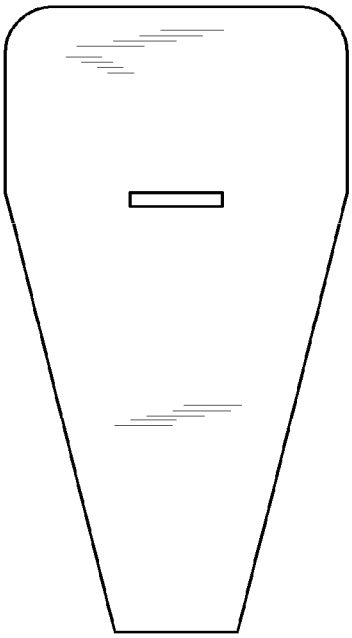
FIG. 37B
FIG. 37C

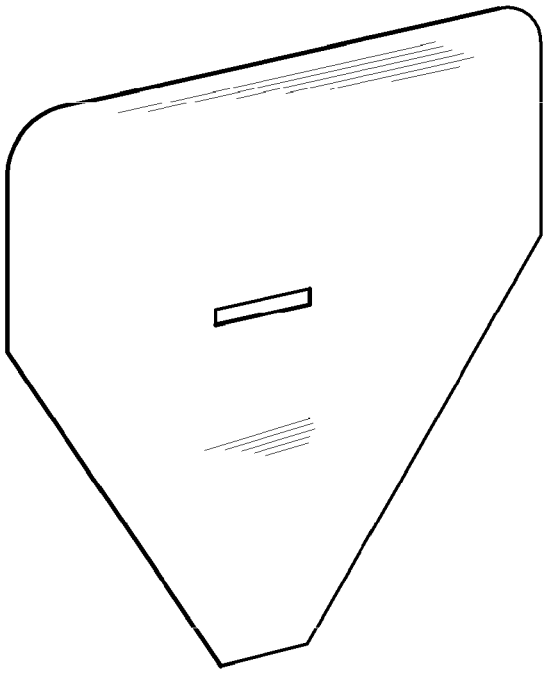
FIG. 38A
FIG. 38D
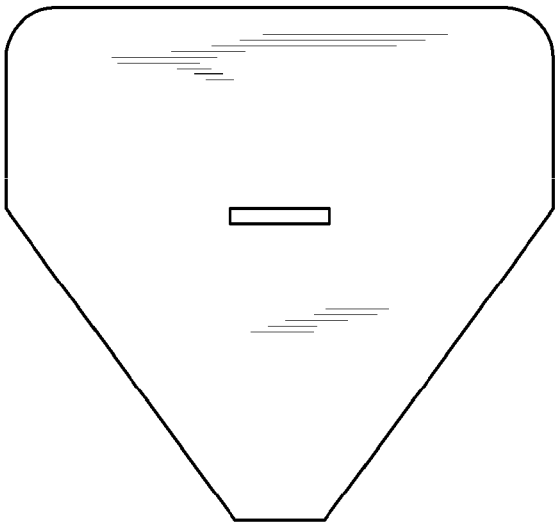
FIG. 38B
FIG. 38C

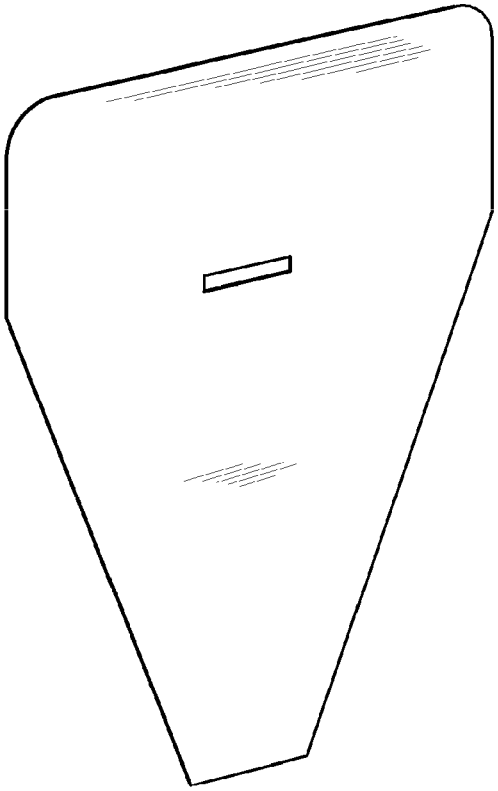
FIG. 39A
FIG. 39D
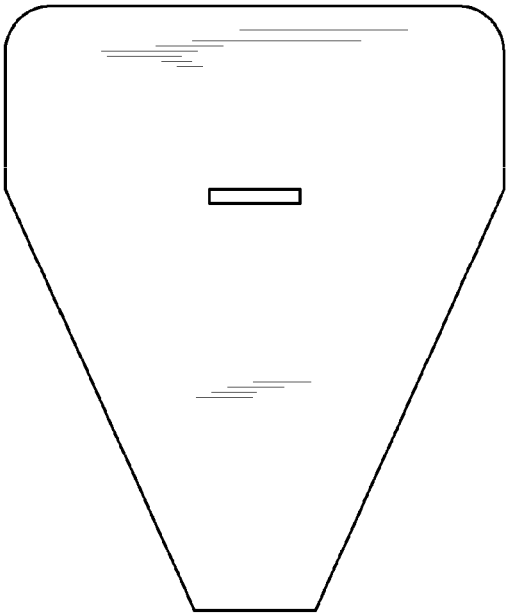
FIG. 39B
FIG. 39C

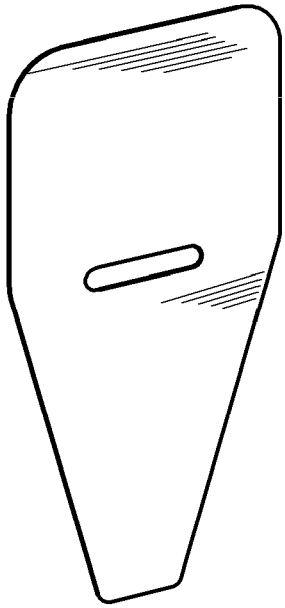
FIG. 53A
FIG. 53D
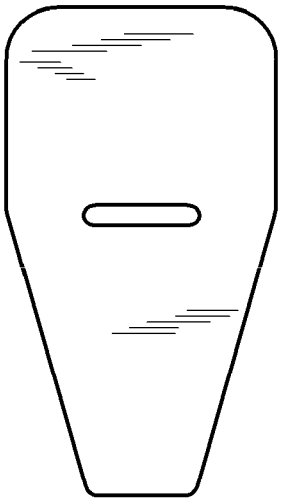
FIG. 53B
FIG. 53C

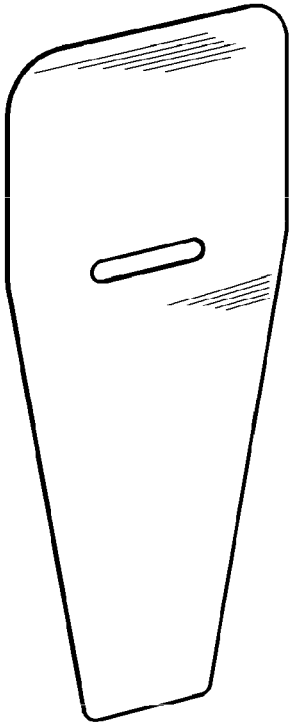
FIG. 54A
FIG. 54D
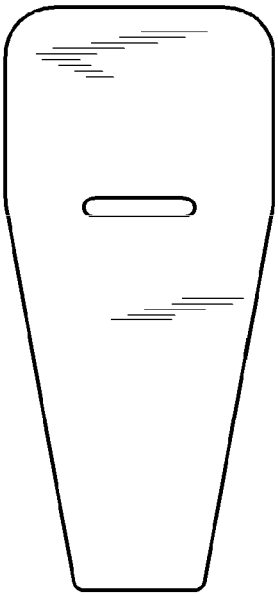
FIG. 54B
FIG. 54C

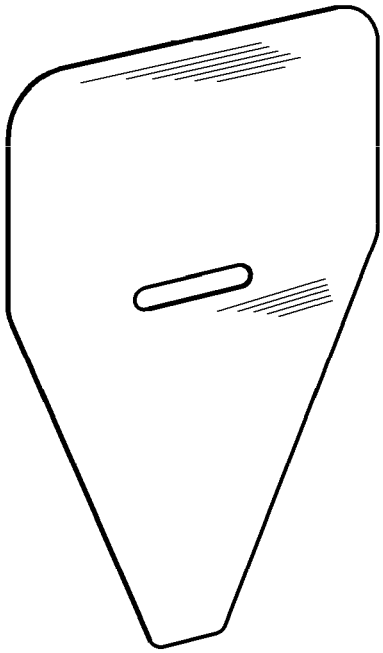
FIG. 55A
FIG. 55D
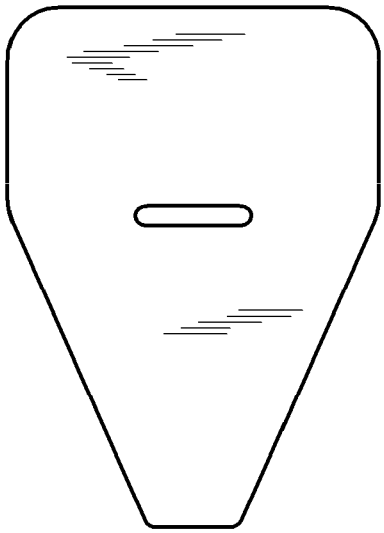
FIG. 55B
FIG. 55C

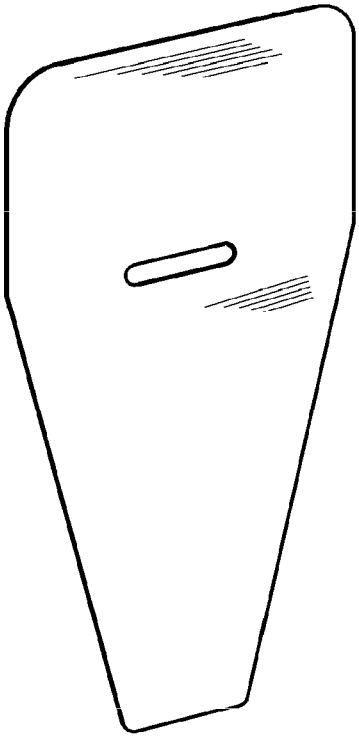
FIG. 56A
FIG. 56D
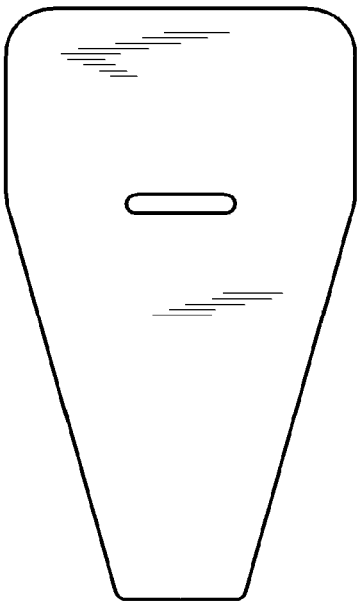
FIG. 56B
FIG. 56C

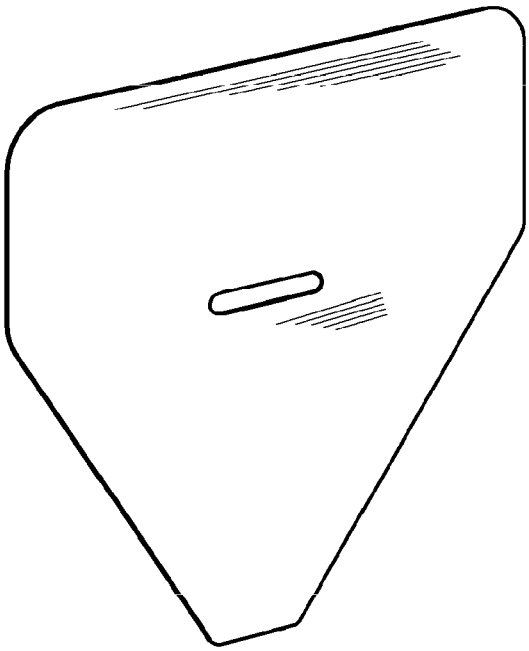
FIG. 57A
FIG. 57D
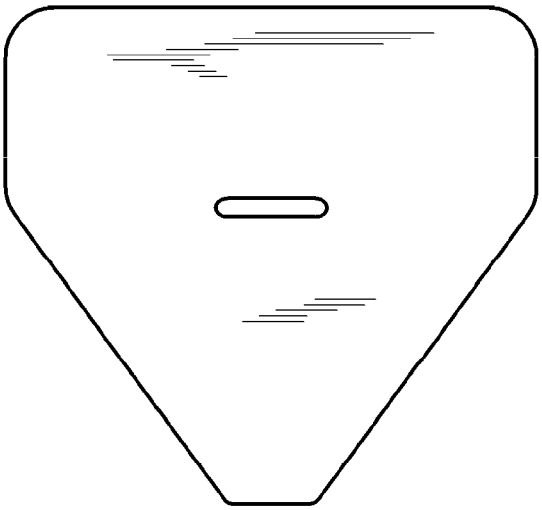
FIG. 57B
FIG. 57C

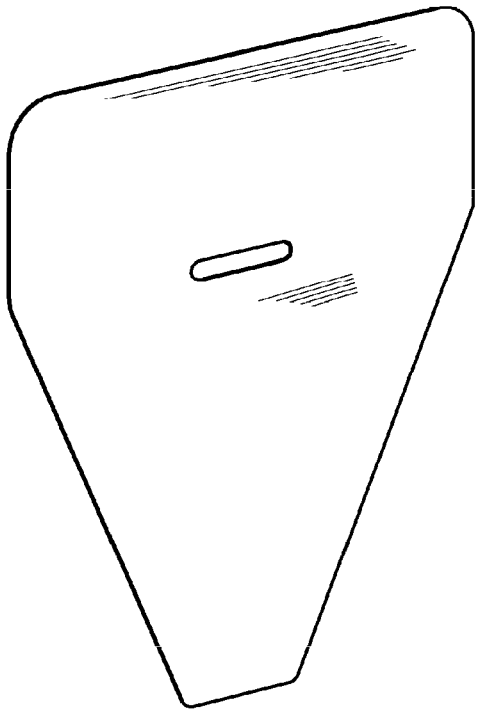
FIG. 58A
FIG. 58D
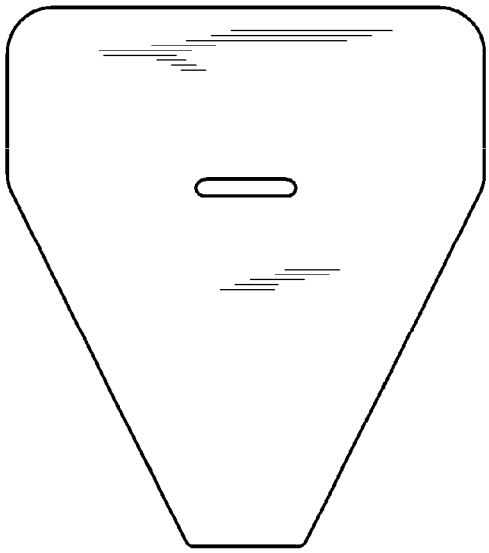
FIG. 58B
FIG. 58C

INTEGRATED TABBED NOTE AND FASTENER

CROSS-REFERENCE TO RELATED APPLICATIONS

This application is a continuation of U.S. patent application Ser. No. 11/534,625 filed Sep. 22, 2006, issued as U.S. Pat. No. 7,857,127 on Dec. 28, 2010, which claims the benefit of U.S. provisional patent application 60/596,458, filed Sep. 23, 2005; and is a continuation in part of U.S. design patent applications 29/243,774 and 29/243,730, filed on Nov. 29, 2005 now abandoned; 29/246,502, 29/246,503, and 29/246,504, filed Apr. 19, 2006 now abandoned; 29/247,938, filed Jul. 20, 2006 now U.S. Pat. No. D. 541,346; 29/247,962, filed Jul. 21, 2006 now U.S. Pat. No. D. 540,869; and 29/248,033, filed Jul. 26, 2006 now abandoned. These applications are incorporated by reference along with all other references cited in this application.

BACKGROUND OF THE INVENTION

The present invention relates generally to providing tabs which may be readily clipped on and unclipped from one or more sheets of paper. More particularly, the present invention relates to a rewritable note which includes a tab section and a fastener that enables the note to be efficiently attached and detached from sheets of paper.

Despite great strides and advances in electronic technology, the birth of the Internet, and continued promises of the paperless office, paper remains critical to the functioning of society and business today. Using paper is familiar, easy, reliable, and relatively inexpensive. With paper comes the need to organize and manage the growing mountains of paper better. Some of the most successful inventions in human history are tools or devices to manage paper better: Some well-known examples that quickly come to mind include the paper clip, binder clip, staple, stapler, file folder, binder, and many others.

Given a mountain of papers, some of the papers may be more important than other papers in the mountain, or groups of papers may have a different priority than other groups in the mountain. It would be very time consuming if one were to start from the beginning each time he or she were searching for a particular piece of paper. Therefore, to organize one or more sheets of paper such that specific sheets of paper may be readily identified, tabbed folders may be used. An individual may label folders to essentially provide labels for any sheets of paper contained therein. By way of example, when papers are to be separated into high priority and low priority groups, the tab portion of one folder may be labeled "high priority" and used to hold high priority papers, while the tab portion of another folder may be labeled "low priority" and used to hold low priority papers. Additional descriptions or notations pertaining to the contents of the folders may be printed or written directly onto the folders.

While the use of tabbed folders in the organization of papers is effective, the use of tabbed folders is not always desirable. Tabbed folders may be bulky, and if multiple folders are needed to organize papers, the amount of bulk added by the tabbed folders may be cumbersome. In addition, the need to open tabbed folders to view the contents of the folders may prove to be inconvenient.

Tabs or labels may be provided directly on sheets of paper to allow for the efficient filing of the sheets of paper. For example, a label may be positioned and glued over a paper clip. When the paper clip is secured to one or more sheets of paper, the label may be used to effectively label the sheets of paper when a printed card is received within the label. While such a label may be effective in allowing sheets of paper to be organized, having to remove a printed card held within the label when the text on the printed card is no longer relevant may be inefficient. Further, the label and paper clip assembly does not allow for additional notes regarding the sheets of paper held by the assembly to be made thereon.

Post-it® notes, which are available from 3M Incorporated of St. Paul, Minn., may be used to provide tabs for a sheet or sheets of paper, and are reusable. Post-it notes may be erased, as well as readily removed and reused. Despite the success of Post-it notes, there are shortcomings such as the inability to secure multiple papers together and not necessarily reliable and substantial in all circumstances. For example, Post-it notes are sometimes too easily removable, even by accident. Over time, Post-it notes may simply loose their adhesiveness.

Though a Post-it note may be positioned on a sheet of paper such that a portion of the Post-it note extends above an edge of the sheet of paper to effectively form a tab while a portion of the Post-it note that does not extend above the edge may serve to allow notes to be made thereon, the tab is relatively flimsy. Hence, the tab portion of a Post-it note used to form a tab may be accidentally bent such that any writing on the tab portion is obscured. In addition, a Post-it note may relatively easily become detached from a sheet of paper to which it is affixed, and is not arranged to secure multiple sheets of paper together.

Therefore, what is needed is a method and an apparatus which is relatively easy to reuse, and allows one or more sheets of paper to be securely tabbed. That is, what is desired is a tab arrangement which is reusable, secures one or more sheets of paper, and allows notes in addition to notations on a tab to be written thereon.

BRIEF SUMMARY OF THE INVENTION

Methods and apparatus for securely but removably tabbing one or more sheets of paper are disclosed. According to another aspect of the present invention, a kit includes a container and a first tabbed note assembly. The container includes at least a first compartment, and the first tabbed note assembly includes a first tabbed note and a first fastener. The first tabbed note has a first opening defined therein, and the first fastener is at least partially disposed in the first opening. The first tabbed note is positioned, or otherwise contained, at least partially in the first compartment. In one embodiment, the kit includes a divider that is inserted at least partially in the container such that the first compartment and a second compartment are defined at least partially by the divider.

In an implementation, the present invention relates to a kit that contains an apparatus that functions as a secure, removable tab for one or more sheets of paper. According to one aspect of the present invention, a kit contains tabbed notes and may be held in a box or other container with one or more compartments. This container may be made from plastic, glass, wood, ceramic, or other material. For example, in one embodiment, the container is clear or colored see-through plastic. The kit may be in a container that may be fully closed securely so that the kit may be moved from one location to another location easily, without a user worrying about the contents of the kit shifting or dropping out.

In an implementation, a kit including: a rigid container including at least two compartments separated by a single divider; in a first compartment of the rigid container, a first number of single-sheet tab notes, each note including at most a single opening and a clip inserted through the opening, where an upper loop of the clip is on a first side of the note and a lower loop of the clip is on a second side of the note, and the first number of single-sheet tab notes has a first color scheme; and in a second compartment of the rigid container, a second number of single-sheet tab notes, substantially the same as the first number of single sheet tab notes, except that the second number of single-sheet tab notes has a second color scheme, different from the first color scheme.

The compartments of the container may be equally sized or each may be different size from other compartments. The compartments may have the same width, height, or depth, or any combination of these. For example, one compartment may have a first width and a second compartment may have a second width, where the second width is different from the first width.

The kit may further include: in the first compartment, a third number of single-sheet tab notes, substantially the same as the first number of single sheet tab notes, except that the third number of single-sheet tab notes has a third color scheme, different from the first and second color schemes, where the first number of single-sheet tab notes are arranged together in a first single group in a first portion of the first compartment and the third number of single-sheet tab notes are arranged together in a second single group in a first portion of the second compartment; and in the second compartment, a fourth number of single-sheet tab notes, substantially the same as the first number of single sheet tab notes, except that the fourth number of single-sheet tab notes has a fourth color scheme, different from the first, second, and third color schemes, where the second number of single-sheet tab notes are arranged together in a first single group in a first portion of the second compartment and the fourth number of single-sheet tab notes are arranged together in a second single group in a second portion of the second compartment.

In an implementation, each compartment hold notes of one color scheme, where each compartment has notes of a different color scheme. There may be any number of compartments, one, two, three, four, or five or more. In an implementation, the compartments are side by side, but in other implementations, the compartments may be back to back. In the back-to-back arrangement, the back compartment may have a bottom that is raised compared to the front compartment. This permits lifting or elevating of the notes in the back compartment slightly above those in the front compartment, so these notes may be more easily seen and selected. In a container of the invention, there may be any number side-to-side and back-to-back compartments and in any combination. The figures show some specific implementations as examples.

Further, there may be some notes of a first color scheme in a front portion on one compartment and a second color scheme in a back portion of the same compartment. In this arrangement of notes, a user may select and pick notes of the first color scheme from the front of the container and select and pick notes of the second color scheme from the back of the container. Therefore, if this arrangement is used in two compartment container, there will be at least four different color schemes.

The first color scheme may include a first color applied to a portion of a note defined by a straight line above the opening; and a second color applied to a portion of a note below the straight line, where the first and second colors are different. The straight line may touch an upper edge of the opening. The first and second colors may be different shades of the same color, such as darker and light shades of blue, green, pink, yellow, or gold. The second color scheme may include a third color applied to a portion of a note defined by a straight line above the opening; and a fourth color applied to a portion of a note below the straight line, where the third and fourth colors are different. The second color may be applied by dying the note and the first color is printed on the note after the note has been dyed.

By dying the note, the color is relatively colorfast compared to the printed color, so when attaching a tab note to a sheet of paper, the dyed color will not rub off or less likely rub off on the sheet of paper, especially compared to the printed color. In a specific implementation, the dyed color is at a lower portion of the note, below the opening, while the printed color is above the opening. The printable portion is writeable. The lower portion of the note is the portion where the clip attaches using pressure. The single sheet is held by pressure between the two loops of the clip at the lower portion. This is where the note is attachable using the clip to other sheets or items. The upper loop exerts pressure in a direction toward the lower loop, and the lower loop exerts pressure in a direction toward the upper loop. In an implementation, the upper and lower loops of the clip are planar. However, in another implementation, to exert greater pressure, the upper loop and lower loop have an offset or gap from the plane, and the clip is placed in a note so the loops exert pressure toward the sheet so the clip holds to the sheet.

In a specific implementation, two side edges of the note above the straight line are substantially parallel as these side edges extend toward a top edge of the note, and two side edges of the note below the straight line are tapered as these side edges extend toward a bottom edge of the note. The bottom edge of the note is a straight line. This edge allows the note to stand upright in a container, and this edge touches a bottom of the container compartment. By tapering the edges of the lower portion of the note, also the portion where the note is attached to other sheets, the note will obscure or block less of the document which the note is attached to. By starting the tapering from a straight line defined above the opening of the note, this permits a sturdy and durable note that remains rigid, but flexible (i.e., not or less flimsy) when in use.

In an implementation, the container is translucent plastic and the single-sheet tab notes are visible through the plastic. This permits a user to see the notes easily, especially to determine how many notes remain in the container and how many notes of a certain color remain. However in other implementations, the container may be opaque or may be made of other colors. The container may have a top cover to hole the notes in place during transportation such as in a briefcase or backpack. This container may be a hinged cover or a completely removable cover.

In other implementations, the container may be a soft container, such as made from fabric, material, paper, plastic, nylon, or polyester. The notes may be held in place through friction. They may be a top flap to this soft container that folds over to hold the notes in place, and this top flap may be secured by Velcro, snap, or other fastener.

In an implementation, a height of the divider is less than or equal to a distance from a bottom edge of a tab note to its top edge and greater than of a distance from the bottom edge to a top edge of an opening of the tab note. This divider helps keep the notes upright in the container and helps prevent shifting or rotation of the notes when in the container.

At least one compartment of a kit may hold fully assembled tabbed note assemblies. Another compartment may hold replacement tabbed notes for the tabbed note assemblies, which may be used to replace the tabbed notes of the fully assembled tabbed note assemblies when their tabbed notes are discarded. As discussed above, in an embodiment, a tabbed note has an opening or a hole. The compartment holding the replacement tabbed notes may be specially shaped to the replacement paper. For example, if the replacement tabbed notes are rectangular, the compartment will likely be rectangular, and sized just large enough to hold the replacement tabbed notes. Further, in one embodiment, the compartment may have a spindle that fits through the opening or hole in the tabbed note. This spindle will typically be sized similarly to the opening or hole and serves to hold the tabbed note more securely in place in its compartment.

According to another aspect of the present invention, a kit includes a container and a first tabbed note assembly. The container includes at least a first compartment, and the first tabbed note assembly includes a first tabbed note and a first fastener. The first tabbed note has a first opening defined therein, and the first fastener is at least partially disposed in the first opening. The first tabbed note is positioned, or otherwise contained, at least partially in the first compartment. In one embodiment, the kit includes a divider that is inserted at least partially in the container such that the first compartment and a second compartment are defined at least partially by the divider.

In accordance with still another aspect of the present invention, a kit includes a container with at least a first compartment and a second compartment that are defined in the container by at least one divider. The kit also includes a first plurality of tabbed note assemblies and a second plurality of tabbed note assemblies. The first plurality of tabbed note assemblies is positioned at least partially in the first compartment and the second plurality of tabbed note assemblies is positioned at least partially in the second compartment. The first plurality of tabbed note assemblies has a first tabbed note assembly with a first tabbed note and a first fastener. The first tabbed note has a first tab portion and a first note portion. The first note portion is of a first shade of a first color and the first tab portion is of a second shade of the first color. A first opening is defined in the first tabbed note, and which the first fastener is inserted through the opening, where the first plurality of tabbed notes is positioned at least partially in the first compartment. The second plurality of tabbed note assemblies includes a second tabbed note assembly having a second tabbed note and a second fastener. The second tabbed note has a second tab portion and a second note portion. The second note portion is of a first shade of a second color and the second tab portion is of a second shade of the second color. The second tabbed note has a second opening defined therein through which the second fastener is inserted.

These and other advantages of the present invention will become apparent upon reading the following detailed descriptions and studying the various figures of the drawings. Other features and advantages of the present invention will become apparent upon consideration of the following detailed description and the accompanying drawings, in which like reference designations represent like features throughout the figures.

In one embodiment, the body includes a first portion and a second portion, and the opening is defined at least partially in the second portion. In such an embodiment, when the tabbed note assembly is coupled to a sheet such as a sheet of paper, the first portion extends above a first edge of the sheet of paper to form a tab for the sheet of paper.

A card or a small piece of paper material that includes a tab portion may be attached to the sheet of paper using fastener to effectively enable the sheet of paper to be tabbed. When the card is fastened to the sheet of paper, the tab portion extends above or beyond an edge of the sheet of paper. Such a tab portion may be written on to enable the sheet of paper to be labeled, while the remainder of the card may be used for writing notes.

According to another aspect of the present invention, a method for forming a tabbed note assembly includes obtaining a body with an opening defined therein, obtaining a fastener, and positioning the fastener with respect to the body. The fastener is positioned such that a first portion of the fastener is on one side of the body while a second portion of the fastener is on another side of the body. A third portion of the fastener is disposed within only the opening. In one embodiment, the fastener is either a paper clip or a binder clip.

In accordance with still another aspect of the present invention, a tabbed note assembly includes at least one piece of a paper product that has a first side, a second side, a tab portion, and a note portion. The paper product has one opening. The assembly also includes a fastener that is at least partially disposed in only the one opening. When the fastener is disposed in the one opening, the fastener contacts both the first side and the second side of the paper product. In one embodiment, the paper product has a polygonal shape. In another embodiment, the paper product has a bottom edge and the fastener has a first top edge and a first bottom edge. In such an embodiment, the bottom edge of the paper product and the first bottom edge of the fastener are separated by at least approximately 0.125 inches when the first bottom edge is positioned in the note portion and the first top edge is disposed in the opening. In other embodiments, a fastener edge may extend beyond the bottom edge of the note.

Further, an aspect of the invention is that a tabbed note of the invention may be clipped to a single piece of paper in a secure, but removable manner. Before or while the tabbed note it attached, a user may write on the tabbed portion. The fastener portion of the tabbed may be reusable. For example, the note or paper portion (which has an opening or hole in a specific embodiment) of the tabbed note may be removed and a replacement paper portion (with a similar opening or hole) may be used with the same fastener.

An aspect of the invention is a kit containing tabbed notes as described above. The kit may be held in a box or other container with one or more compartments. This container may be made from plastic, glass, wood, ceramic, or other material. For example, in one embodiment, the container is clear or colored see-through plastic. The kit may be in a container that may be fully closed securely so that the kit may be moved from one location to another location easily, without a user worrying about the contents of the kit shifting or dropping out.

One compartment of a kit may hold fully assembled tabbed note assemblies. Another compartment may hold replacement tabbed notes for the tabbed note assemblies, which may be used to replace the tabbed notes of the fully assembled tabbed note assemblies when their tabbed notes are discarded. As discussed above, in an embodiment, a tabbed note has an opening or a hole. The compartment holding the replacement tabbed notes may be specially shaped to the replacement paper. For example, if the replacement tabbed notes are rectangular, the compartment will likely be rectangular, and sized just large enough to hold the replacement tabbed notes. Further, in one embodiment, the compartment may have a spindle that fits through the opening or hole in the tabbed note. This spindle will typically be sized similarly to the opening or hole and serves to hold the tabbed note more securely in place in its compartment.

Other objects, features, and advantages of the present invention will become apparent upon consideration of the following detailed description and the accompanying drawings, in which like reference designations represent like features throughout the figures.

BRIEF DESCRIPTION OF THE DRAWINGS

FIGS. 34A to 34D show an additional embodiment of the invention.

FIGS. 35A to 35D show an additional embodiment of the invention.

FIGS. 36A to 36D show an additional embodiment of the invention.

FIGS. 37A to 37D show an additional embodiment of the invention.

FIGS. 38A to 38D show an additional embodiment of the invention.

FIGS. 39A to 39D show an additional embodiment of the invention.

FIGS. 53A to 53D show an additional embodiment of the invention.

FIGS. 54A to 53D show an additional embodiment of the invention.

FIGS. 55A to 55D show an additional embodiment of the invention.

FIGS. 56A to 56D show an additional embodiment of the invention.

FIGS. 57A to 57D show an additional embodiment of the invention.

FIGS. 58A to 58D show an additional embodiment of the invention.

FIGS. 59A to 59D show an additional embodiment of the invention.

FIGS. 60A to 60B show further views of an additional embodiment of the invention.

FIGS. 61A to 61D show an additional embodiment of the invention.

FIGS. 62A to 62B show further views of an additional embodiment of the invention.

FIGS. 63A to 63D show an additional embodiment of the invention.

FIGS. 64A to 64B show further views of an additional embodiment of the invention.

FIGS. 65A to 65D show an additional embodiment of the invention.

FIGS. 66A to 66B show further views of an additional embodiment of the invention.

Figure 1A:
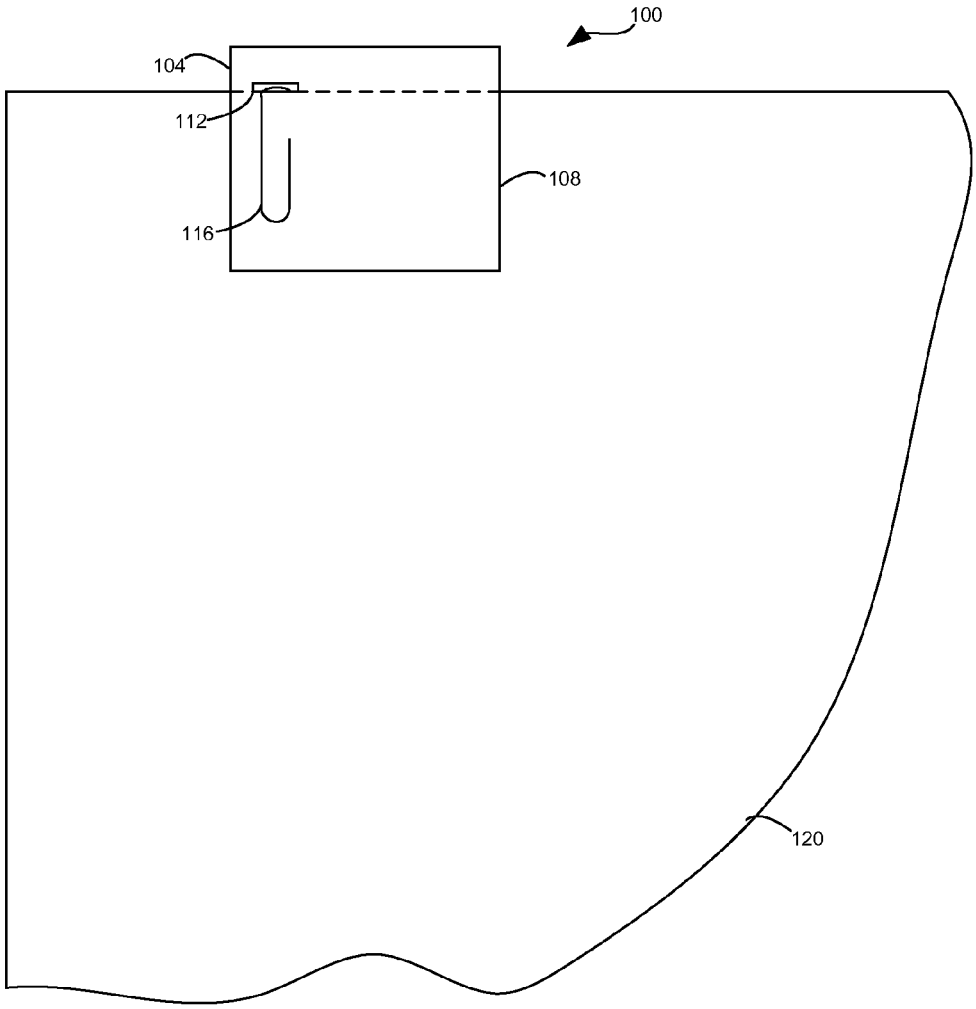
FIG. 1A is a diagrammatic representation of a tabbed note assembly fastened to a sheet of paper in accordance with an embodiment of the present invention.

FIGS. 67A to 67F show an additional embodiment of the invention.

FIGS. 68A to 68F show an additional embodiment of the invention.

FIGS. 69A to 69F show an additional embodiment of the invention.

FIGS. 70A to 70F show an additional embodiment of the invention.

FIGS. 71A to 71F show an additional embodiment of the invention.

FIGS. 72A to 72F show an additional embodiment of the invention.

FIGS. 73A to 73F show an additional embodiment of the invention.

FIGS. 74A to 74F show an additional embodiment of the invention.

FIGS. 75A to 75F show an additional embodiment of the invention.

FIGS. 76A to 76F show an additional embodiment of the invention.

FIGS. 77A to 77D show an additional embodiment of the invention.

FIGS. 78A to 78D show an additional embodiment of the invention.

FIGS. 79A to 79F show an additional embodiment of the invention.

FIGS. 80A to 80D show an additional embodiment of the invention.

FIGS. 81A to 81D show an additional embodiment of the invention.

DETAILED DESCRIPTION OF THE INVENTION

In an embodiment, the invention is an integrated tabbed note and clip. Commercially, embodiments of the invention may be known as the Clip-rite™, ClipNote™, Clip'NWrite™, ClipWrite™, TabClip™, or Tabby™. To create a tab for a sheet of paper, a card that includes a tab portion may be attached to the sheet of paper using a fastener such as a gem paper clip or a perfect gem paper clip. The gem paper clip or perfect gem paper clip is merely one example of a fastener that may be used. Regarding the origins of the gem clip: In 1901, an American named William Middlebrook invented a paper-clip making machine for the Gem Manufacturing Company in England. The paper clip from this machine is the familiar double-oval-shaped clip we use today, and is known as the "gem clip." More details of the gem paper clip and perfect gem paper clip and other fasteners are provided below.

The card includes an opening through which the fastener may be inserted. In general, the opening may be positioned such that when the fastener is inserted through the opening, and the card is fastened to one or more sheets of paper, the tab extends above the profile of one or more sheets of paper.

The position of the opening will determine the size of the tab portion. In various embodiments of the invention, the position of the opening will vary. The closer the opening is to the top edge of the card, the smaller the tab. If the opening is almost at the edge of the card, then there will be a relatively insignificant amount of tab, which may be suitable for certain applications of the invention. In other embodiment, there may be a relatively large tab area. This may allow a user write, type, print, or otherwise put more information on the tab area, which is viewable even if in a book or stack of paper. The invention may be used in indexing a collection of items.

Such a tab may be written on to enable the sheet of paper to be readily identified, while the remainder of the card, i.e., the portion of the card that does not extend above the profile of the sheet of paper when the card is fastened to the sheet of paper, may be used for writing notes. The fastener allows the card to be relatively securely fastened to a sheet of paper, and the insertion of the fastener through the opening reduces the likelihood that the fastener and the card may become separated.

Figure 1B:
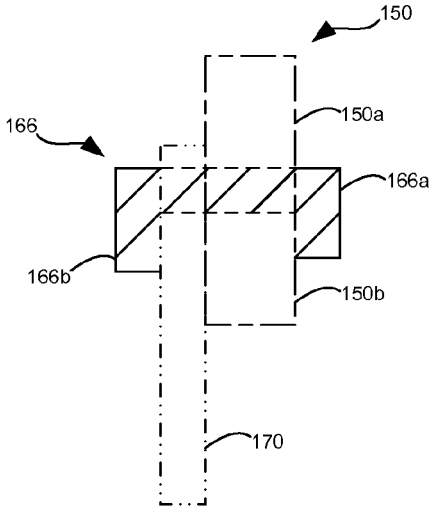
FIG. 1B is a diagrammatic cross-sectional side-view representation of a tabbed note assembly fastened to a sheet of paper in accordance with an embodiment of the present invention.
Figure 1C:
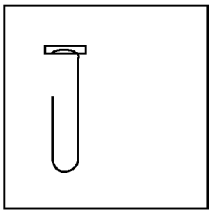
FIGS. 1C to 1H illustrates uses of the tabbed note assembly.

A fastener and a card, i.e., a tabbed note, through which the fastener is inserted may be considered to be a tabbed note assembly. FIG. 1A is a diagrammatic representation of a tabbed note assembly fastened to a sheet of paper in accordance with an embodiment of the present invention. FIG. 1B shows a cross-sectional side-view representation of a tabbed note assembly that is fastened to a sheet of paper. A tabbed note assembly 100 includes a tabbed note that includes a tab 104 and a note 108.

The tabbed note may be formed from any suitable material, preferably a material which may be written or printed on. Suitable materials include, but are not limited to, card stock, paper (natural or synthetic), plastic, rubber, polymer, polyester, animal skin, leather, natural fibers, cotton, linen, fabric, parchment, Mylar®, or vellum. Mylar is a trademark of E.I. du Pont de Nemours and Company. Such materials may be reusable as writing or printing may readily be removed from the materials using erasers or correction fluid, for example, and new writing or printing may be placed on the materials. Permanent writing or printing may also be used.

Tabbed note assembly 100 also includes a fastener 116 that is arranged to enable tabbed note assembly 100 to be fastened to or otherwise attached to a sheet of paper 120 or a document. The tabbed note assembly may also be fastened to other items such as, for example, cardboard, wood, book or binder cover, folder, plastic, polymer, and others. In the described embodiment, fastener 116 is a gem paper clip. However, as will be described below, e.g., with respect to FIGS. 3A to 3C and FIGS. 11A to 11D, fastener 116 may generally be any suitable fastener.

FIG. 1A shows fastener 116, when fastener 116 is placed through an opening 112. The opening should be large enough to allow the fastener to be inserted through it. This opening may be a hole or cutout. In the figure, the opening is a rectangularly shaped opening. However, the opening may be any shape including polygon, trapezoid, square, circle, or ellipse. Also, opening 112 may be a slit, cut, tear, or perforation through which the fastener is inserted. A cut or slit may be made in any line form, such as a straight line of a certain length, zigzag, pocket (U-shaped or upside-down U-shaped line), curved, a combination of straight lines, and others. The length of the cut or slit should be long enough to allow the fastener to be inserted through it. As discussed above, the location of the opening for the fastener may vary depending on the specific implementation of the invention.

Figure 1D:
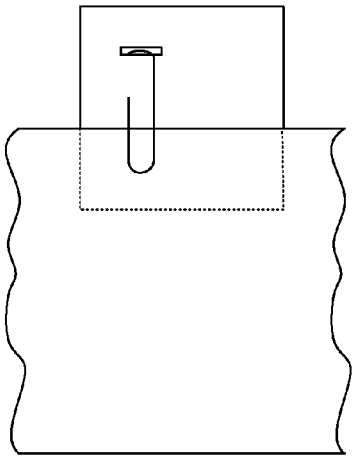
Figure 1E:
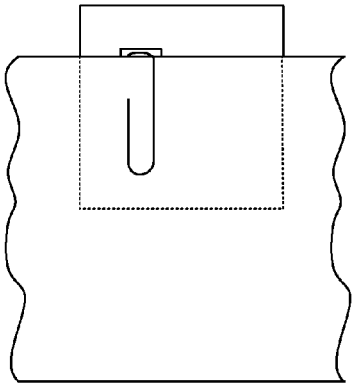
Figure 1F:
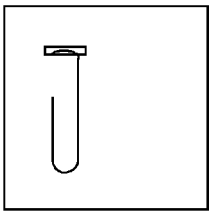
Figure 1G:
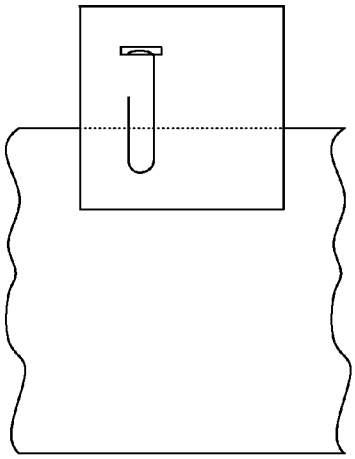
Figure 1H:
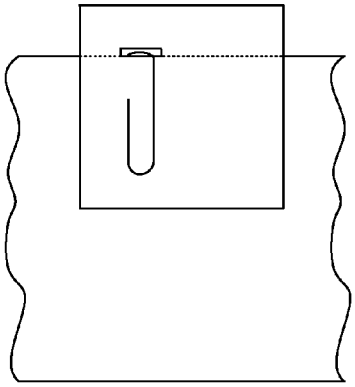
Figure 1I:
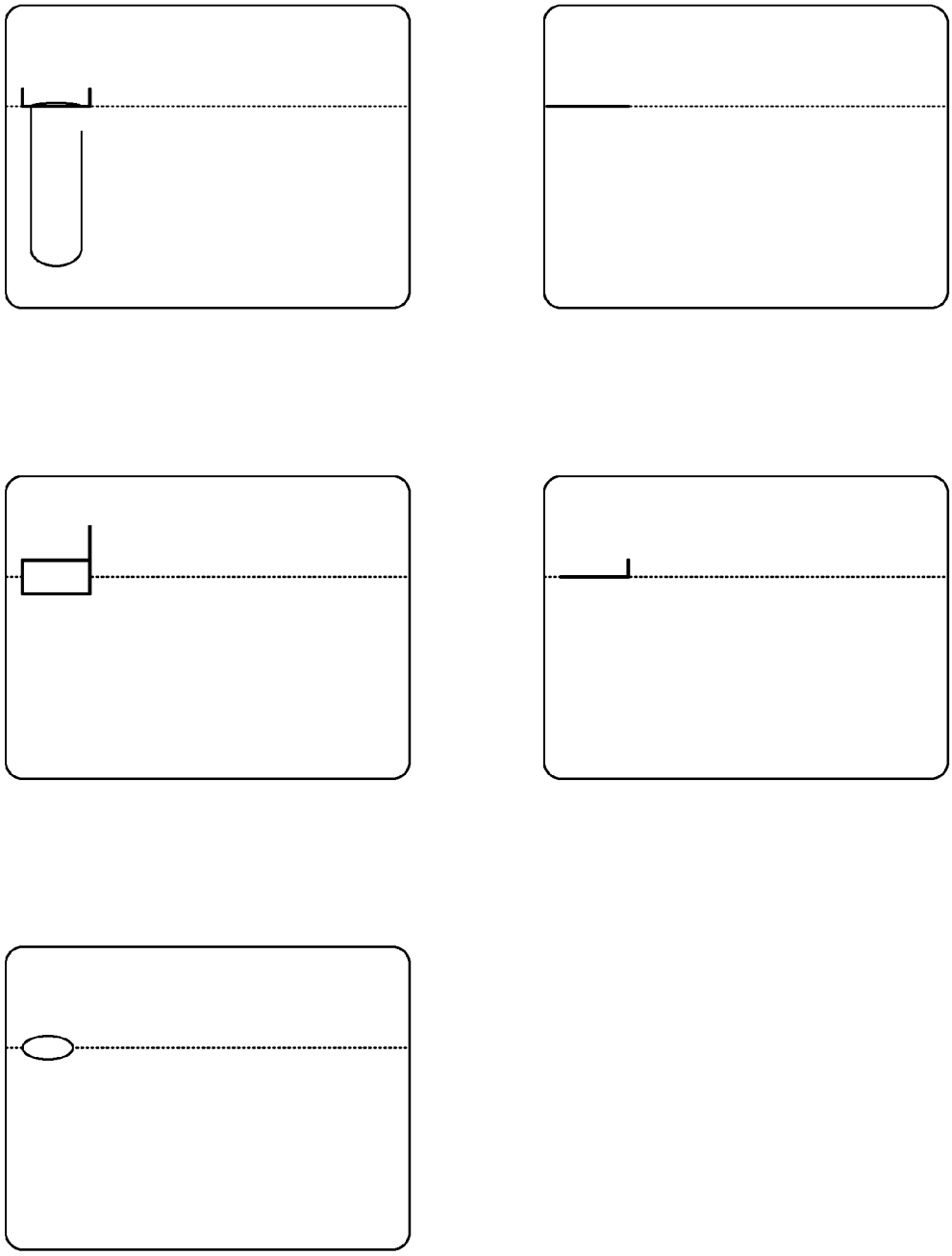
FIG. 1I illustrates various embodiments of an opening or a slit in accordance with the present invention.

FIG. 1I shows various embodiments of an opening or slit of the present invention. As shown, an opening may have various shapes, sizes, or configurations. Generally, an opening is configured and sized to enable a desired fastener to be readily inserted through. In further embodiments of the invention, the area around the opening for fastener may be reinforced with paper, cloth, plastic, laminate, or any other suitable material. Reinforcing the area around an opening will generally increase the durability of the tabbed note assembly.

Returning to FIG. 1A, when fastener 116 is in place with respect to sheet 120 (i.e., when fastener 116 is clipped to sheet 120), tab 104 is effectively a top portion of the tabbed note and arranged so tab 104 extends or protrudes above a top of sheet 120. A user may write information on tab 104. This information will remains visible even when sheet 120 is in a stack with other sheets 120. Note 108, which may be considered to be a base portion of the tabbed note, is arranged such that a user may make notations on note 108. FIG. 1A shows the note 108 of the tabbed note on top of sheet 120. However, in other embodiments of the invention, the note may be behind sheet 120, and the fastener will be on top of the sheet. Fastener 116 is arranged such that when tabbed note assembly 100 is fastened to sheet 120, fastener 116 is effectively fastened about both sheet 120 and the tabbed note.

A tabbed note assembly which includes a tabbed note 150 and a fastener 166 is clipped to a sheet of paper 170. Fastener 166 passes through tabbed note 150, and is arranged such that a note or base portion 150*b* of tabbed note 150 and sheet 170 are disposed between a front side 166*a* and a back side 166*b* of fastener 166. When note 150*b* and sheet 170 are disposed between front side 166*a* and back side 166*b* of fastener 166, a tab or top portion 150*a* of tabbed note 150 is positioned such that tab 150*a* effectively extends above sheet 170. It should be appreciated that front side 166*a* of fastener 166 may generally be a front loop or a front leg of fastener 166, while back side 166*b* of fastener 166 may generally be a back loop or a back leg of fastener 166.

FIGS. 1C to 1H show uses or applications of the invention. FIG. 1E shows a how a user may use a tabbed note assembly where the bottom portion is placed behind a sheet, while FIG. 1H shows a how a user may use a tabbed note assembly where the bottom portion is placed in front of the sheet. Further, it can be appreciated that the user may insert the entire tabbed note assembly completely into the sheet, until the tabbed note assembly can no longer be inserted further in the sheet. Or the user may insert the entire tabbed note assembly partially into the sheet, such as shown in FIGS. 1D and 1G. For example, the tabbed note assembly may be inserted 10, 15, 20, 25, 27, 28, 30, 40, 50, 60, 70, 80, 90, or any other percentage into the sheet.

The tabbed note assembly of the invention is two-sided and either side may be the front or the back. Furthermore, a user may use one side. Then later decide to flip the tabbed note assembly around and use the second side. So, the tabbed note assembly may be thought of as being usable at least two times. After the tabbed note assembly is complete used and is no longer needed, the user may remove the fastener and use it as a stand-alone fastener. This reduces the amount of waste that ends up going to landfills.

Figure 2A:
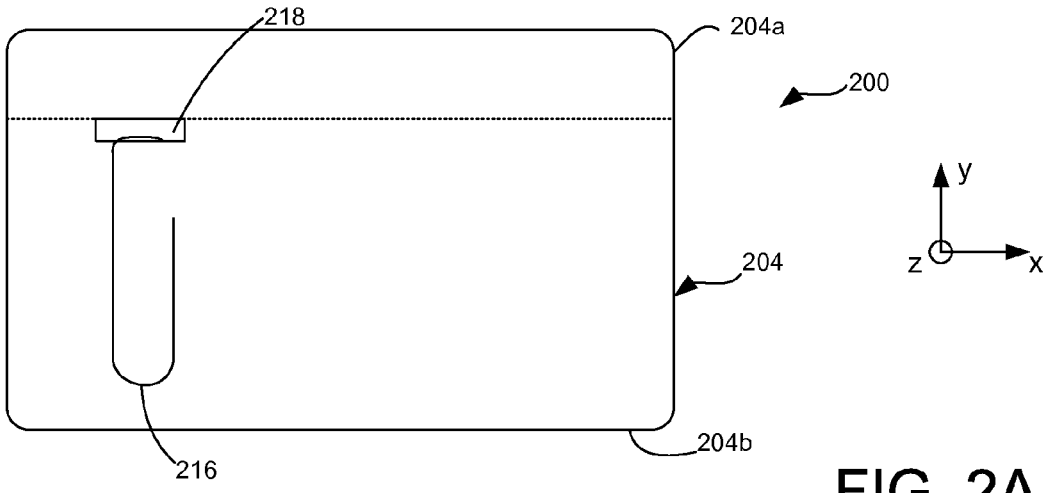
FIG. 2A is a diagrammatic representation of a front side of a tabbed note assembly with a first fastener in accordance with an embodiment of the present invention.
Figure 2B:
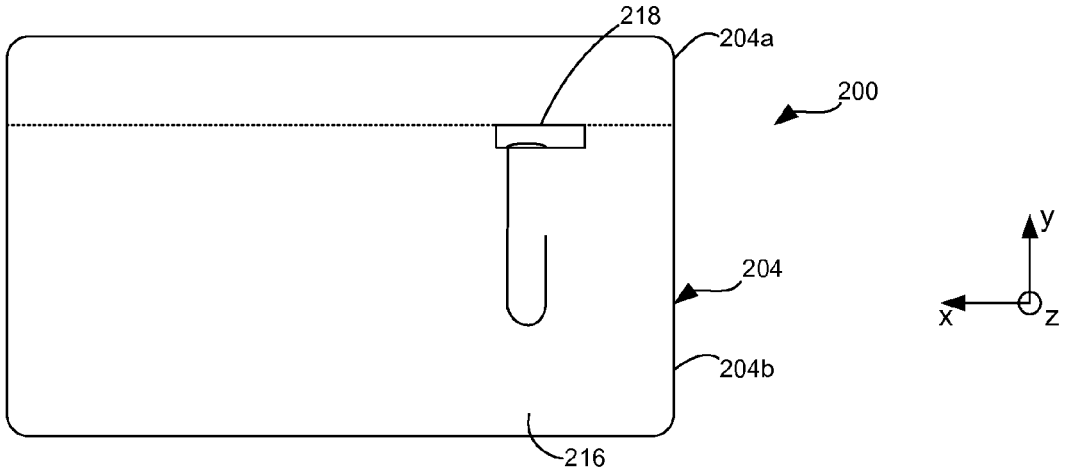
FIG. 2B is a diagrammatic representation of a back side of a tabbed note assembly, i.e., tabbed note assembly 200 of FIG. 2A, in accordance with an embodiment of the present invention.
Figure 2C:
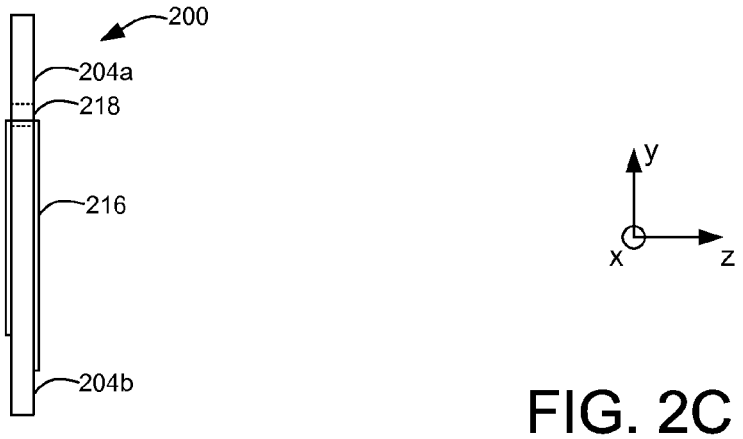
FIG. 2C is a diagrammatic cross-sectional side-view representation of a tabbed note assembly, i.e., tabbed note assembly 200 of FIG. 2A, in accordance with an embodiment of the present invention.

With reference to FIGS. 2A to 2C, a tabbed note assembly that utilizes a gem paper clip will be described in more detail in accordance with an embodiment of the present invention. A tabbed note assembly 200 includes a fastener 216 and a tabbed note 204 which has a tab 204*a* and a note 204*b*. Fastener 216, which is shown as a gem paper clip in the described embodiment, is positioned such that fastener 216 passes through an opening 218 in tabbed note 204. It should be appreciated that fastener 216 is partially disposed in only opening 218. Hence, even if other openings (not shown) are included in tabbed note 204, fastener 216 is substantially only partially disposed in opening 218.

A typical paper clip has two loops, a larger loop and a smaller loop. A portion of fastener 216, e.g., a small loop of fastener 216, is positioned in contact with a back side or surface of tabbed note 204 while another portion of fastener 216, e.g., a large loop of fastener 216, is positioned in contact with a front side or surface of tabbed note 204. Still another portion of fastener 216 remains substantially within opening. Opening 218 may be substantially any size or shape which allows fastener 216 to pass through.

FIGS. 2A to 2C show merely one embodiment of the invention and there are many possible variations. For example, in an alternative embodiment of the invention, the small loop of the fastener is positioned to contact the front surface of the tabbed note, while the large loop of the fastener is positioned to contact the back surface of the tabbed note. Further, the tabbed note shown has rounded corners on four sides. In other embodiments, there may be rounded corners on any number of sides such as one, two, three, or more (in the case the tabbed note is a polygon having more than four corners). For example, one implementation has two rounded corners for the upper tab 204*a* portion, and two nonrounded corners (e.g., square corner) for the lower tab 204*b*. The amount of rounding of the rounded corners may vary.

As mentioned above, fasteners used in tabbed note assemblies may vary widely. While a gem paper clip is one suitable fastener, another suitable fastener is a perfect gem paper clip. It should be appreciated that a perfect gem paper clip is also commonly known as a perfected gem paper clip, a perfect paper clip, a Gothic paper clip, or a spear paper clip. Other fasteners may include binder clips, presentation clips, clasps, banker's clasps, slide clips. These fasteners may be made of any material including metal, plastic, ceramic, polymer, stainless steel, steel, iron, copper, gold, silver, sterling silver, titanium, aluminum, brass, bronze, palladium, ruthenium, rhodium, osmium, iridium, and platinum. Some versions of the fasteners may include precious, semiprecious, and simulated stones including diamond, ruby, sapphire, emerald, agate, crystal, turquoise, garnet, rose quartz, amethyst, onyx, aquamarine, bloodstone, tanzanite, alexandrite, peridot, lapis, opal, tourmaline, topaz, zircon, and others. Also, the size of the fastener may vary depending on the use anticipated. Bigger fasteners may generally be used when there is more to clasp together while smaller fasteners may generally be used when there is less to clasp together.

Figure 3A:
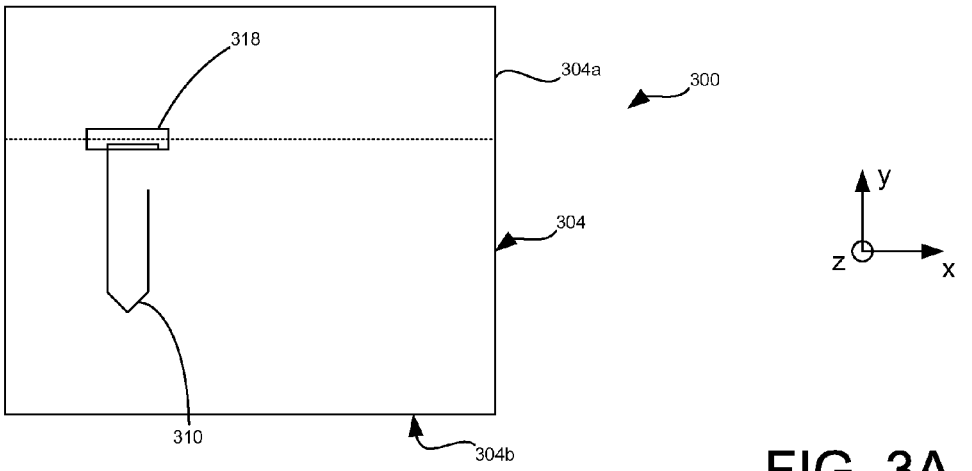
FIG. 3A is a diagrammatic representation of a front side of a tabbed note assembly with a second fastener in accordance with an embodiment of the present invention.
Figure 3B:
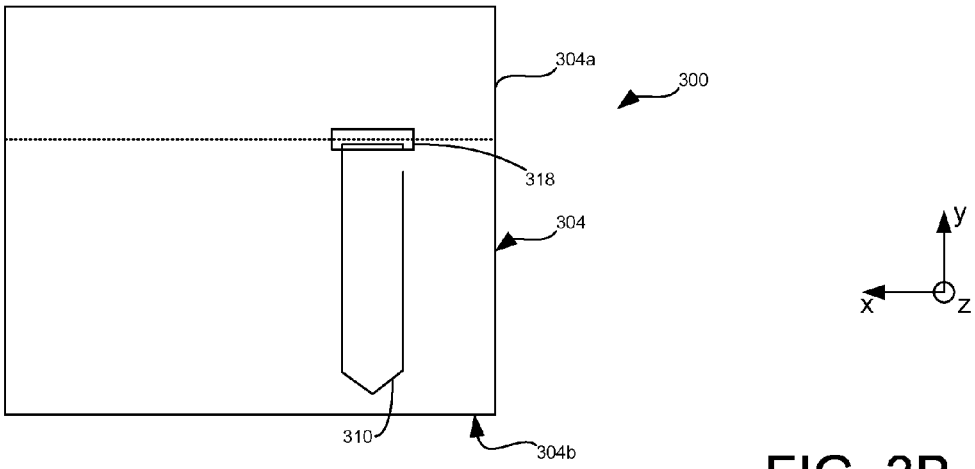
FIG. 3B is a diagrammatic representation of a back side of a tabbed note assembly, i.e., tabbed note assembly 300 of FIG. 3A, in accordance with an embodiment of the present invention.
Figure 3C:
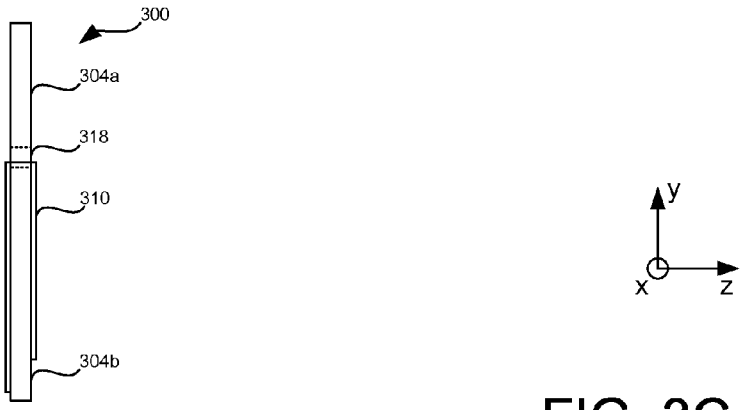
FIG. 3C is a diagrammatic cross-sectional side-view representation of a tabbed note assembly, i.e., tabbed note assembly 300 of FIG. 3A, in accordance with an embodiment of the present invention.

FIGS. 3A to 3C are diagrammatic representations of different views of a tabbed note assembly which includes a perfect gem paper clip in accordance with an embodiment of the present invention. The dimensions or aspect ratio of the tabbed note are different from the embodiment in the previous figures. Also the corners are not rounded. The aspect ratio of a tabbed note may be any ratio including 0.5:1, 0.6:1, 0.7:1, 0.8:1, 1:1 (i.e., square), 1.2:1, 1.3:2, 4:3, 1.4:1, 1.66, 16:9 (high-definition or HDTV wide screen), 1.85:1, 1.9:1, 2:1, 2.35:1, 2.4:1, and 2.5:1. The aspect ratio or aspects of the invention may be associated with the Fibonacci series. The Fibonacci numbers proceed in a sequence 0, 1, 1, 2, 3, 5, 8, 13, 21, 34, 55, and so forth. A tabbed note may be a golden rectangle. An aspect ratio of the invention may be the golden ratio or Phi (which is also known sometimes as the golden number or golden mean) of:

1.6180339887498948482045868343656381177203091798057

In specific embodiments, a tabbed note may have dimensions such that the tabbed note is approximately three inches by approximately three inches.

Further, as discussed above, the tabbed note is not limited to being a four-sided polygon. Further, in some instances, a tabbed note may not be a polygon. For example, the shape of the tabbed note may be a triangle, such as a golden triangle which is an isosceles triangle with a hypotenuse to the base ratio being the golden ratio. The shape of a tabbed note may be an octagon, pentagon, circle, ellipse, oval, or a random or nonrandom geometrical or other shape. The shape may be representative of a character or person (fictional or nonfictional), cartoon character such as Winnie the Pooh, celebrity, badge, emblem, flag, flower, tree, bush, cat, dog, food, milk carton, cheese, animal, silhouette, shoe, automobile, motorcycle, car, truck, plane, rocket, missile, box, building, monument, spaceship, boat, ship, musical instrument, toy, baby, object, ball, sunglass frame, beer stein, bottle, baby bottle, star, comet, planet, heavenly object, religious symbol, rock, stone, glass, fishing reel, ring, alphabetic letter, Chinese character, Japanese character, Korean character, smile, frown, mask, company logo, computer component, human organs and human body parts including chest, breast, nipple, heart, lung, liver, kidney, intestine, brain, eye, nose, ear, leg, knee, ankle, head, foot, hand, big toe, big thumb, index finger, three fingers, lips, tongue, neck, or other shapes, or combinations of these.

A tabbed note assembly 300 includes a fastener 310 that is a perfect gem paper clip. A perfect gem paper clip will be described below with reference to FIG. 4A. Like fastener 216 of FIGS. 2A to 2C, fastener 310 is positioned such that fastener 310 passes through an opening 318 in a tabbed note 304 of tabbed note assembly 300. Part of fastener 310 is arranged to be in contact with a front side or surface of tabbed note 304 while another part of fastener 310 is positioned in contact with a back side or surface of tabbed note 304.

When the tabbed note assembly of FIG. 3A is attached to a sheet, an edge of that sheet will lie approximately along the dashed line shown. The sheet will overlap with the tabbed note assembly below the dashed line. Above the dashed line will be the portion that shows or is substantially nonoverlapping with respect to the sheet or sheets. It should be appreciated that the position of the dashed line will typically vary depending upon the position of the fastener. The dashed line may be positioned at the top, bottom, or such that the dashed line effectively passes through the opening that accommodates a fastener. Further, as previously discussed, in other embodiments, a fastener may not necessarily be fully inserted through a tabbed note assembly. Also, the position of the opening or hole may vary with respect edges of the tabbed note.

In the implementation of FIG. 3B, an end of a fastener clip is shown on the right hand side. In other implementations, the end of a fastener clip may be on the left hand side.

Figure 4A:
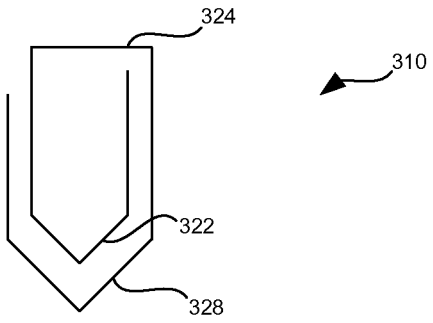
FIG. 4A is a diagrammatic representation of a fastener, i.e., fastener 310 of FIG. 3A, in accordance with an embodiment of the present invention.

Referring next to FIG. 4A, perfect gem paper clip 310 will be described in accordance with an embodiment of the present invention. Perfect gem paper clip 310 generally includes a top area 324 that is effectively a connector that connects a first winding 328, or a large loop, of perfect gem paper clip 310 with a second winding 322, or a small loop, of perfect gem paper clip 310. Top area 324 is generally a straight portion of perfect gem paper clip 310. As will be appreciated by those skilled in the art, perfect gem paper clip 310 is formed by bending a wire.

Figure 4B:
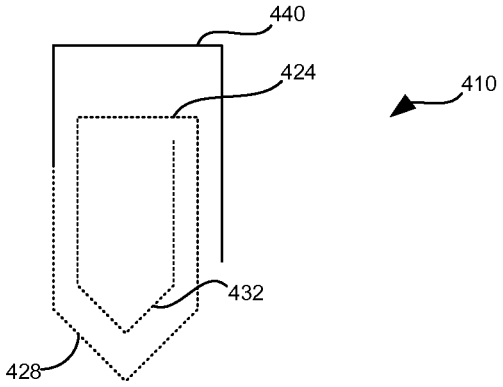
FIG. 4B is a diagrammatic representation of an extended fastener in accordance with an embodiment of the present invention.

While perfect gem paper clip 310 is suitable for use as a part of a tabbed note assembly such as tabbed note assembly 300 of FIGS. 3A to 3C, a variation of a perfect gem paper clip 310 may provide additional stiffness to a tab of a tabbed note. FIG. 4B is a diagrammatic representation of an extended perfect gem paper clip in accordance with an embodiment of the present invention. An extended perfect gem paper clip 410 includes a top area 424 that is arranged to substantially contact an edge of an opening of a tabbed note. An inner loop 432 and an outer loop 428 are connected by top area 424. Inner loop 432, outer loop 428, and top area 424, which are indicated by a dotted line, effectively form a perfect gem paper clip.

Figure 4C:
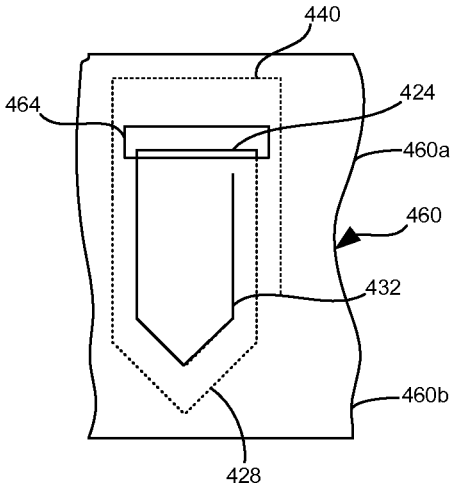
FIG. 4C is a diagrammatic representation of an extended fastener, i.e., extended fastener 410 of FIG. 4B, inserted through an opening of a tabbed note in accordance with an embodiment of the present invention.

An extension 440, as shown by a solid line, extends from outer loop 428. As shown in FIG. 4C, when extended perfect gem paper clip 410 is inserted into a portion of a tabbed note 460 that includes a tab 460*a* and a note 460*b*, inner loop 432 is positioned on a first side of tabbed note 460, while outer loop 428 and extension 440 are positioned on a second side of tabbed note 460. Top area 424 is positioned substantially within an opening 464 in tabbed note 460. Extension 440 is arranged to provide stiffness to tabbed area 460, i.e., extension 440 effectively reinforces tabbed area 460*a*.

Figure 4D:
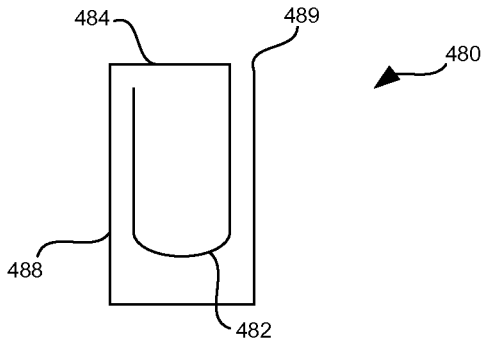
FIG. 4D is a diagrammatic representation of a fastener in accordance with an embodiment of the present invention.

Another variation of a gem paper clip is show in FIG. 4D. FIG. 4D is a diagrammatic representation of a paper clip in accordance with an embodiment of the present invention. Paper clip 480 includes an inner loop 482 (or shorter loop) and an outer loop 488 (or longer loop). Outer loop 488 is shaped such that a bottom of outer loop 488 includes a number of substantially right angle, or ninety degree, bends. The angles need not be exactly ninety degrees, but approximately. The corner may not be exactly squared, but slightly rounded as a result of the machinery and manufacturing process to make such paper clips. For example, the bends of outer loop may have bends that are visually ninety degree angles. For example, the bends may be in a range from 70 to 90 degrees, 80 to 90 degrees, 85 to 90 degrees, 86 to 90 degrees, 87 to 90 degrees, 88 to 90 degrees, 89 to 90 degrees, or other ranges. Squared perfect gem paper clip 480 includes four substantially right angle bends, in the described embodiment.

In this implementation, the inner loop is a rounded loop. The rounded portion or arc portion of the loop may be any degree of rounding and the width of the loop may vary as desired. In other words, this paper clip implementation has a longer square loop with a shorter rounded loop. When used in the tabbed note assembly of the invention, this paper clip will permit ease in inserting (and removing) the tabbed note assembly to (and from) a sheet or other item, which the tabbed note assembly is being clipped to.

In other implementations of the invention, the fastener may be another type of paper clip. For example, another paper clip may have a triangular, more pointed loop as the shorter loop (like the perfect gem clip) and the square loop as the longer loop. Another clip may have the square loop as the shorter loop and the triangular, more pointed loop as the longer loop (like the perfect gem clip). Another clip may have the square loop as the shorter loop and the rounded loop as the longer loop. There are many combinations and variations of a paper clip design and any of these variations or combinations may be used in a tabbed note assembly of the invention.

Figure 4E:
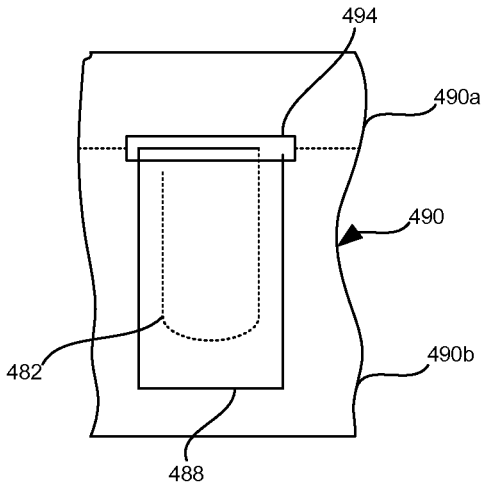
FIG. 4E is a diagrammatic representation of a fastener of FIG. 4D inserted through an opening of a tabbed note in accordance with an embodiment of the present invention.

In an embodiment, an end 489 of outer loop 488 may be arranged to be at our about the same distance from the bottom of outer loop 488 as a top area 484 that couples inner loop 482 to outer loop 488, although the positioning of end 489 of outer loop 488 may vary. When paper clip 480 is inserted through an opening 494 in a tabbed note 490 that includes a tab 490*a* and a note 490*b*, as shown in FIG. 4E, inner loop 482 is positioned on a back side of tabbed note 460 while outer loop 488 is positioned on a front side of tabbed note 460. Top area 494 is positioned within opening 494.

In one embodiment, a bottom of outer loop 488 may be arranged to be substantially flush with a bottom of tabbed note 490. In addition to being suitable for use with various types of fasteners, e.g., paper clips, tabbed notes may have varied configurations. By way of example, a tabbed note may be configured to be used in a variety of different orientations.

Figure 4F:
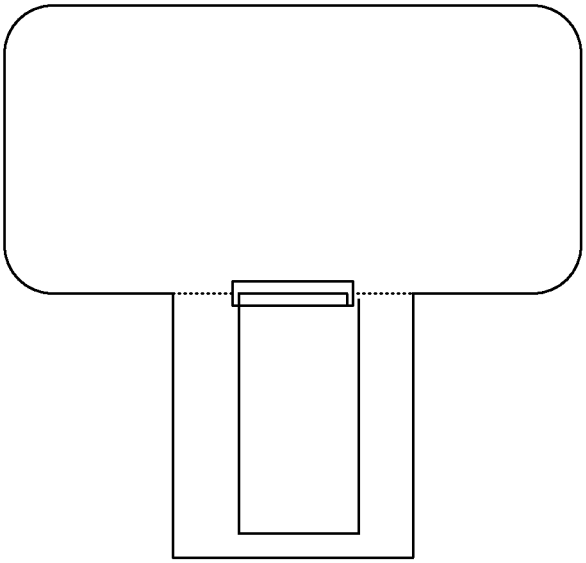
FIG. 4F is a diagrammatic representation of an embodiment of the present invention in which a top portion of a tabbed note is oval-like in shape, and in which at least one of shorter and longer loops of a fastener are of a square-type.
Figure 4G:
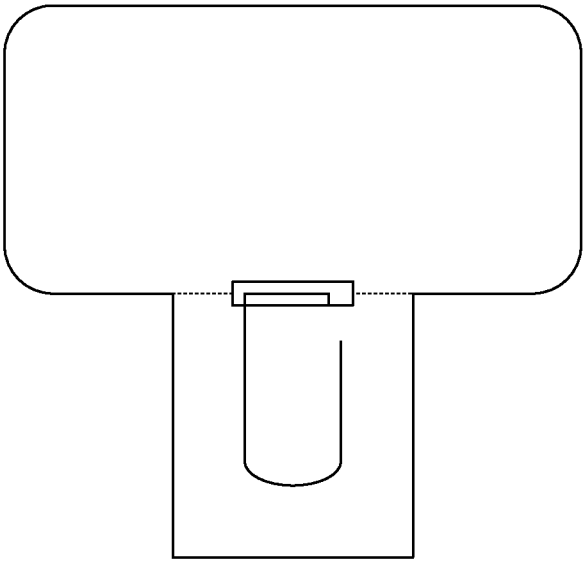
FIG. 4G is a diagrammatic representation of a reverse side of a tabbed note assembly as shown in FIG. 4F.

FIG. 4F and shows an embodiment of the present invention in which the top portion of a tabbed note is substantially oval-like. FIG. 4G shows the reverse side of the tabbed note assembly of FIG. 4F. The bottom portion of the tabbed note is substantially rectangular, and is smaller than the top portion. Although the fastener shown is one that includes a squared longer loop and a rounded shorter loop, as shown in FIG. 4G, it should be understood that substantially any fastener may be used. The shape of this embodiment of the tabbed note assembly may be referred to as "T-like" or "mushroom-like" because the tabbed note resembles a mushroom or a letter "T."

Figure 5A:
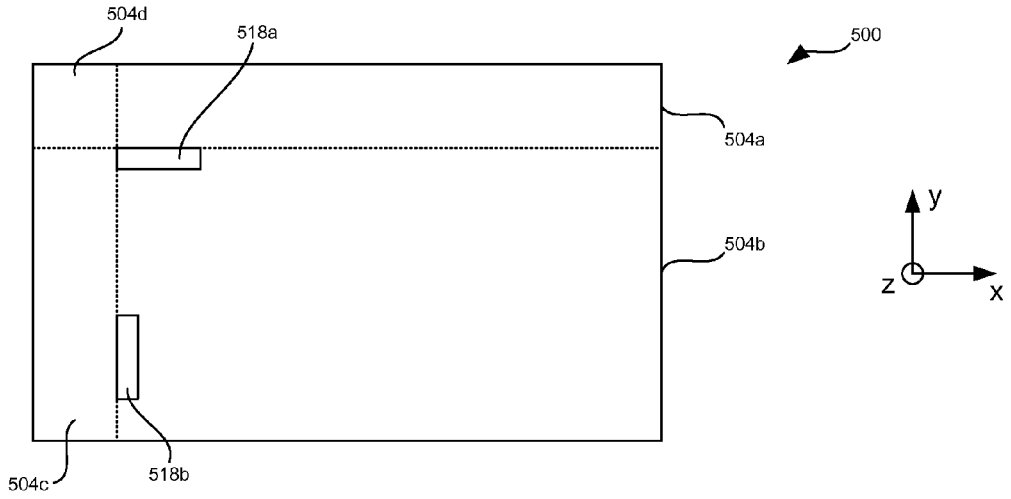
FIG. 5A is a diagrammatic representation of a tabbed note portion of a tabbed note assembly which includes two openings in accordance with an embodiment of the present invention.
Figure 5B:
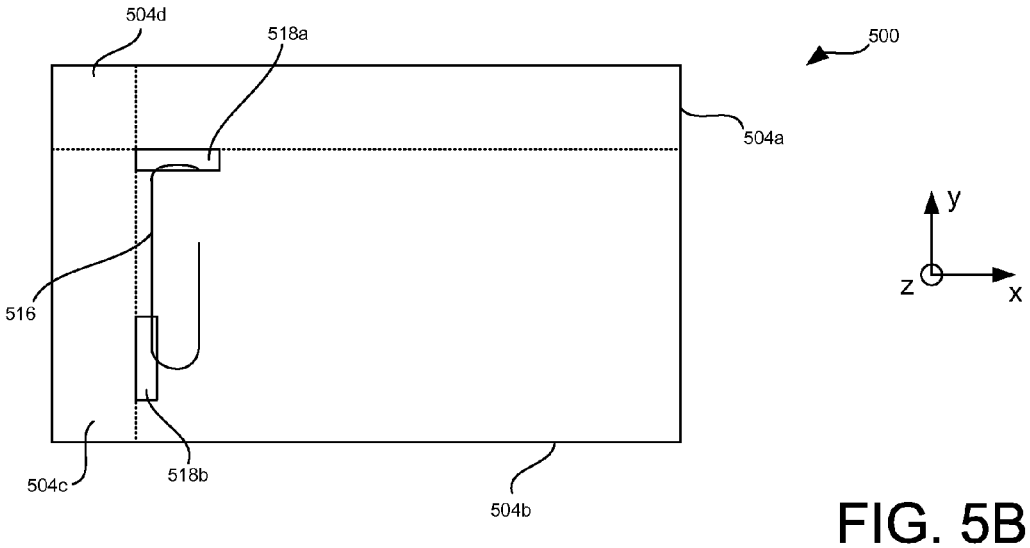
FIG. 5B is a diagrammatic representation of a tabbed note portion of a tabbed note assembly, i.e., tabbed note portion 500 of FIG. 5A, with a fastener located in a first orientation in accordance with an embodiment of the present invention.
Figure 5C:
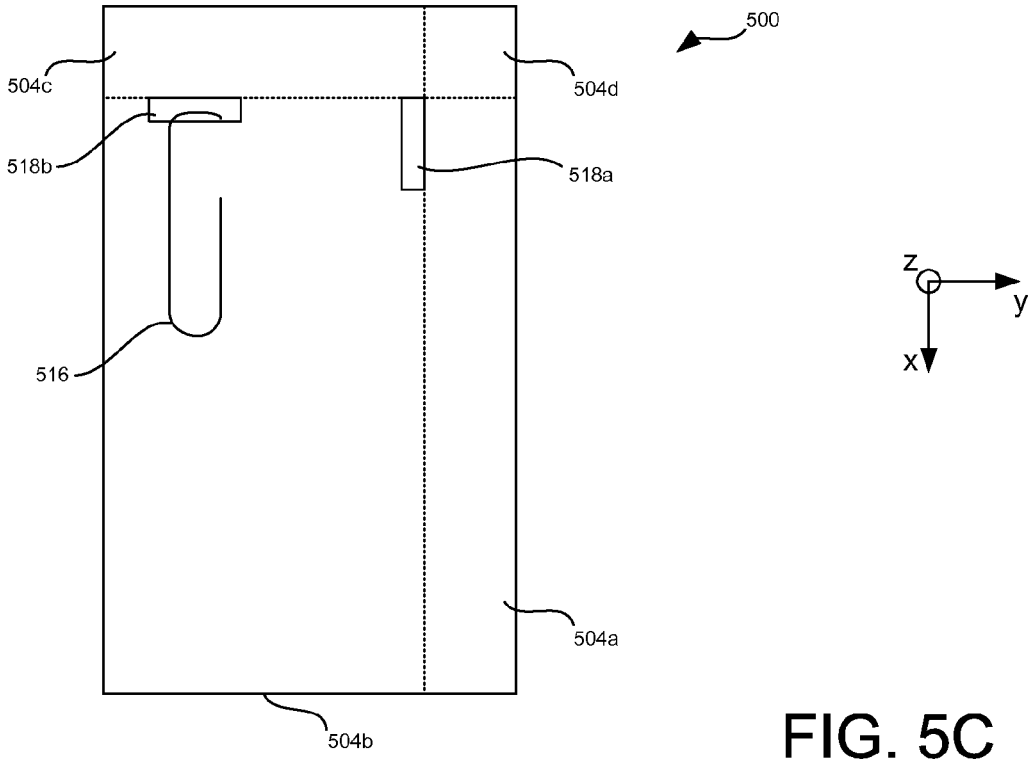
FIG. 5C is a diagrammatic representation of a tabbed note portion of a tabbed note assembly, i.e., tabbed note portion 500 of FIG. 5A, with a fastener located in a second orientation in accordance with an embodiment of the present invention.

With reference to FIGS. 5A to 5C, a tabbed note which includes more than one opening through which a fastener may be inserted will be described in accordance with an embodiment of the present invention. FIG. 5A shows a tabbed note 500 that includes areas 504*a*-504*d* and openings 518*a*, 518*b*. Area 504*b* is arranged to be a note area in which notes may be printed or written, regardless of the orientation in which tabbed note 500 is used.

When tabbed note 500 is in a first orientation, a fastener 516, which is shown as a gem paper clip in FIG. 5B, is inserted through a first opening 518*a*. When tabbed note 500 is in the first orientation, areas 504*a*, 504*d* form a tab while areas 504*b*, 504*c* form a note. Alternatively, when tabbed note 500 is in a second orientation, fastener 516 is inserted through a second opening 518*b*, as shown in FIG. 5C. Areas 504*c*, 504*d* form a tab while areas 504*a*, 504*b* for a note when tabbed note 500 is in the second orientation. It should be appreciated that fastener 516 is partially disposed in only one opening 518*a*, 518*b* at any given time. That is, fastener 516 does not pass through and is not partially disposed in more than one opening 518*a*, 518*b*.

Figure 6A:
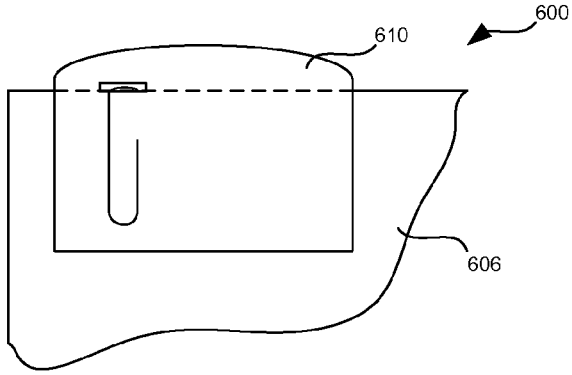
FIG. 6A is a diagrammatic representation of a tabbed note assembly with a first variation on a tab portion in accordance with an embodiment of the present invention.
Figure 6B:
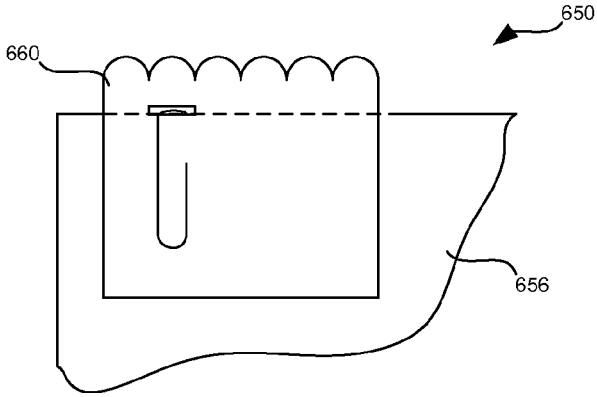
FIG. 6B is a diagrammatic representation of a tabbed note assembly with a second variation on a tab portion in accordance with an embodiment of the present invention.

Although a tab of a tabbed note has been shown as having a substantially rectangular shape, it should be appreciated that a tab may take on a variety of different shapes. By way of example, a tab may have a curved shape or a scalloped shape. FIG. 6A is a diagrammatic representation of a tab with a curved profile in accordance with an embodiment of the present invention. A tabbed note assembly 600 includes a tab 610 with a curved upper edge which, when tabbed note is coupled to a sheet 606, extends above an edge of sheet 606. FIG. 6B is a diagrammatic representation of a tab with a scalloped profile in accordance with an embodiment of the present invention. A tabbed note assembly 650 includes a tab 660 with a scalloped upper edge. The scalloped upper edge of tab 660, when tabbed note assembly 650 is coupled to sheet 656, extends above sheet 656. That is, the overall shape of a tab may vary widely.

Figure 7A:
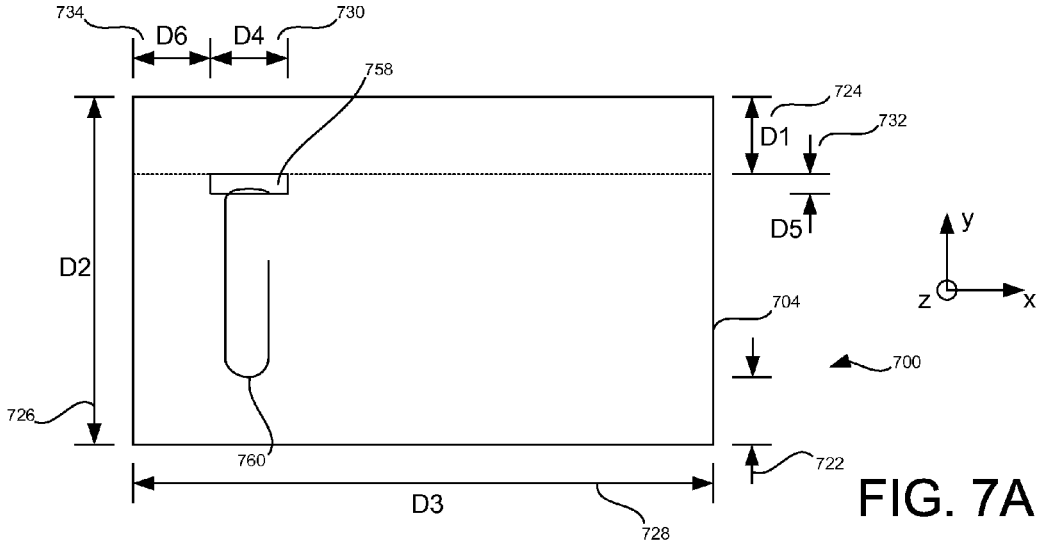
FIG. 7A is a diagrammatic representation of a tabbed note assembly as shown with approximate dimensions in accordance with an embodiment of the present invention.
Figure 7B:
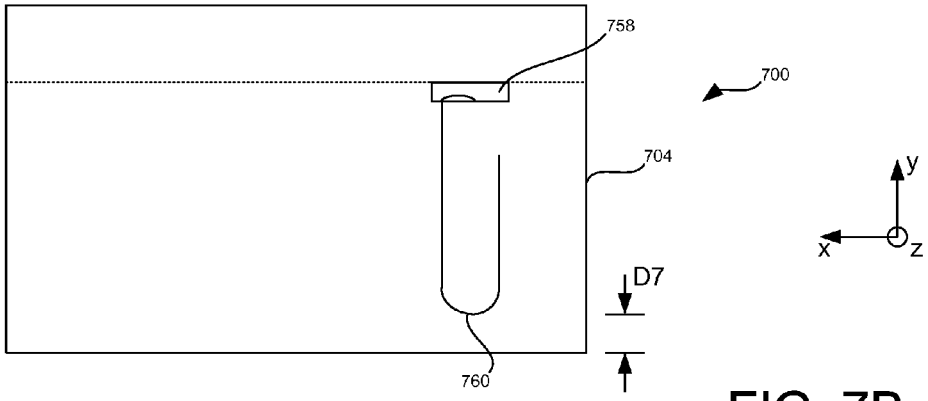
FIG. 7B is a diagrammatic representation of a tabbed note assembly, i.e., tabbed note assembly 700 of FIG. 7A, as shown with approximate dimensions in accordance with an embodiment of the present invention.

In general, the dimensions associated with a tabbed note assembly may vary widely. Referring next to FIGS. 7A and 7B, the dimensions associated with a tabbed note assembly will be described in accordance with an embodiment of the present invention. Within a tabbed note assembly 700, the dimensions may vary widely depending upon a variety of different factors. By way of example, a fourth dimension 730, which is a width of an opening 758 through which a fastener such as a paper clip 760 may be inserted, and a fifth dimension 732, which is a height of opening 758, may vary depending upon the shape and the size of paper clip 760. A height 726 and a width 728 of tabbed note assembly 700, as well as a height of a tab 724, may vary depending upon the requirements of a particular application for which tabbed note assembly 700 is intended. A distance 734 between an edge of tabbed note assembly 700 and an edge of opening 758 may be selected to be large enough to substantially prevent tearing of tabbed note 704 when tabbed note assembly 700 is in use or when paper clip 760 is being inserted into tabbed note 704.

Figure 7C:
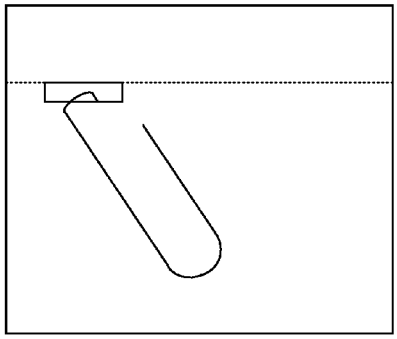
FIG. 7C is a diagrammatic representation of a tabbed note assembly in which a fastener is rotated at an angle compared to a fastener that is inserted in a substantially vertical orientation.

In one embodiment, a dimension 722 which is a distance between a bottom of a small or inner loop of paper clip 760 and a bottom of tabbed note 704 may be chosen to facilitate the insertion of tabbed note assembly 700 over a sheet of paper. Dimension 722 is generally defined as being greater than zero. By way of example, in one embodiment, dimension 722 is selected as being at least approximately 0.03125 inches. In further embodiments of the invention, the shorter loop of the paper clip may extend beyond the bottom edge of the note. It should be appreciated that the orientation of a fastener such as paper clip 760 may vary. For instance, though paper clip 760 is shown as having at least one substantially straight edge in an approximately parallel orientation with respect to a side of tabbed node 704, paper clip 760 is not limited to being arranged in such an orientation, e.g., a vertical orientation. FIG. 7C shows a further embodiment of the present invention in which a fastener such as a paper clip is rotated at an angle compared to a vertical fastener. The angle of rotation may be widely varied.

Figure 8:
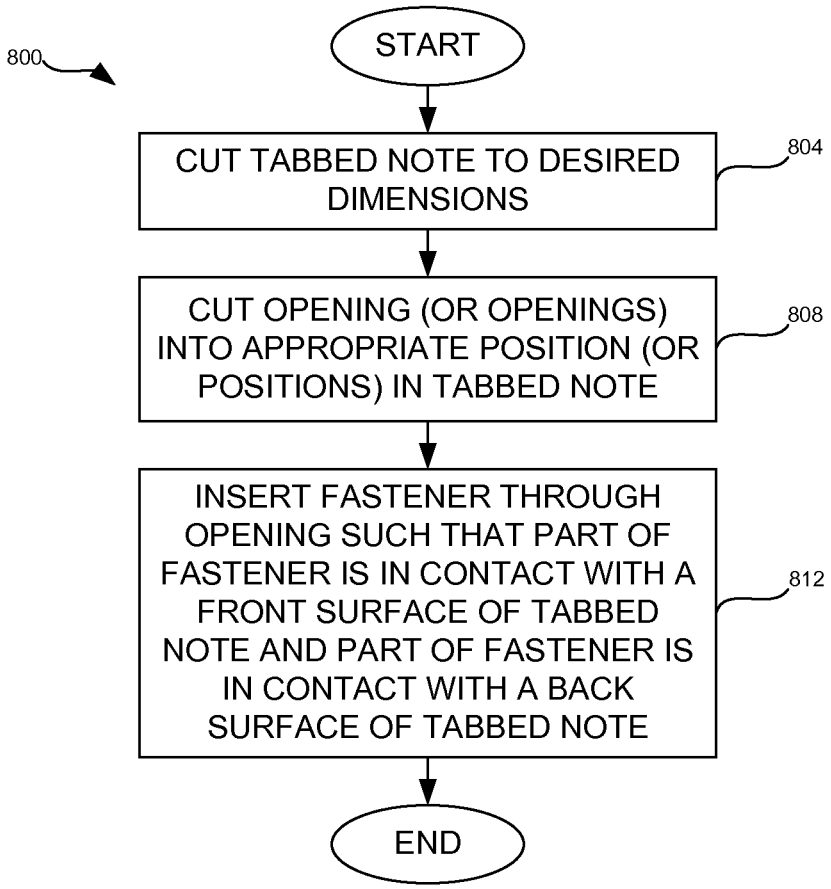
FIG. 8 is a process flow diagram which illustrates one method of forming a tabbed note assembly in accordance with an embodiment of the present invention.

With reference to FIG. 8, the steps associated with one method of assembling a tabbed note assembly will be described in accordance with an embodiment of the present invention. A process 800 of assembling a tabbed note assembly begins at step 804 in which a tabbed note is cut to desired dimensions. A tabbed note may generally be cut using any suitable paper cutter, as for example a paper cutter that utilizes a laser to form cuts or a paper cutter which is arranged to stamp out the tabbed note from a large sheet. A cutting process may be either a manual process or an automated process. Once the tabbed note is cut to desired dimensions, an opening is then cut in step 808 into an appropriate position in tabbed note. Alternatively, the tabbed note and the opening may be cut at the same time instead of in separate steps. In some instances, multiple openings may be cut into multiple positions in the tabbed note. Cutting the openings may be achieved, in one embodiment, through a stamping process.

After an opening is cut into the tabbed note, a fastener is inserted through the opening in step 812. The fastener, which may be a paper clip or a binder clip, is inserted through the opening either manually or automatically such that part of the fastener is in contact with a front surface of the tabbed note and another part of the fastener is in contact with a back surface of the tabbed note. When the fastener is a paper clip, an inner or small loop of the paper clip may be in contact with the front surface of the tabbed note while an outer or large loop of the paper clip may be in contact with the back surface. Once the fastener is inserted through an opening in a tabbed note, the process of assembling a tabbed note assembly is completed.

Figure 9:
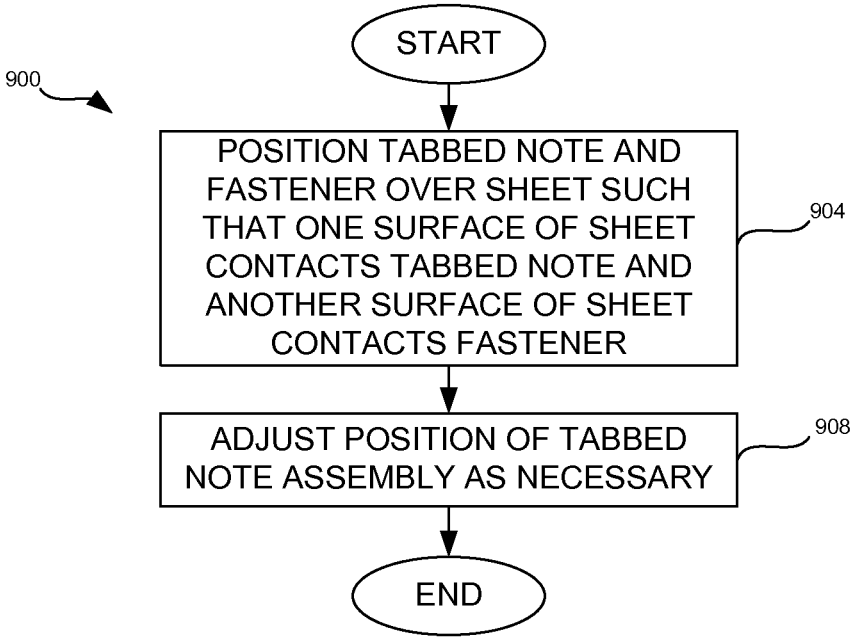
FIG. 9 is a process flow diagram which illustrates one method of using a tabbed note assembly in accordance with an embodiment of the present invention.

FIG. 9 is a process flow diagram which illustrates one method of using a tabbed note assembly in accordance with an embodiment of the present invention. A process 900 of using a tabbed note assembly begins at step 904 in which a tabbed note assembly is initially positioned over a sheet of paper. Initially positioning a tabbed note assembly over a sheet of paper generally entails sliding the tabbed note assembly over the sheet of paper such that one surface of the sheet contacts a tabbed note of the tabbed note assembly while another surface of the sheet contacts a fastener of the tabbed note assembly. In one embodiment, when the fastener is a paper clip, the tabbed note is in contact with a front surface of the sheet of paper while the outer loop of the fastener is in contact with a back surface of the sheet of paper. That is, the sheet of paper may be positioned between the tabbed note and the outer loop of the fastener.

After the tabbed note is initially positioned, the position of the tabbed note assembly may be adjusted as necessary in step 908. Adjusting the position of the tabbed note assembly may involve sliding or otherwise moving the tabbed note assembly to a desired position. Once the tabbed note assembly is in a desired position, the process of using a tabbed note assembly is completed. It should be appreciated that a user of the tabbed note assembly may make notations on the tabbed note assembly at substantially any time.

A tabbed note assembly may be used to secure more than one sheet of paper. That is, a tabbed note assembly may be used to secure a stack of sheets. Although a fastener such as a paper clip may be suitable for securing more than one sheet of paper, alternative fasteners may also be used in a tabbed note assembly for purposes of securing and tabbing a stack of sheets. One alternative fastener that is particularly suitable for securing and tabbing a stack of sheets is a binder clip. A binder clip may be substantially any size, and a tabbed note may be sized accordingly to accommodate the binder clip.

Figure 10A:
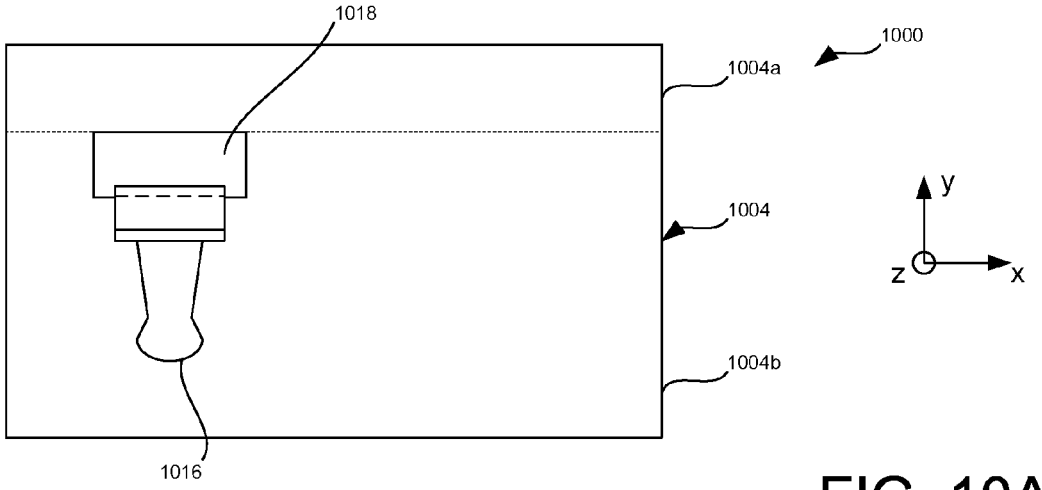
FIG. 10A is a diagrammatic representation of a tabbed note assembly which utilizes a binder clip as a fastener in accordance with an embodiment of the present invention.
Figure 10B:
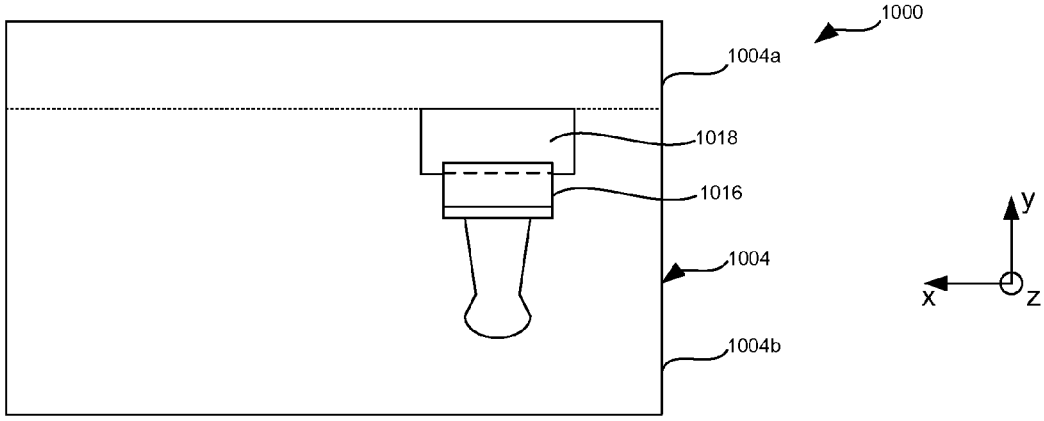
FIG. 10B is a diagrammatic representation of a tabbed note assembly, i.e., tabbed note assembly 1000 of FIG. 10A, in accordance with an embodiment of the present invention.
Figure 10C:
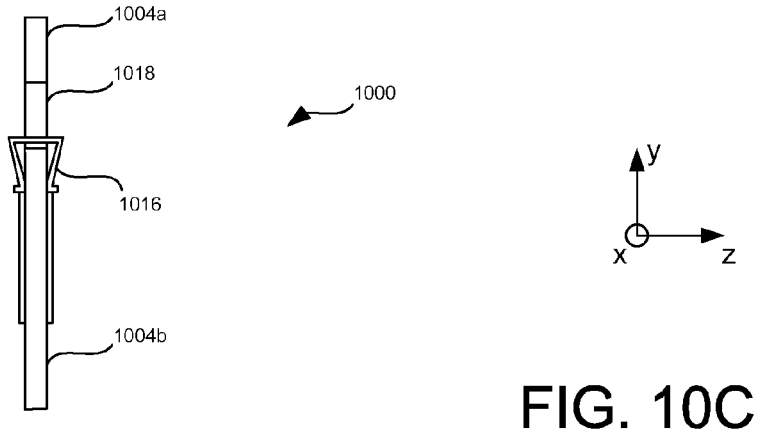
FIG. 10C is a diagrammatic cross-sectional side-view representation of a tabbed note assembly, i.e., tabbed note assembly 1000 of FIG. 10A, in accordance with an embodiment of the present invention.

Referring next to FIGS. 10A to 10C, a tabbed note assembly which includes a binder clip will be described in accordance with an embodiment of the present invention. A tabbed note assembly 1000 includes a tabbed note 1004 in which an opening 1018 is defined. Opening 1018 is shown as being defined in a note 1004*b* of tabbed note 1004. It should be appreciated, however, that opening 1018 may instead be defined in a tab 1004*a* of tabbed note 1004, or opening 1018 may be defined partially in tab 1004*a* and partially in note 1004*b*.

A binder clip 1016 is arranged to be positioned partially within opening 1018 such that sides of binder clip 1016 contact a front and a back of tabbed note 1004 when binder clip 1016 is in a closed, or clamped, position, as shown in FIG. 10C. To enable tabbed note assembly 1000 to be used to tab a sheet of paper, forces or moments are generally applied to binder clip 1016.

Figure 11A:
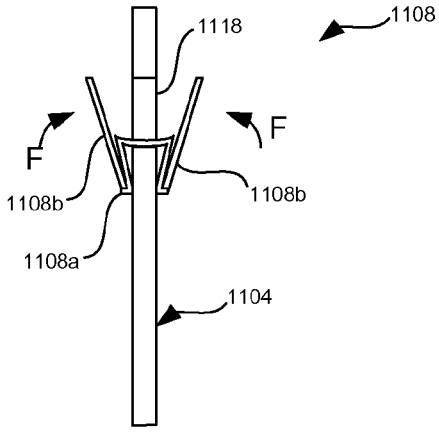
FIG. 11A is a diagrammatic cross-sectional side-view representation of a tabbed note assembly with a binder clip prior to the binder clip being fastened to a sheet of paper in accordance with an embodiment of the present invention.
Figure 11A:
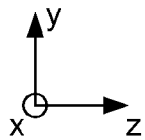

With reference to FIGS. 11A to 11D, one method of using tabbed note assembly which includes a binder clip to tab a sheet of paper will be described in accordance with an embodiment of the present invention. FIG. 11A is a cross-sectional side-view representation of a tabbed note assembly prior to being used to tab a sheet of paper. A binder clip 1108 which includes a flexible body 1108*a* and legs 1108*b* is positioned through an opening 1118 in a tabbed note 1104. Legs 1108*b* are in a raised position such that when forces F of an appropriate magnitude are applied to legs 1108*b*, body 1108*a* effectively opens.

Figure 11B:
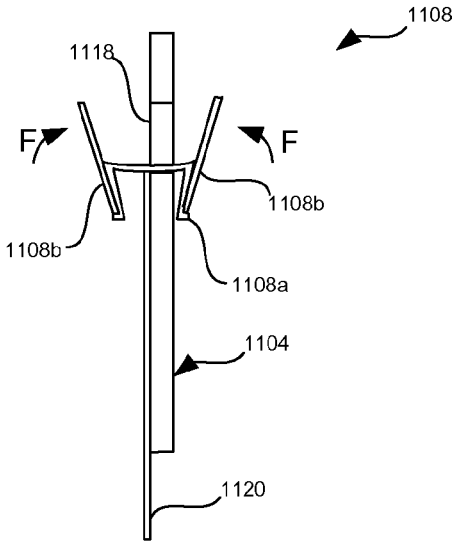
FIG. 11B is a diagrammatic cross-sectional side-view representation of a tabbed note assembly with a binder clip, i.e., binder clip 1108 of FIG. 11A, during a process of fastening the binder clip to a sheet of paper in accordance with an embodiment of the present invention.
Figure 11B:
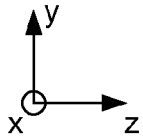

FIG. 11B is a cross-sectional side-view representation of binder clip 1108 with body 1108*a* in an open position. When forces F are applied to legs 1108*b*, legs 1108*b* apply force on body 1108*a* and cause body 1108*a* to open. Once body 1108*a* is open, a sheet of paper 1120 may be positioned within body 1108*a*. As shown, sheet of paper 1120 is thinner than tabbed note 1104, although it should be understood that the thickness of sheet of paper 1120 may vary widely. Additionally, while one sheet of paper 1120 has been shown, the number of sheets of paper 1120 which may be positioned within body 1108*a* may vary widely.

Figure 11C:
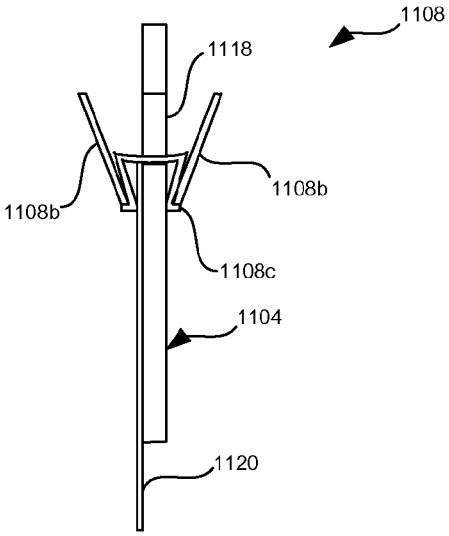
FIG. 11C is a diagrammatic cross-sectional side-view representation of a tabbed note assembly with a binder clip, i.e., binder clip 1108 of FIG. 11A, in a transitional position after the binder clip is fastened to a sheet of paper, i.e., sheet of paper 1120 of FIG. 11B, in accordance with an embodiment of the present invention.
Figure 11C:
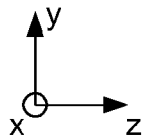
Figure 11D:
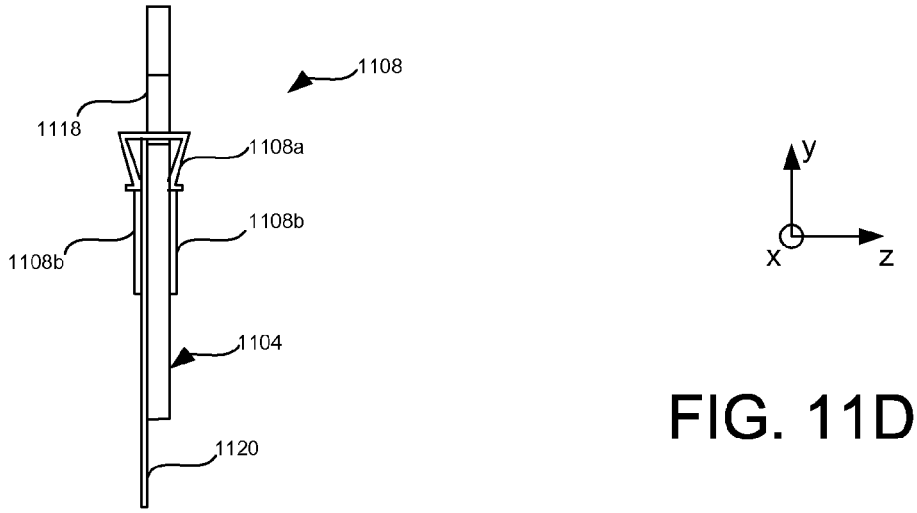
FIG. 11D is a diagrammatic cross-sectional side-view representation of a tabbed note assembly with a binder clip, i.e., binder clip 1108 of FIG. 11A, after legs of the binder clip, i.e., legs 1108*b* of FIG. 11A, are set in a home position in accordance with an embodiment of the present invention.

After sheet of paper 1120 is positioned within body 1108*a*, forces F may be removed from legs 1108*b*. The removal of forces F generally causes body 1108*a* to close. The closure of body 1108*a* causes body 1108*a* to apply a clamping force on tabbed note 1104 and sheet of paper 1120 such that sheet of paper 1120 is held against tabbed note 1104, as shown in FIG. 11C. Although binder clip 1108 may be used with legs 1108*b* in a raised or open position, positioning legs 1108*b* in a closed position lowers the overall profile of the tabbed note assembly. FIG. 11D is a cross-sectional side-view representation of binder clip 1108 with legs 1108*b* in a closed position. When legs 1108*b* are in a closed position, legs 1108*b* are such that one leg 1108*b* is in contact with tabbed note 1104 while another leg 1108*b* is in contact with sheet of paper 1120.

Figure 12:
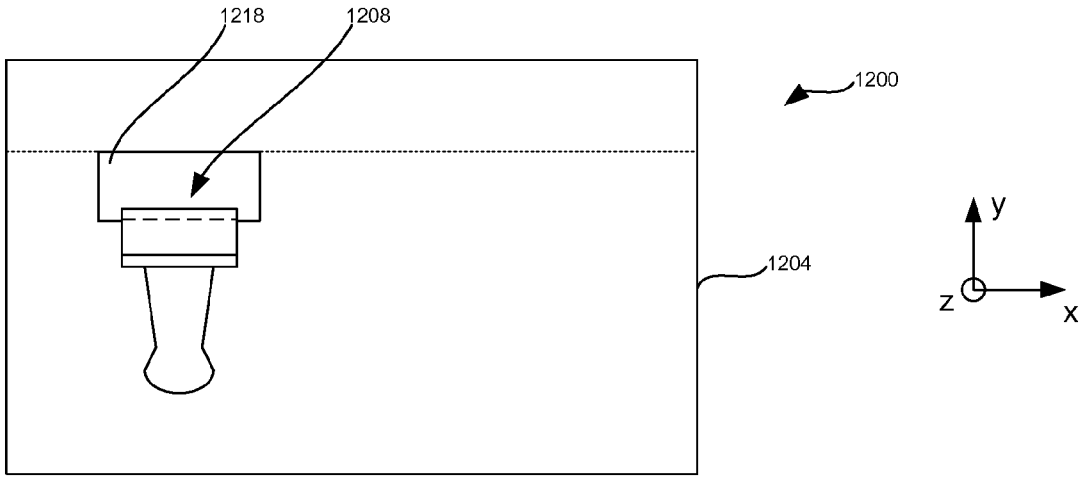
FIG. 12 is a diagrammatic representation of a tabbed note assembly with a binder clip in a home position in accordance with an embodiment of the present invention.

In one embodiment, a tabbed note assembly that includes a binder clip may include multiple tabbed notes. When a stack of tabbed notes is included in a tabbed note assembly, once a "top" tabbed note in the stack is used, that tabbed note may be removed from the stack, and the next tabbed note becomes the top tabbed note. FIG. 12 is diagrammatic representation of a tabbed note assembly which includes a stack of tabbed notes in accordance with an embodiment of the present invention. A tabbed note assembly 1200 includes tabbed notes 1204 in which openings 1218 are defined. A binder clip 1208 is arranged about tabbed notes 1204 such that binder clip 1208 effectively clamps tabbed notes 1204.

Figure 13A:
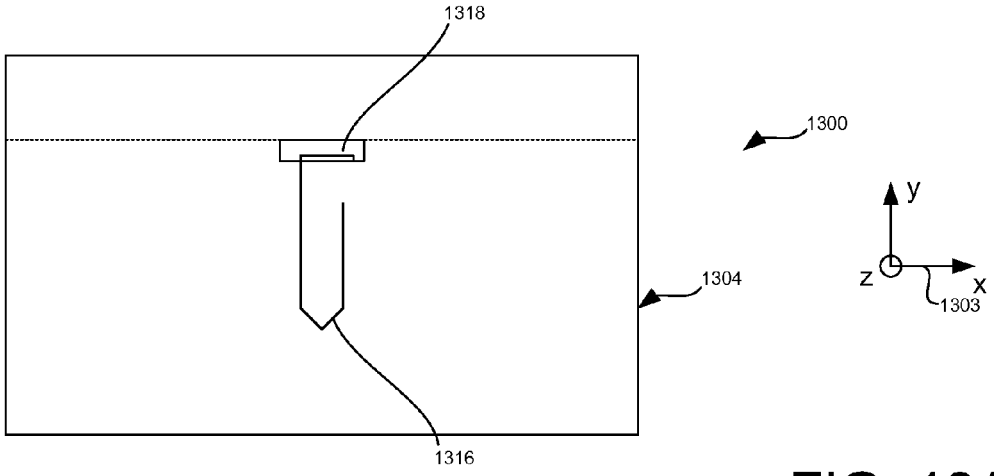
FIG. 13A is a diagrammatic representation of a tabbed note assembly with a fastener disposed in a central position in accordance with an embodiment of the present invention.

When a top one of tabbed notes 1204 is to be discarded, e.g., has been used for tabbing purposes and is no longer needed, the top one of tabbed notes 1204 may be removed and the next one of tabbed notes 1204 in the stack of tabbed notes 1204 may then be written on and effectively used as a tab. As previously mentioned, the configuration, e.g., shape and size, of a tabbed note assembly may vary widely. For example, the location of a fastener within a tabbed note assembly may vary. FIG. 13A is a diagrammatic representation of a tabbed note assembly with a fastener located near a middle of a tabbed note in accordance with an embodiment of the present invention. A tabbed note assembly 1300 includes a tabbed note 1304 in which an opening 1318 is defined. Opening 1318 is arranged to receive a fastener 1316, and is positioned such that fastener 1316 is located in the approximate middle of tabbed note assembly 1300 relative to an x-axis 1303. When fastener 1316 is positioned near the middle of tabbed note assembly 1300, notes may be made on tabbed note 1304 on both sides of fastener 1316.

Figure 13B:
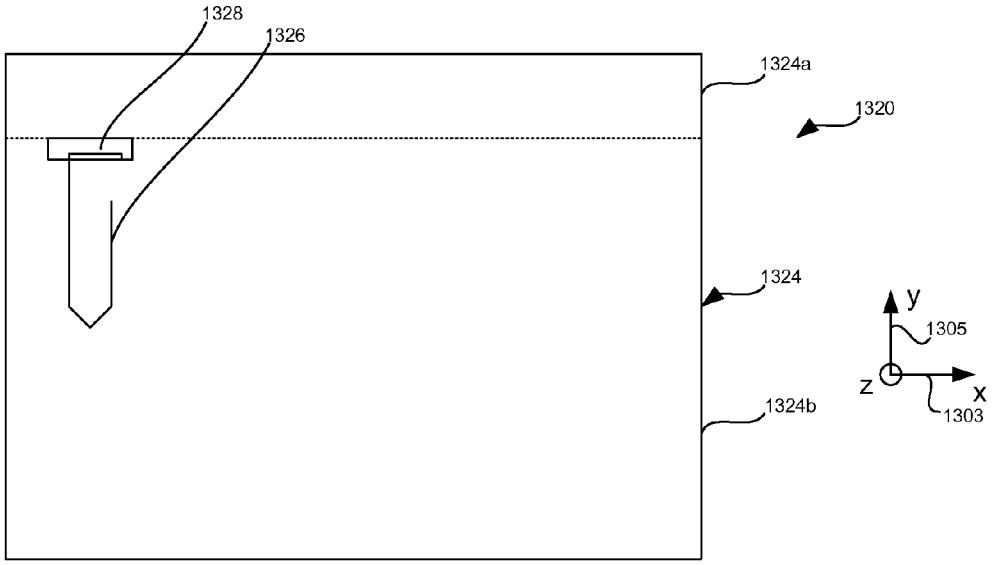
FIG. 13B is a diagrammatic representation of a tabbed note assembly with a relatively large tabbed note in accordance with an embodiment of the present invention.

To provide additional space for notes to be written on a tabbed note, the overall size of a tabbed note may be increased. FIG. 13B is a diagrammatic representation of a tabbed note assembly with a relatively large tabbed note in accordance with an embodiment of the present invention. A tabbed note assembly 1320 includes a tabbed note 1324 which has a relatively large tab 1324*a* and a relatively large note 1324*b*, relative to a size of an opening 1328 and a fastener 1326. A dimension of tabbed note 1324 relative to x axis 1303 and a dimension of tabbed note relative to a y-axis 1305 may be selected to provide an increased amount of space in which a user may write.

Figure 13C:
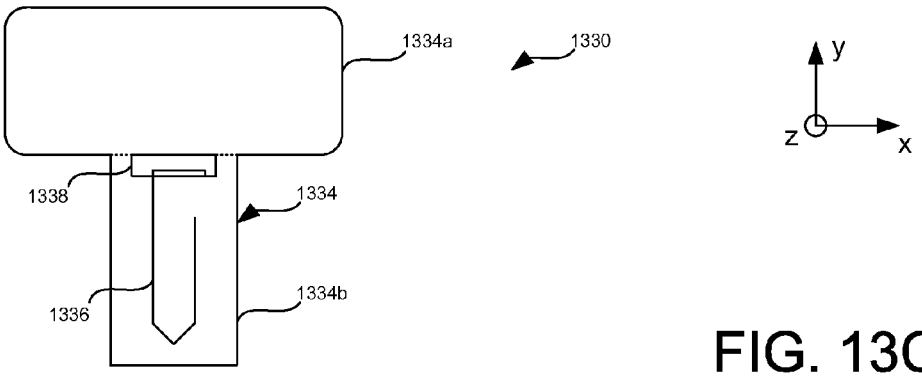
FIG. 13C is a diagrammatic representation of a tabbed note assembly with a tabbed note which is primarily a tab in accordance with an embodiment of the present invention.

In one embodiment, a tabbed note may be arranged to include substantially only a tab. A tabbed note that effectively only includes a tab may be useful when a user of the tabbed note intends for the tabbed not to be used strictly to provide a tab. With reference to FIG. 13C, one such tabbed note will be described in accordance with an embodiment of the present invention. A tabbed note assembly 1330 includes a tabbed note 1334 with a tab 1334*a* and a note 1334*b*. Note 1334*b* is sized to accommodate an opening 1338, and to effectively support a fastener 1336. Tab 1334*a* is large, relative to note 1334*b*. The shape of the tabbed note assembly in this figure is similar to the mushroom-shaped note described previously.

Figure 13D:
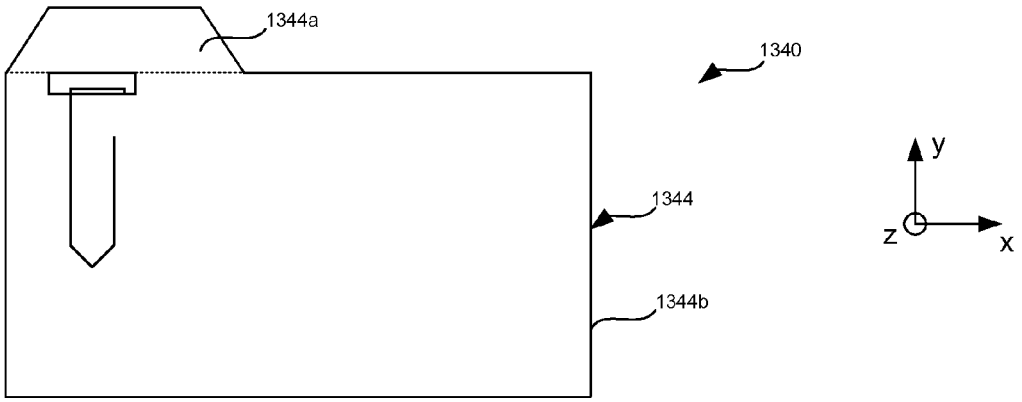
FIG. 13D is a diagrammatic representation of a tabbed note assembly with a tabbed note which includes an indexed tab in accordance with an embodiment of the present invention.
Figure 13E:
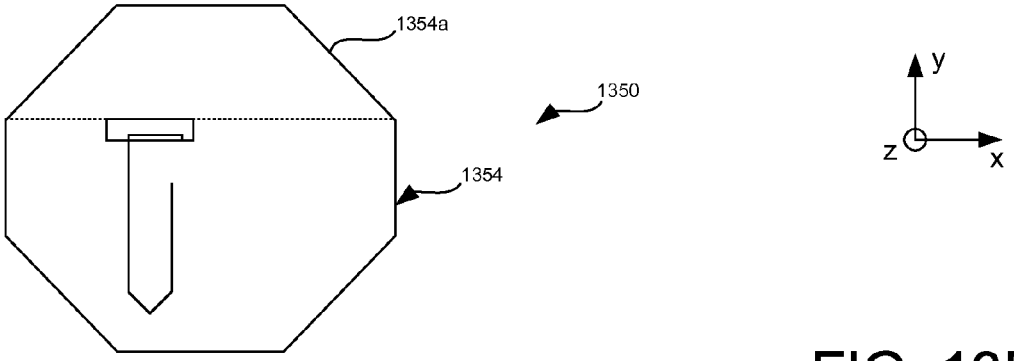
FIG. 13E is a diagrammatic representation of a tabbed note assembly with a tabbed note which is octagonally shaped in accordance with an embodiment of the present invention.

A tabbed note may have a variety of different shapes. For example, as shown in FIG. 13D, a tabbed note assembly 1340 may include a tabbed note 1344 with a tab 1344*a* that approximates the shape of tabs which are often used on manila folders, e.g., tab 1344*a* has a trapezoidal shape. It should be appreciated that tab 1344*a* may be positioned at different locations relative to x-axis. Although tabbed note 1344 includes a note 1344*b* of a rectangular shape, it should be appreciated that a tabbed note which includes a trapezoidal-shaped tab may have any suitable shape. One suitable shape for a tabbed note that supports a trapezoidal-shaped tap is an octagon. FIG. 13E shows a tabbed note assembly 1350 which includes an octagonally shaped tabbed note 1354 with a tab 1354*a* that has the shape of a trapezoid.

Figure 13F:
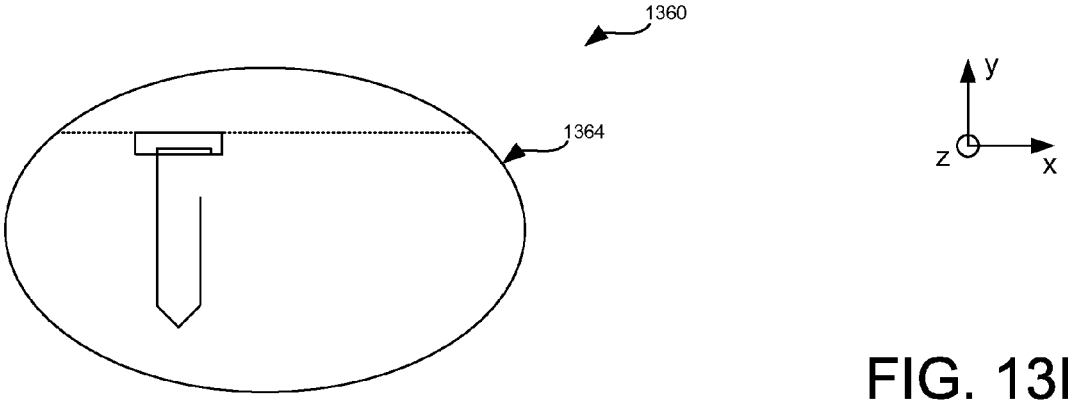
FIG. 13F is a diagrammatic representation of a tabbed note assembly with a tabbed note which has an oval shape in accordance with an embodiment of the present invention.

In lieu of having polygonal shapes, a tabbed note may also have curved or rounded shapes. By way of example, FIG. 13F is a representation of a tabbed note assembly 1360 which includes an oval shaped tabbed note 1364.

Figure 13G:
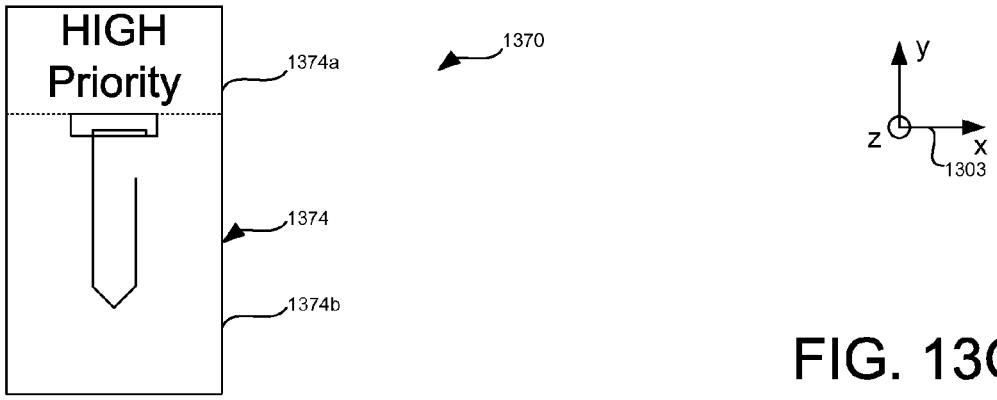
FIG. 13G is a diagrammatic representation of a first tabbed note assembly with a tabbed note that has a preprinted tab in accordance with an embodiment of the present invention.

A tab of a tabbed note may be printed such that it is not necessary for a user to write on the tab. However, the user may additionally write on a preprinted tab if the user desires. For instance, a tab may be printed with text which indicates a priority for a document that the tab is intended to label. A tabbed note which has a printed tab may have a variety of different configurations. As shown in FIG. 13G, a tabbed note assembly 1370 includes a tabbed note 1374 with a tab 1374*a* which is printed with text that indicates a priority. Tab 1374*a* and a note 1374*b* have a dimension relative to x-axis 1303 that is sized appropriately to accommodate the text in tab 1374*a*.

Figure 13H:
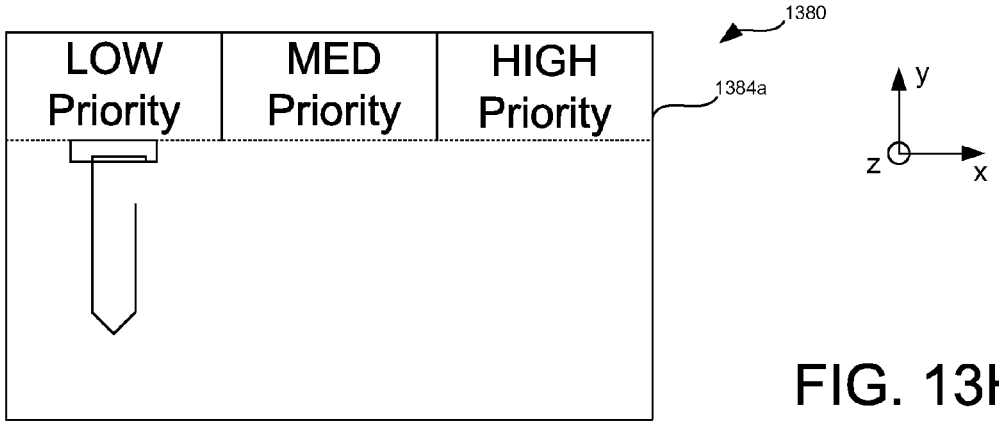
FIG. 13H is a diagrammatic representation of a second tabbed note assembly with a tabbed note that has a preprinted tab in accordance with an embodiment of the present invention.

FIG. 13H shows a tabbed note assembly 1380 with a tabbed note 1384 with a tab 1384 which includes printed text that indicates a priority. A user may select an appropriate priority, and mark the appropriate priority, e.g., by circling or highlighting the appropriate priority. Alternatively, in one embodiment, tab 1384 may include various perforations such that when a user selects a priority, the portions of tab 1384 associated with unselected priorities may be detached.

Figure 13I:
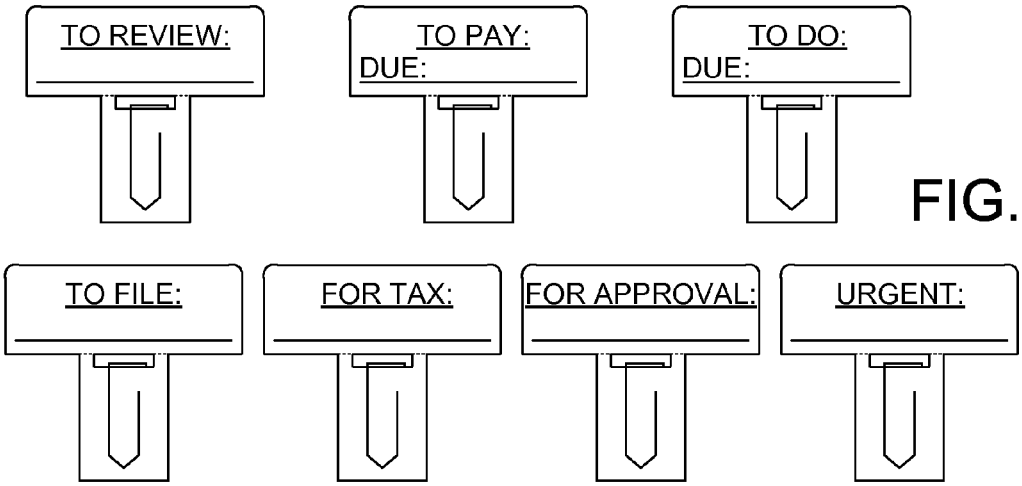
FIG. 13I provides diagrammatic representations of further tabbed note assemblies having preprinted tabs in accordance with embodiments of the present invention.

FIG. 13I shows further embodiments of tabbed notes having preprinted tabs in accordance with an embodiment of the present invention. As shown, preprinted tabs may include the following statements: "TO REVIEW," "TO PAY," "TO DO," "TO FILE," "FOR TAX," "FOR APPROVAL," and "URGENT." These tabs may each include spaces in which a due date or a name may be written. The preprinted tabs shown in FIG. 13I are merely examples of some preprinted tabs, and it should be understood that there are many other possibilities. Further, a note portion of a tabbed note may also be preprinted.

A tabbed note may be preprinted with ruled lines, either in a tab portion or in a note portion, or both. Specifically, there may be a number of printed parallel lines which the user may use to write information. The preprinting may include any type of printing or background, and may be in any color. For example, the printing may include polka dots, circles, flowers, shapes, mosaic, zigzag, xylophone, zebra, company names or logos, or messages as "From Victor to Elaine" or "From Janet to Mike with Love."

Further, a tabbed note may include barcoding or radio frequency identification (RFID) to enable the tabbed note to be scanned. The tabbed note may also include embossing, Braille, and other forms of information recording (including stored visual, sound, odor, taste, or feel information, or any combination of these).

Figure 13J:
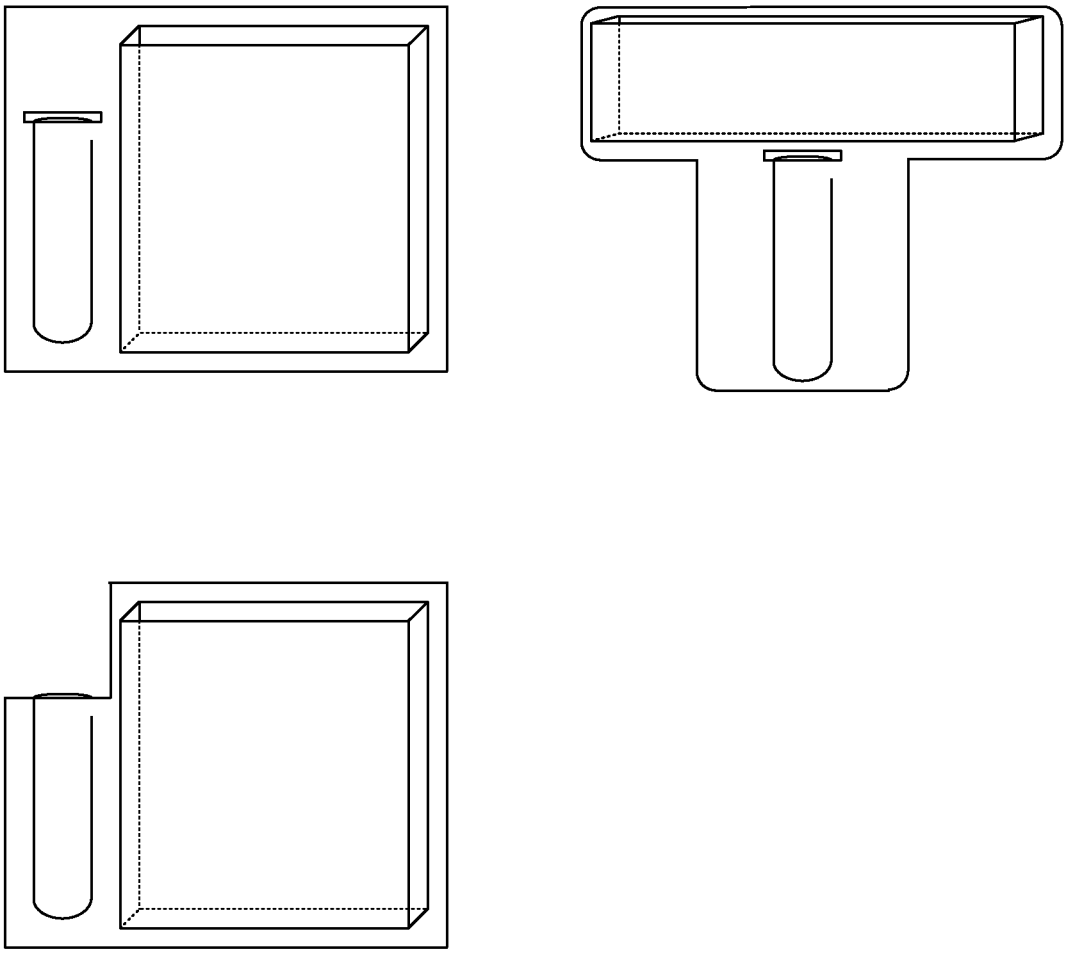
FIG. 13J provides diagrammatic representations of further tabbed note assemblies having an attached pad of note pages in accordance with embodiment of the present invention.

FIG. 13J shows embodiments of the tabbed note assembly of the invention having a pad of note pages in various shapes and orientations. A pad of a tabbed note assembly of the invention may have a number of pages of paper for writing of notes, and may be coupled to a note portion of a tabbed note. The pages may be bound together on a top edge using an adhesive such as glue, or may be bound together using substantially any other binding mechanism, e.g., note pages may be spiral bound. Another technique to form a pad of pages of the invention is to use a removable adhesive, where each page is attached to other pages in a stack. When a pad of pages is effectively bound together using a removable adhesive, pages removed from the stack may be returned to the stack if desired.

In one embodiment, a pad of pages may be arranged to be replaced. For example, a note portion of a tabbed note may include an opening through which a sheet or back page of a pad of pages may be inserted. When the pad of pages needs to be replenished, the remnants of the old pad of pages (e.g., a cardboard backing of the pad of pages) may be removed from such an opening and a new pad of pages may be inserted. A pad of pages may also be removably adhered to the note portion such that a spiral binding of the pad of pages also binds the tabbed note to the pad of pages, or such that a removable adhesive binds the pad of pages to the tabbed note. Alternatively, the pad of pages may be substantially bound using an adhesive or other fastening mechanism, such that the pad of pages may not be replaced.

The location of a pad of pages relative to a fastener in a tabbed note assembly may vary widely. A pad of pages may placed to a left, right, above, or below the fastener. The pad may also be placed over the fastener. For example, the fastener may be in a center of the note assembly, and the pad may be placed on top of the fastener. When a pad is placed on top of a fastener, the pad may effectively be attached to the tabbed note using the fastener, i.e., removable notes may be attached using the fastener.

A user may write notes on the pad of a tabbed note assembly. When the user wants discard or remove the previously written notes, the user may tear off or remove the note. The user will then be presented with a new note on which to write information. Furthermore, the user may write information on two or more pages at a time, in case one note does not have enough space for the user's writing.

In a further embodiment of the invention, the invention may include paper, card stock, Mylar, polyester film, or other material that is specially precut or perforated so it may be detached or removed from a bigger piece of such material. This material may be designed to be fed through a printer, such as a tractor-feed printer, laser printer, or inkjet printer. Software may be used to print to the attached tabbed note. The tabbed note may then be detached, and the fastener may be pushed through the opening to fully assembly the tabbed note assembly of the invention. The printer may print any information desired on the tabbed note including letters, barcoding, and symbols.

The invention may include, in one embodiment, paper with precut, perforated, or scored tab notes (having openings for a fastener). In a further embodiment, the invention may include paper and software to instruct a computer connected to the printer to print to the paper. In still another embodiment, the invention may include the paper, software, and fasteners.

When a sheet of paper with an attached tabbed note assembly no longer needs to be tabbed, the tabbed note assembly may simply be removed from the sheet. However, in some instances, it may be desirable to keep at least part of the tabbed note assembly attached to the sheet even when a tab is no longer needed. For example, it may be desirable to keep the notes written on a note of a tabbed note assembly even when a tab is no longer needed. Alternatively, it may be desirable to keep the fastener of the tabbed note assembly fastened to a sheet or sheets. As such, a user of a tabbed note assembly may remove the tab when the tab is no longer needed by either tearing the tab off of a tabbed note or cutting the tab off of the tabbed note. To facilitate the removal of a tab, perforations may be provided on a tabbed note.

Figure 14A:
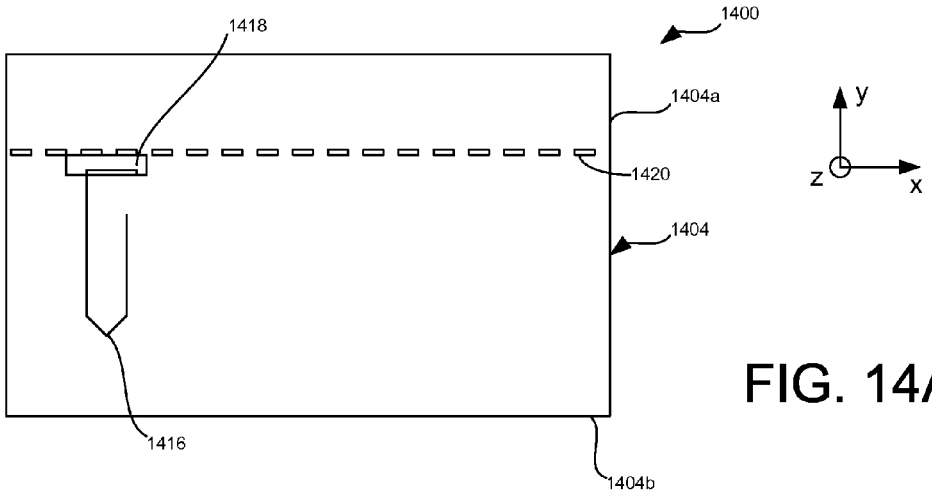
FIG. 14A is a diagrammatic representation of a tabbed note assembly with a tab that is separated from a note by a perforated border in accordance with an embodiment of the present invention.

FIG. 14A is a diagrammatic representation of a tabbed note assembly with a tab that is substantially perforated in accordance with an embodiment of the present invention. A tabbed note assembly 1400 includes a tabbed note 1404 in which an opening 1418 is defined. A fastener 1416 is disposed through opening 1418. A tab 1404*a* and a note 1404*b* of tabbed note 1404 are delineated or effectively separated by a perforated border 1420 or a perforation. Perforated border 1420 is shown as substantially coinciding with a top edge of opening 1418, although it should be appreciated that perforated border 1420 may instead coincide with a bottom edge of opening 1418, or perforated border 1420 may not be arranged to coincide with any edge of opening 1418.

Figure 14B:
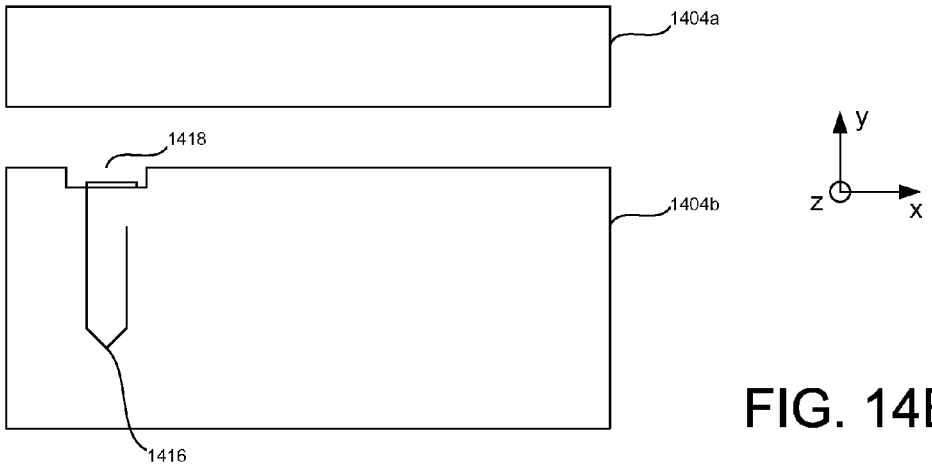
FIG. 14B is a diagrammatic representation of a tabbed note assembly, i.e., tabbed note assembly 400 of FIG. 14*a*, in which a tab has been separated from a note in accordance with an embodiment of the present invention.

Tab 1404*a* may be separated from note 1404*b* of tabbed note 1404, as shown in FIG. 14B, when tab 1404*a* is no longer needed. Once tab 1404*a* is decoupled from note 1404*b*, note 1404*b* and fastener 1416 may be considered as a note assembly. The separation of tab 1404*a* from note 1404*b* may be accomplished by tearing along perforated border 1420.

Figure 15A:
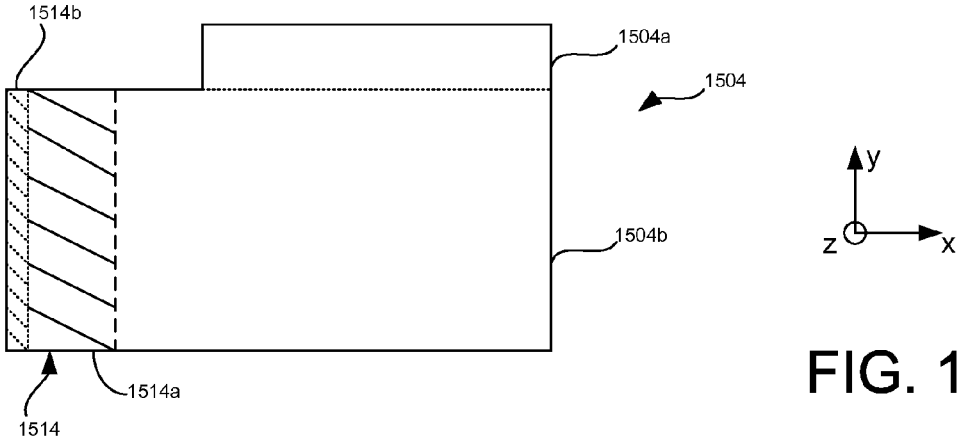
FIG. 15A is a diagrammatic representation of a front side of a first tabbed note with a portion arranged to be folded over to form a pocket in accordance with an embodiment of the present invention.
Figure 15B:
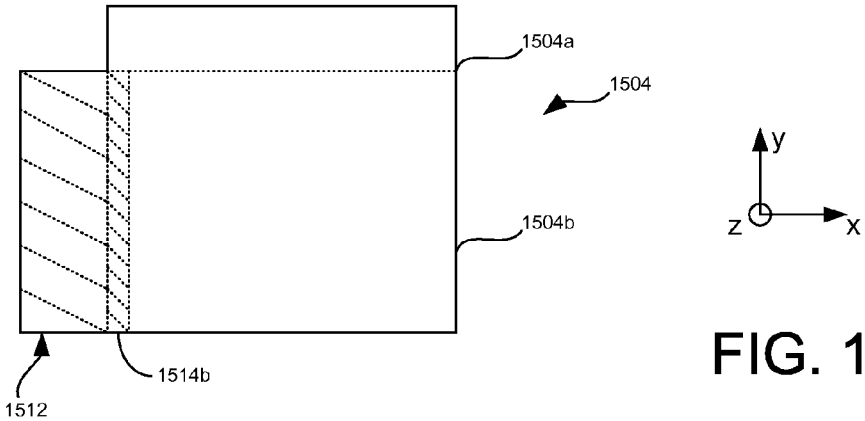
FIG. 15B is a diagrammatic representation of a front side of a first tabbed note, i.e., tabbed note 1504 of FIG. 15A, as shown with a pocket portion that is folded and attached to form a pocket in accordance with an embodiment of the present invention.

A tabbed note, in lieu of having an opening defined therein through which a fastener may be inserted, may instead have a pocket or a compartment through which a fastener may be inserted. A pocket may be formed as an integral part of a tabbed note. For example, a pocket may effectively be formed from a part of a tabbed note, or a pocket may be formed by substantially attaching a separate piece to a tabbed note. With reference to FIGS. 15A to 15D, a tabbed note with a pocket that is formed from a part of the tabbed note will be described in accordance with an embodiment of the present invention. A tabbed note 1504, as shown in FIG. 15A, includes a tab 1504*a* and a note 1504*b*. Tabbed note 1504 effectively includes a fold-over portion 1514 that is arranged to fold over onto note 1504*b* to create a pocket. Fold-over portion 1514 includes a pocket portion 1514*a* and a seam portion 1514*b*. When fold-over portion 1514 is folded, as shown in FIG. 15B which shows a front view of tabbed note 1504 and indicates where seam portion 1514*b* is on the back side of tabbed note 1504, seam portion 1514*b* may be coupled to the back side of tabbed note 1504.

Seam portion 1514*b* is arranged to be coupled to the back side of note 1504 using a coupling substance. Typically, seam portion 1514*b* is effectively bonded to the back side of note 1504 using a coupling substance or mechanism. The coupling substance or mechanism may be any suitable adhesive, or adhesive tape, for example. Alternatively, seam portion 1514*b* may be coupled to the back side of note 1504 using a mechanism such as a staple. In one embodiment, a laminating material may be applied over fold-over portion 1514, once folded, may be coupled to the remainder of note 1504 through the application of a laminating material over fold-over portion 1514 and the portion of note 1504 that is not covered by fold-over portion 1514.

Figure 15C:
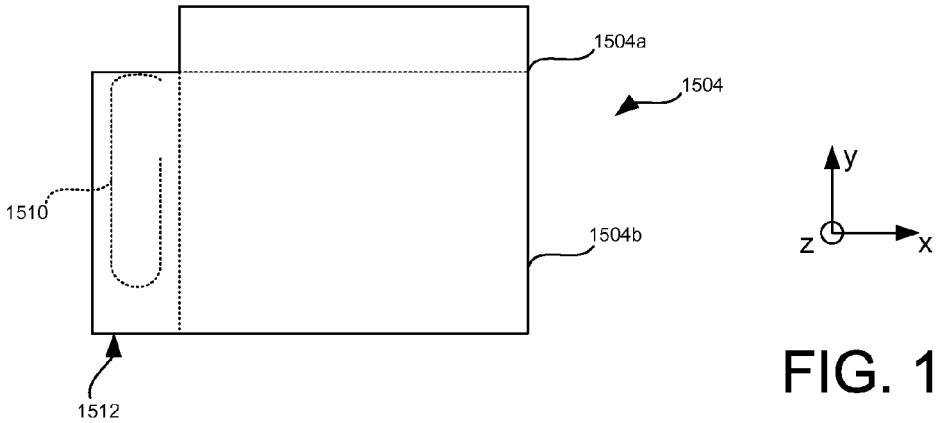
FIG. 15C is a diagrammatic representation of a front side of a first tabbed note, i.e., tabbed note 1504 of FIG. 15A, with a pocket portion, i.e., pocket portion 1512 of FIG. 15B, through which a fastener is at least partially inserted in accordance with an embodiment of the present invention.

When seam portion 1514*b* is coupled to the back side of note 1504*b*, a pocket 1512 is effectively formed in note 1504*b*. Pocket 1512 is typically sized to accommodate a fastener that is to be used with tabbed note 1504 to create a tabbed note assembly. As shown in FIG. 15C, which is a front view of tabbed note 1504, when a first leg or loop of fastener 1510 is inserted at least partially within pocket 1512, fastener 1510 effectively does not come into contact with a front surface of tabbed note 1504. That is, substantially all of the front surface of tabbed note 1504 may be written thereon, as fastener 1510 does not obscure the front surface.

Figure 15D:
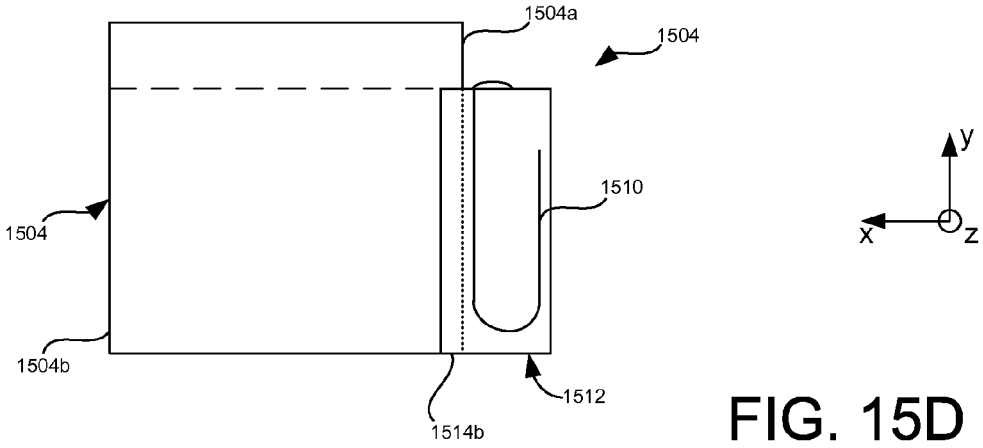
FIG. 15D is a diagrammatic representation of a back side of a first tabbed note, i.e., tabbed note 1504 of FIG. 15A, with a pocket portion, i.e., pocket portion 1512 of FIG. 15B, through which a fastener is at least partially inserted in accordance with an embodiment of the present invention.

One loop or clamping leg of fastener 1510 is arranged to be positioned substantially within pocket 1512 while another loop or clamping leg of fastener 1510 is arranged to be positioned substantially outside of pocket 1512. FIG. 15D is a back surface representation of tabbed note 1504 with fastener 1510 at least partially inserted through pocket 1512. As shown, a loop or leg of fastener 1510 is positioned in contact with a back side of pocket 1512 which is held in tact when seam 1514*b* is secured to the back side of tabbed note 1504. When tabbed note 1504 is used to provide a tab for at least one sheet (not shown), e.g., a sheet of paper, the sheet is held against or effectively clamped against the back surface of tabbed note 1504 by fastener 1510. In other words, to secure tabbed note 1504 to a sheet (not shown), the sheet is arranged and held between the back surface of tabbed note 1504 and fastener 1510.

Pocket 1512 is arranged such that pocket 1512 is essentially positioned to a side of tab 1504*a*, relative to an x-axis. In one embodiment, a pocket may be positioned such that the pocket is positioned substantially under a tab.

Figure 15E:
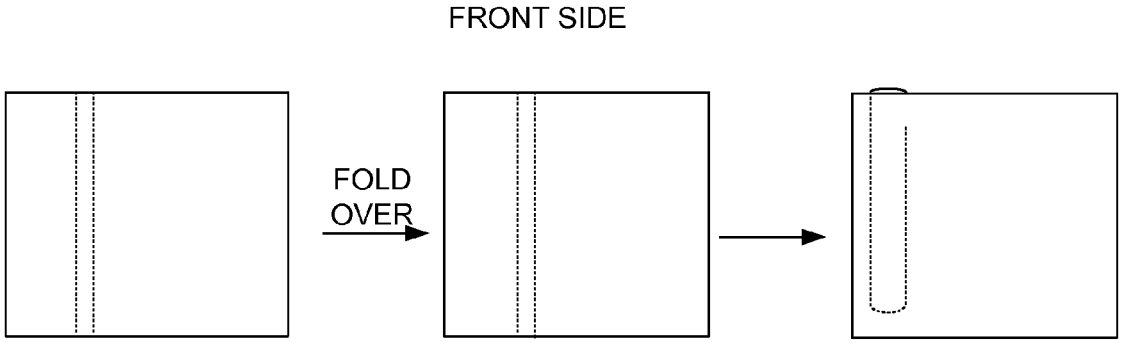
FIG. 15E is a diagrammatic representation of a note assembly without a tabbed portion substantially above the fastener in accordance with an embodiment of the present invention.

FIG. 15E shows a note assembly without a tab portion above the fastener in accordance with an embodiment of the present invention. The figures show the steps in making an assembly without a tabbed portion, in which a material is folded over to make a pocket. The sheet of material that is folded over is adhered to a back of the sheet of material. The size of the fold over should be sufficient to allow a fastener to be inserted in the pocket that is formed when the material is folder over. In this note assembly, there is not a tabbed portion above the fastener. It should be appreciated, however, that this note assembly may include no tab portion as shown or may include a tab portion that is similar to tab portion 1504*a* of FIG. 15A.

Figure 16A:
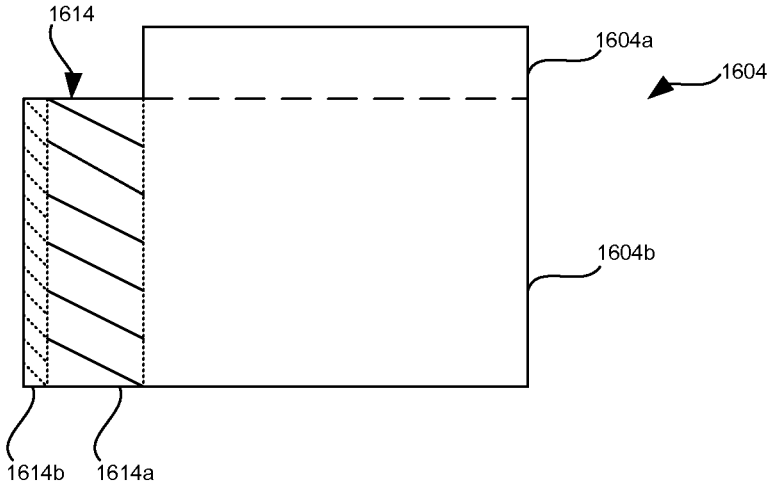
FIG. 16A is a diagrammatic representation of a front side of a second tabbed note with a portion arranged to be folded over to form a pocket that is positioned substantially under a tab of the second tabbed note in accordance with an embodiment of the present invention.
Figure 16A:
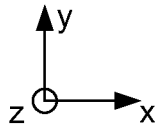

Referring next to FIGS. 16A to 16D, a tabbed note with a pocket that is positioned substantially under a tab will be described in accordance with an embodiment of the present invention. As shown in FIG. 16A, a tabbed note 1604 includes a tab 1604*a* and a note 1604*b*. Tabbed note 1604 includes a fold-over portion 1614 that is arranged to fold over onto note 1604*b* to create a pocket substantially under tab 1604*a* relative to a y-axis. Fold-over portion 1614 includes a pocket portion 1614*a* and a seam portion 1614*b* that are arranged to cooperate with the remainder of note 1604*b* to define a pocket.

Figure 16B:
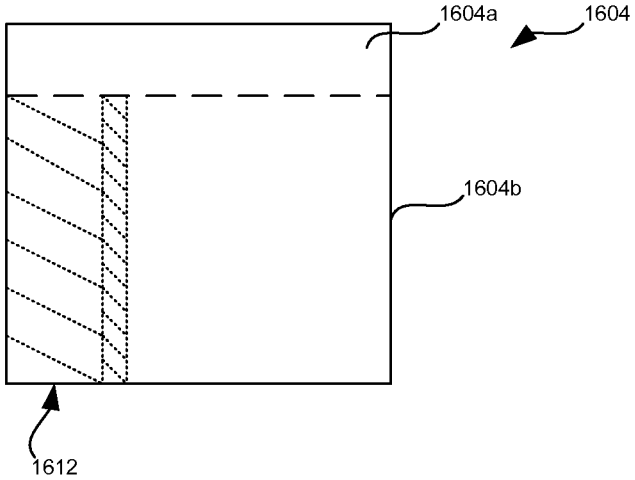
FIG. 16B is a diagrammatic representation of a front side of a second tabbed note, i.e., tabbed note 1604 of FIG. 16A, as shown with a pocket portion that is folded and attached to form a pocket in accordance with an embodiment of the present invention.
Figure 16B:
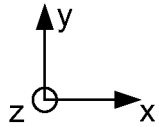
Figure 16C:
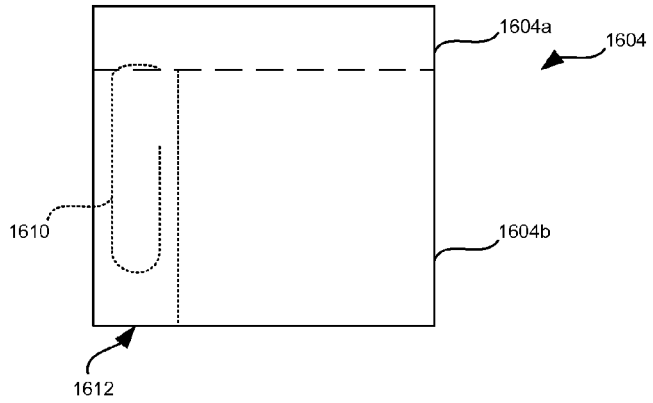
FIG. 16C is a diagrammatic representation of a front side of a second tabbed note, i.e., tabbed note 1604 of FIG. 16A, with a pocket portion, i.e., pocket portion 1612 of FIG. 16B, through which a fastener is at least partially inserted in accordance with an embodiment of the present invention.
Figure 16D:
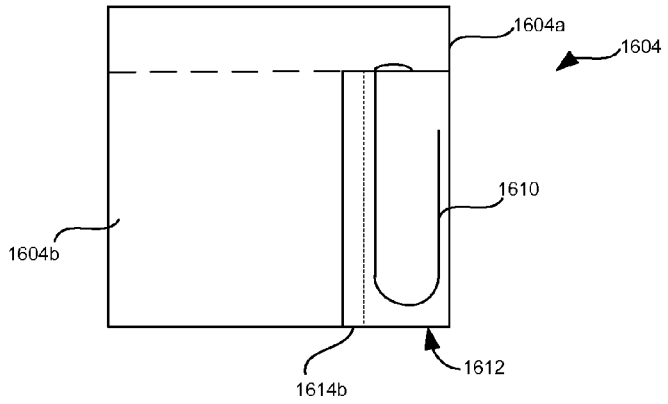
FIG. 16D is a diagrammatic representation of a back side of a second tabbed note, i.e., tabbed note 1604 of FIG. 16A, with a pocket portion, i.e., pocket portion 1612 of FIG. 16B, through which a fastener is at least partially inserted in accordance with an embodiment of the present invention.

When fold-over portion 1614 is folded over onto the remainder of note 1604*b* and seam portion 6514*b* is sealed or otherwise secured against note 1604*b*, a pocket 1612 is effectively formed, as shown in FIG. 16B. FIG. 16B is a front surface representation of tabbed note 1604 with pocket 1612 defined substantially relative to a back surface of tabbed note 1604. When a fastener 1610 is positioned within pocket 1612, fastener 1610 is in contact with an interior surface of pocket 1612, and substantially no part of fastener 1610 is visible on a front surface of tabbed note 1604, as indicated in FIG. 16C. Fastener 1610 is arranged such that when a first loop or leg of fastener 1610 is positioned within pocket 1612, a second loop or leg of fastener 1610 remains external to pocket 1612, as shown in FIG. 16D. Fastener 1610 is arranged to cooperate with the back side of tabbed note 1604 to enable at least one sheet (not shown) to be secured between the fastener and back side.

An opening may be defined in a fold-over portion of a tabbed note such that when a pocket is formed using the fold-over portion, a fastener may effectively be inserted into the pocket using the opening. When the fastener is inserted into the pocket, at least a portion of the fastener, as for example an inner loop or leg of the fastener, is in contact with an inner surface of the pocket.

Figure 17A:
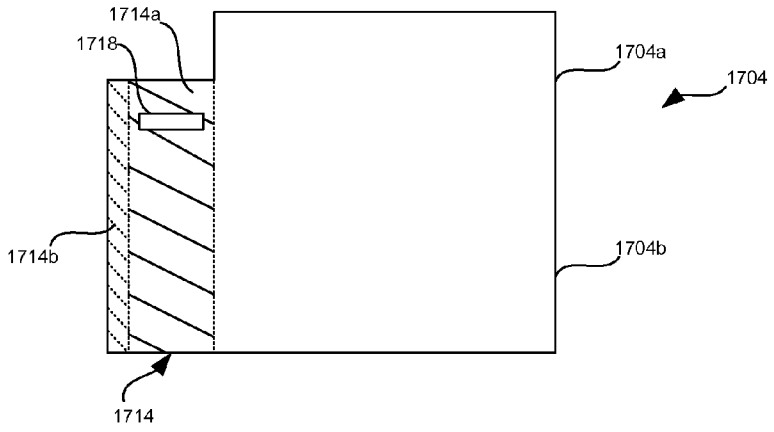
FIG. 17A is a diagrammatic representation of a front side of a third tabbed note with a portion arranged to be folded over to form a pocket with an opening defined therein which a fastener may be inserted in accordance with an embodiment of the present invention.
Figure 17B:
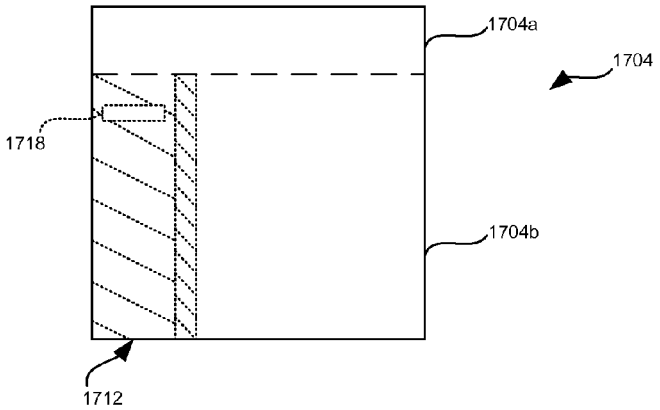
FIG. 17B is a diagrammatic representation of a front side of a third tabbed note, i.e., tabbed note 1704 of FIG. 17A, as shown with a pocket portion that is folded and attached to form a pocket with an opening defined therein in accordance with an embodiment of the present invention.

With reference to FIGS. 17A and 17B, one embodiment of a tabbed note which includes a pocket as well as an opening will be described in accordance with an embodiment of the present invention. A fold-over portion 1714 of a tabbed note 1704 that includes a tab 1704*a* and a note 1704*b* includes a pocket portion 1714*a* through which an opening 1718 is defined, as well as a seam portion 1714*b*. It should be appreciated that although opening 1718 is shown as being defined in pocket portion 1714*a* prior to the formation of a pocket, opening 1718 may instead be formed after a pocket is formed, e.g., after seam portion 1714*b* is adhered against a back surface of tabbed note 1704 to define the pocket. Opening 1718 is generally sized such that a fastener may pass at least partially through.

Figure 17C:
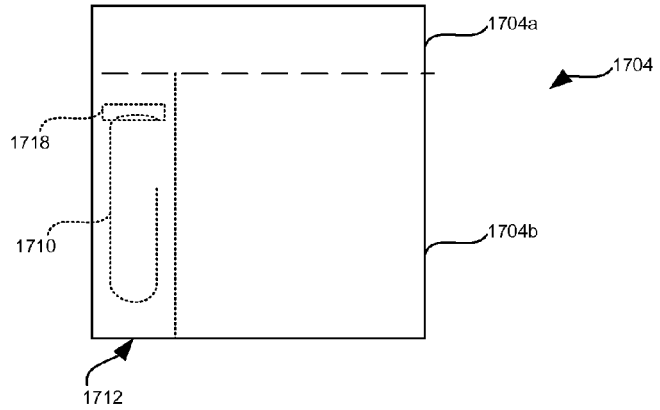
FIG. 17C is a diagrammatic representation of a front side of a third tabbed note, i.e., tabbed note 1704 of FIG. 76A, with a pocket portion, i.e., pocket portion 1712 of FIG. 17B, that defines an opening through which a fastener is at least partially inserted therein in accordance with an embodiment of the present invention.

As indicated in FIG. 17B, once a pocket 1712 is formed, both pocket 1712 and opening 1718 are effectively associated with a back side of tabbed note 1704, while a front surface of tabbed note 1704 is substantially all available to be written thereon. When a fastener 1710 is inserted through opening 1718, a front loop or leg of fastener 1710 is positioned such that the front loop or leg of fastener 1710 passes through opening 1718 and into a space defined within pocket 1712, as indicated in FIG. 17C. A back loop or leg of fastener 1710 is positioned against a back surface of object 1712 when fastener 1710 is inserted into pocket 1712 through opening 1718. The pockets formed in tabbed notes have generally been described as being formed integrally with a tabbed note. As previously mentioned, however, pockets are not necessarily formed integrally with a tabbed note. That is, a pocket may be formed on a tabbed note through the introduction of a separate piece (e.g., a pocket back) that may be coupled to the tabbed note.

Figure 18A:
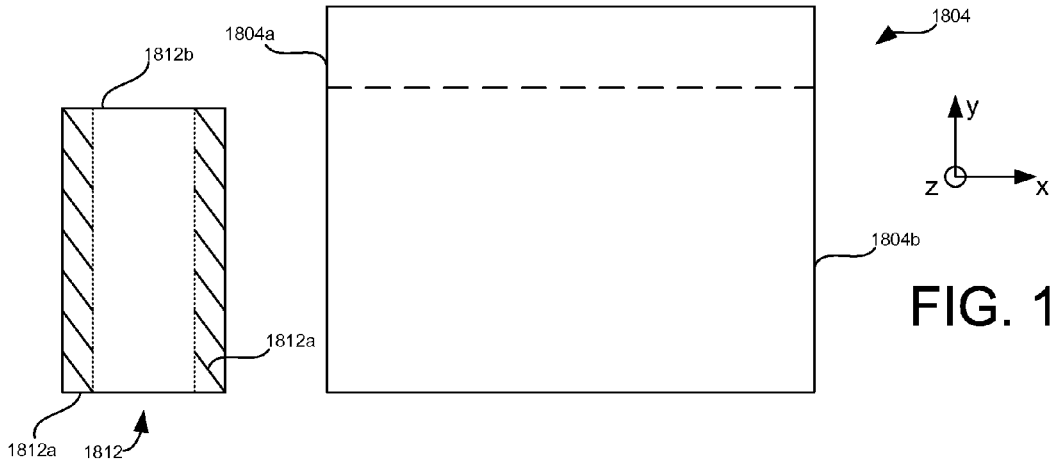
FIG. 18A is a diagrammatic representation of a tabbed note and a pocket prior to the pocket being coupled to the tabbed note to form a pocket in accordance with an embodiment of the present invention.
Figure 18B:
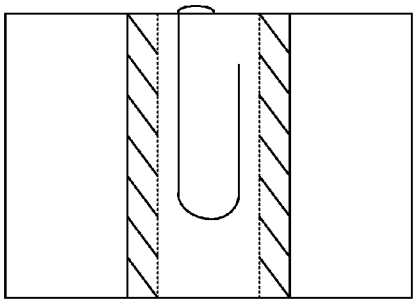
FIGS. 18B to 18E are diagrammatic representations of tabbed notes coupled with pockets in accordance with embodiments of the present invention.
Figure 18C:
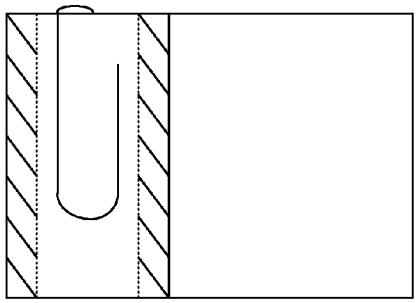

FIG. 18A is a diagrammatic representation of a tabbed note and a pocket prior to the pocket being coupled to the tabbed note to form a pocket in accordance with an embodiment of the present invention. A tabbed note 1804 includes a tab 1804*a* and a note 1804*b*, while a pocket includes a pocket portion 1812 and a number of seams 1812*a*. A pocket is effectively formed when pocket 1812 is positioned against a surface of tabbed note 1804, and seams 1812*a* are sealed against the surface, as for example using an adhesive.

Figure 18D:
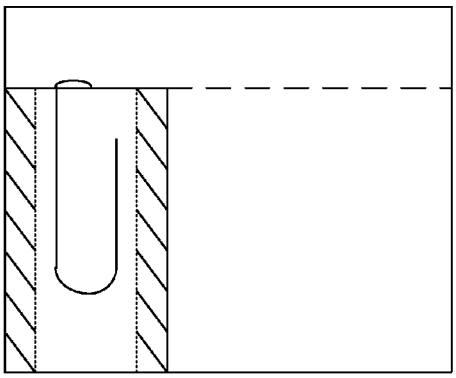
Figure 18E:
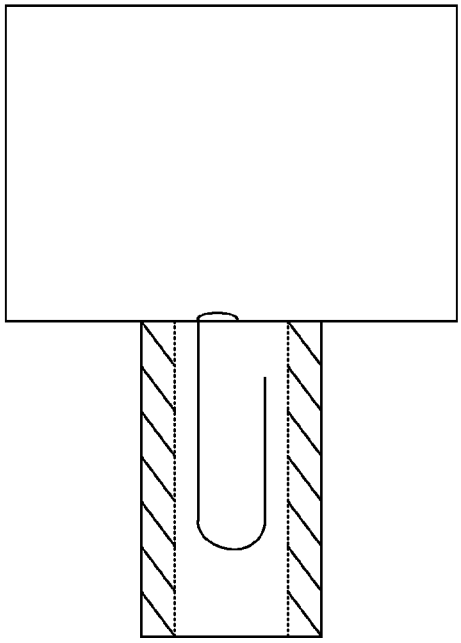

FIGS. 18B to 18E show various positions for a pocket and also various shapes for a tabbed note in accordance with embodiments of the present invention. For example, in FIGS. 18B and 18C, respectively, a pocket may be in a central area of a note or on a left-hand side of a note. In FIG. 18D, there is an upper or tab portion to a tabbed note, which is visible in a stack of papers. FIG. 18E a further shape and configuration of a tabbed note with pocket.

Figure 18F:
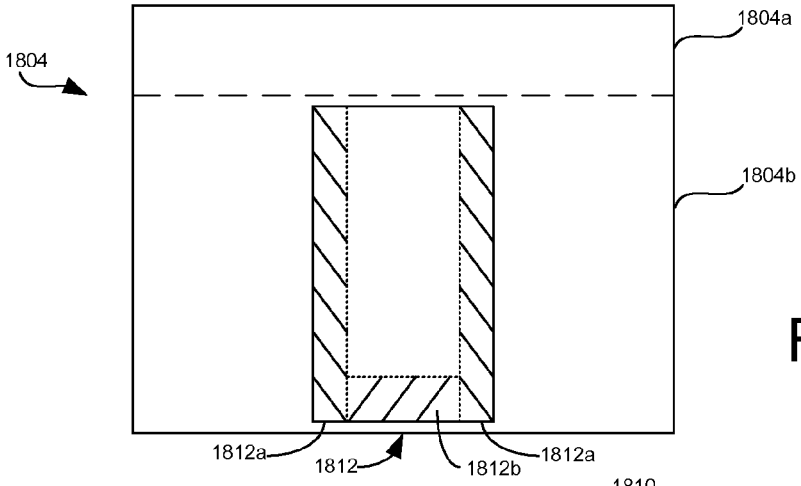
FIG. 18F is a diagrammatic representation of a tabbed note and a pocket, i.e., tabbed note 1804 and pocket 1812 of FIG. 18A, coupled together to form an overall tabbed note with a pocket in accordance with an embodiment of the present invention.
Figure 18G:
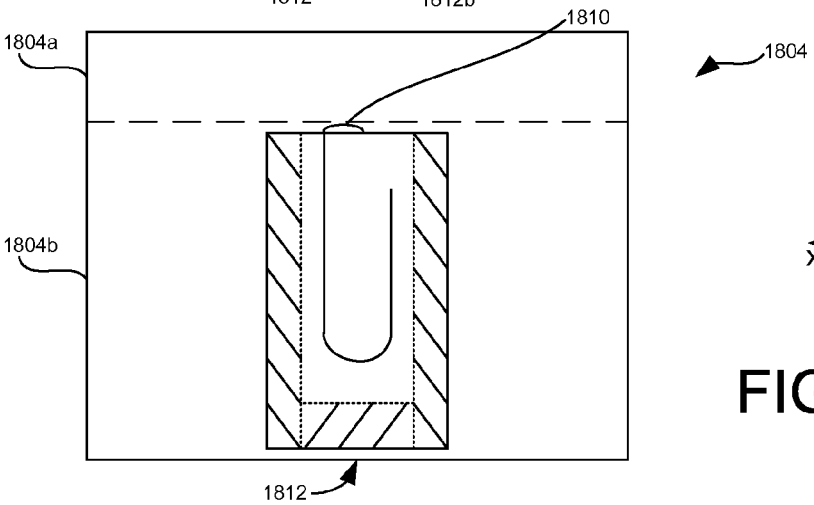
FIG. 18G is a diagrammatic representation of a tabbed note and a pocket, i.e., tabbed note 1804 and pocket 1812 of FIG. 18A, coupled to form an overall tabbed note with a pocket in which a fastener is at least partially inserted in accordance with an embodiment of the present invention.

FIGS. 18F and 18G show still further embodiments of a tabbed note with pocket in accordance with the present invention. In these embodiments, the pocket has a further bottom section 1812*b*. Once the pocket is formed, as shown in FIG. 18F, a fastener 1810 may be at least partially inserted into the pocket defined by pocket 1812 and the back surface of tabbed note 1804, as shown in FIG. 18G. It should be understood that the positioning of pocket 1812 relative to tabbed note 1804 may vary widely.

Figure 19A:
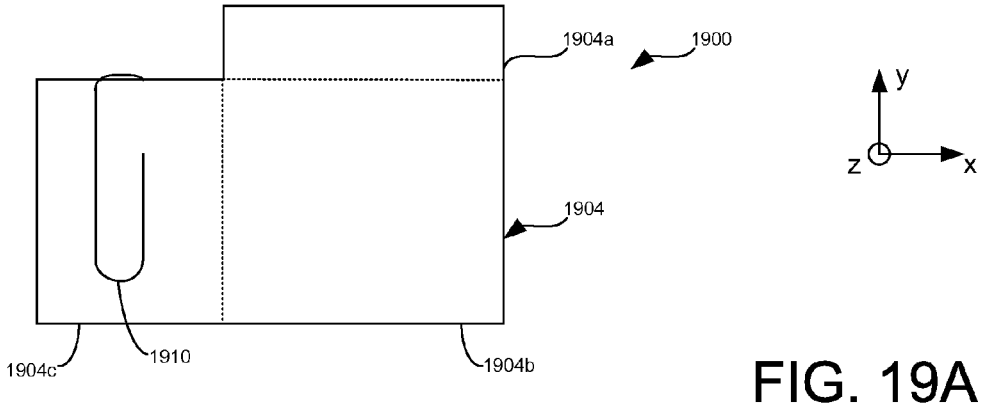
FIG. 19A is a diagrammatic representation of a front side of a tabbed note assembly with a tabbed note on which a fastener is disposed in a first position in accordance with an embodiment of the present invention.
Figure 19B:
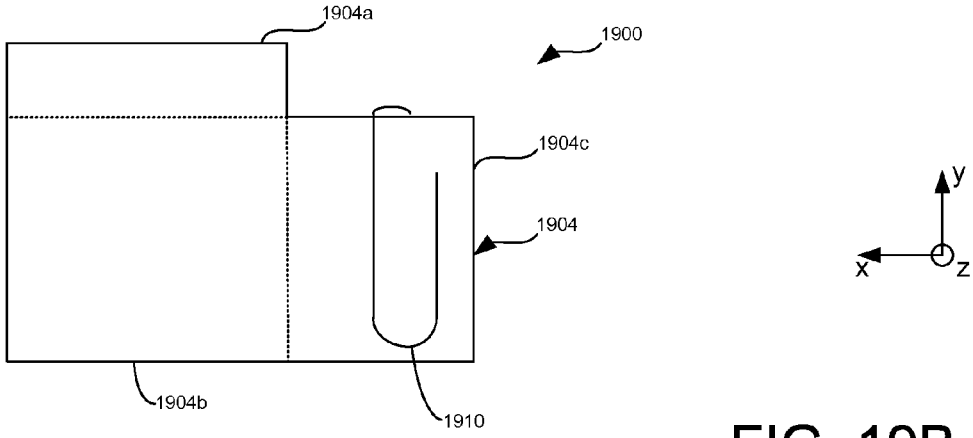
FIG. 19B is a diagrammatic representation of a back side of a tabbed note assembly with a tabbed note, i.e., tabbed note 1904 of FIG. 19A, on which a fastener is disposed in a first position in accordance with an embodiment of the present invention.

A tabbed note may be such that the tabbed note includes neither an opening through which a fastener may be at least partially inserted nor a pocket through which a fastener may be at least partially inserted. FIG. 19A is a diagrammatic representation of a front side of a tabbed note assembly with a tabbed note without an opening or a pocket in accordance with an embodiment of the present invention, while FIG. 19B is a diagrammatic representation of a back side of the tabbed note assembly. A tabbed note assembly 1900 includes a tabbed note 1904 with three portions 1904*a-c*. As shown, when a fastener 1910 is positioned substantially about a portion 1904*c*, portion 1904*a* is effectively a tab and portions 1904*b*, 1904*c* are effectively a note. A front loop of fastener 1910 is in contact with a front side of portion 1904*c*, while a back loop of fastener 1910 is in contact with a back side of portion 1904*c*.

Figure 19C:
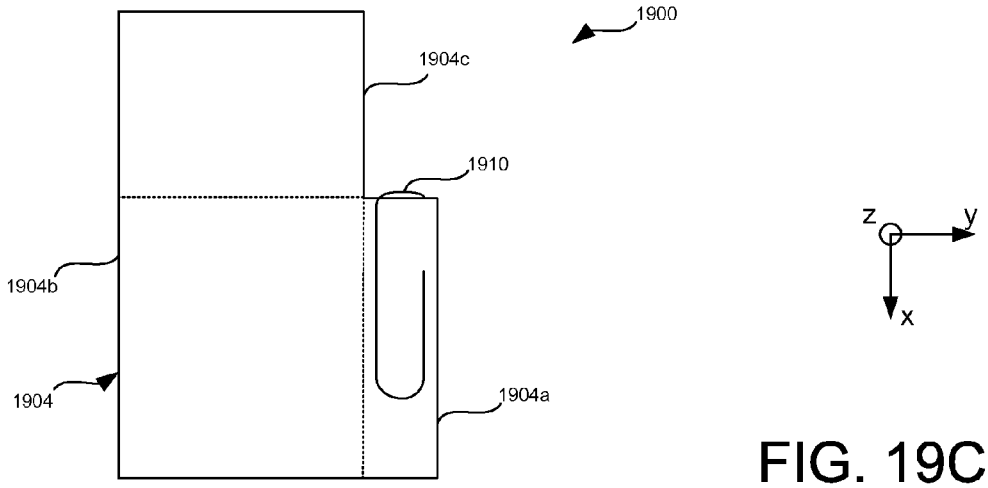
FIG. 19C is a diagrammatic representation of a front side of a tabbed note assembly with a tabbed note, i.e., tabbed note 1904 of FIG. 19A, on which a fastener is disposed in a second position in accordance with an embodiment of the present invention.

By moving fastener 1910 to a different position, a different tab may be substantially created within tabbed note assembly 1900. FIG. 19C is a diagrammatic representation of a front side of a tabbed note assembly 1900 on which a fastener is positioned about portion 1904*a*. By positioning fastener 1900 about portion 1904*a*, portion 1904*c* effectively becomes a tab while portions 1904*a*, 1904*b* effectively serve as a note. The ability to move fastener 1910 to different positions enables tabs of different sizes and shapes to be incorporated into a single tabbed note 1900 by altering the sizes of portions 1904*a*, 1904*c*. It should be appreciated, however, that portions 1904*a*, 1904*c* may also be of substantially the same size and shape. In one embodiment, a single tabbed note such as tabbed note 1904 may include more than two potential tabs. By way of example, an approximately "plus-shaped" or "cross-shaped" tabbed note may be arranged to include four potential tabs.

Figure 19D:
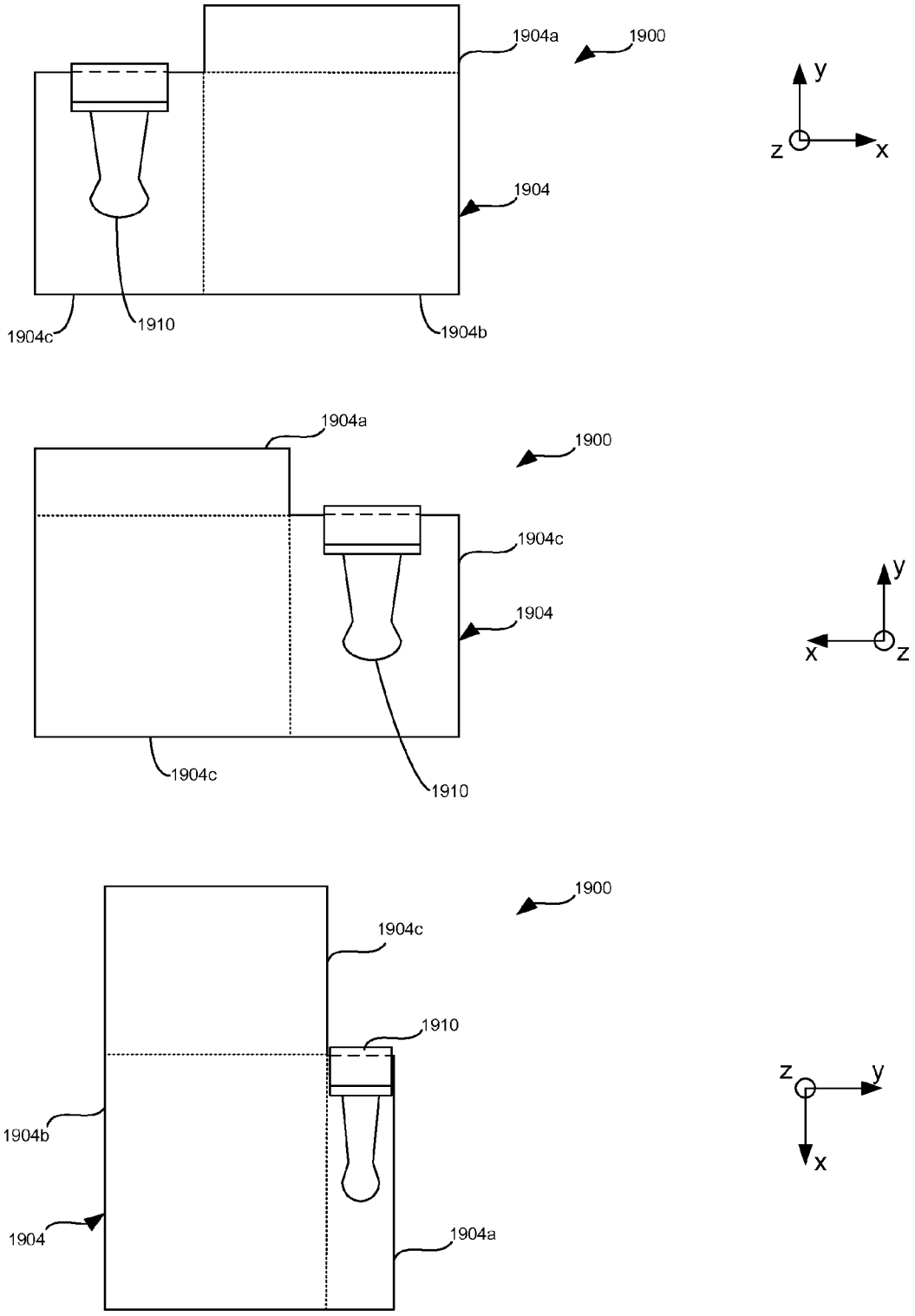
FIG. 19D shows embodiments of the invention with a binder clip fastener.

FIG. 19D shows embodiments of the invention using a binder clip fastener.

Furthermore, FIGS. 19A to 19D show embodiments of the invention where the tabbed note has a corner, where the fastener will be placed, completely removed. In alternative embodiments of the invention, instead of completely removing the corner, the tabbed note may have a horizontal cut, slit or perforation, and fastener clasps the tabbed note via the horizontal cut. The upper portion of the tabbed note, above the cut, may be left as is, or may be folded over. Tabbed note with a cut for the fastener may be packaged in a kit of the invention.

Tabbed note assemblies may be packaged as kits. A kit may be contained in a receptacle such as a box or other container that includes at least one compartment. For a kit which contains both assembled tabbed note assemblies and extra tabbed notes, one compartment of a kit may hold the tabbed note assemblies, while another compartment may hold replacement or extra tabbed notes that may be used to replace tabbed notes which have already been used. A kit may also be arranged to hold fasteners and tabbed notes in separate compartments such that a user may obtain the kit and then assemble tabbed note assemblies using the fasteners and tabbed notes. It should be appreciated that a kit is not limited to holding one size of tabbed notes and one size of fasteners, as a kit may hold different sizes of both tabbed notes and fasteners.

Figure 20A:
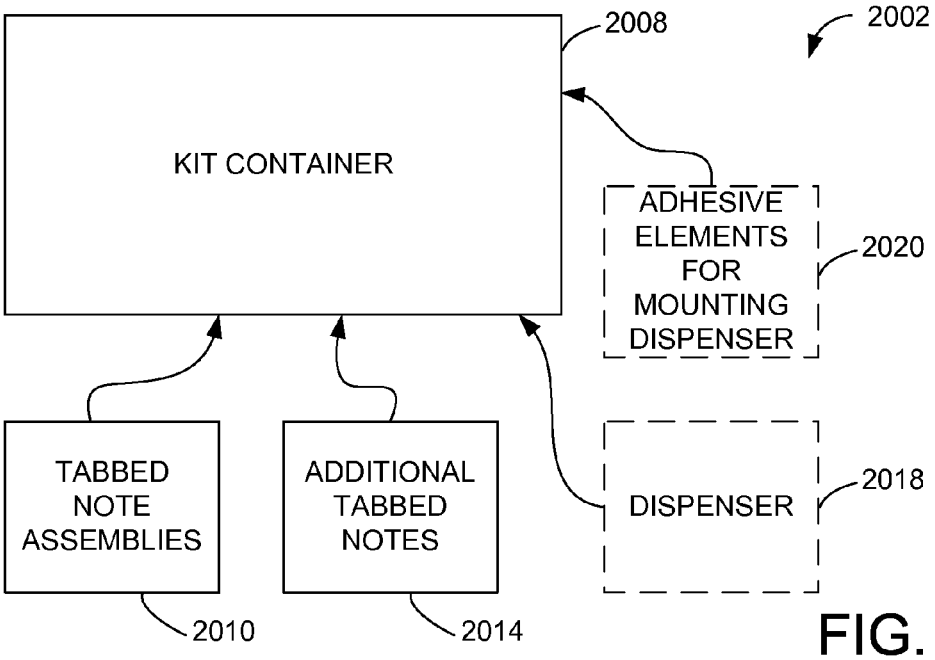
FIG. 20A is a block diagram representation of a first kit which contains tabbed note assemblies in accordance with an embodiment of the present invention.

FIG. 20A is a block diagram representation of one kit which may be used to hold assembled tabbed note assemblies and additional tabbed notes in accordance with an embodiment of the present invention. A kit 2002 includes a kit container 2008 that may generally be formed from a material such as cardboard, plastic, or a combination of cardboard and plastic. In one embodiment, kit container 2008 may include an injection molded piece which is formed into a plurality of compartments.

One compartment may be sized to hold a stack of tabbed note assemblies 2010, while a second compartment may be sized to hold a stack of tabbed notes 2014, i.e., refills which may be used to replace the tabbed notes of tabbed note assemblies 2010. Tabbed notes 2014 may include openings or holes through which fasteners may be inserted. The compartment of kit 2008 that holds tabbed notes 2014 may be shaped and sized to be just large enough to hold the replacement tabbed notes 2014 and, further, may have a spindle or a post that fits through the openings or holes in the tabbed notes 2014. Such a spindle may be sized similarly to the openings or holes, and may serve to hold tabbed notes 2014 more securely in place. In one embodiment, in lieu of a spindle, tabbed notes 2014 may instead to held securely together using shrink wrap or any suitable plastic wrap.

Kit container 2008 may also optionally include a compartment that holds at least one dispenser 2018 that is arranged to dispense tabbed note assemblies 2010. Such a dispenser 2018 may be prefilled with tabbed note assemblies, or may be arranged to be filled by a user. In one embodiment, dispenser 2018 may be prefilled with tabbed note assemblies and placed in a compartment that accommodates tabbed note assemblies 2010. That is, in some instances, tabbed note assemblies 2010 may substantially only be provided with kit 2002 within a dispenser.

Dispenser 2018 may generally include an opening that facilitates the dispensation of a single tabbed note assembly at a time. Kit container 2008 may also optionally include adhesive elements 2020 intended for use in mounting dispenser 2018 on a surface. Adhesive elements 2020 may be elements such as at least one double-sided piece of tape, or at least one piece of adhesive foam with adhesive on two sides. Adhesive elements 2020 may be provided in a separate compartment of kit container 2008, or may be provided in the same compartment as dispenser 2018. The adhesive may be optional.

To facilitate the use of dispenser 2018, as well as to facilitate the use of additional tabbed notes 2014 once the tabbed notes of tabbed note assemblies 2010 have been used and potentially discarded, kit 2002 may include instructions (not shown) for use. Such instructions may be provided on a piece of paper inserted into kit container 2008, or may be printed on kit container 2008. By way of example, if kit container 2008 includes a plastic component and a cardboard component, instructions may be printed on the cardboard component.

Figure 20B:
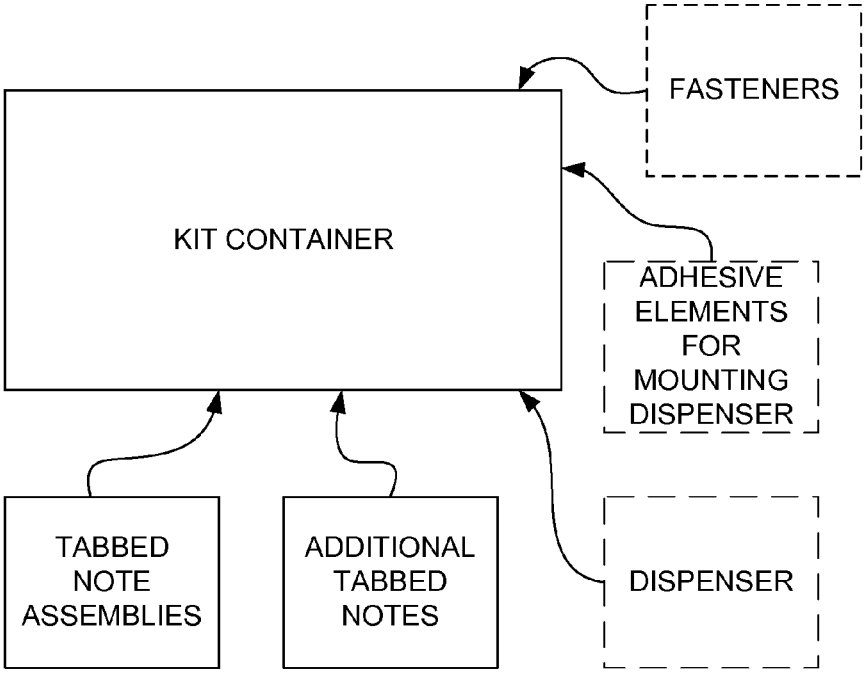
FIG. 20B shows a kit of the invention including tabbed note assemblies, additional tabbed notes, dispenser, adhesive elements for mounting dispenser, and fasteners.

FIG. 20B shows a kit of the present invention including tabbed note assemblies, additional tabbed notes, dispenser, adhesive elements for mounting dispenser, and fasteners. The adhesive in such a kit may be optional. The kit may include any one of the tabbed notes, fastener, dispenser, or adhesive, or any combination of these. For example, the tabbed notes may be sold alone in a shrink-wrapped package.

Figure 20C:
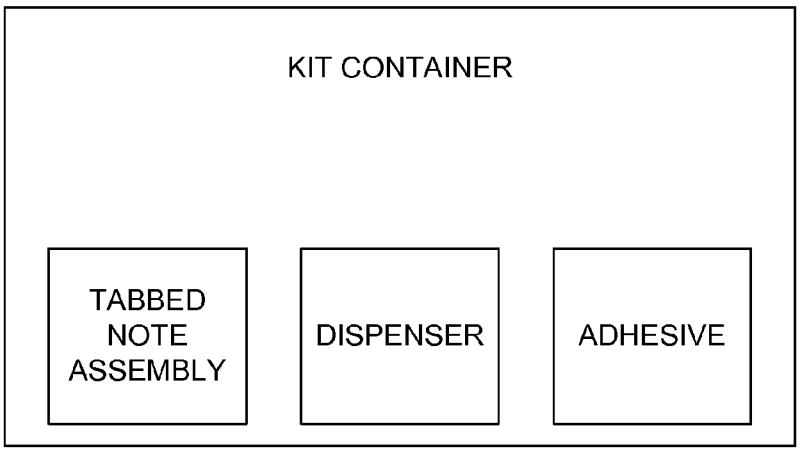
FIG. 20C shows a kit container having a tabbed note assembly pages, dispenser, and adhesive in accordance with an embodiment of the present invention.
Figure 21A:
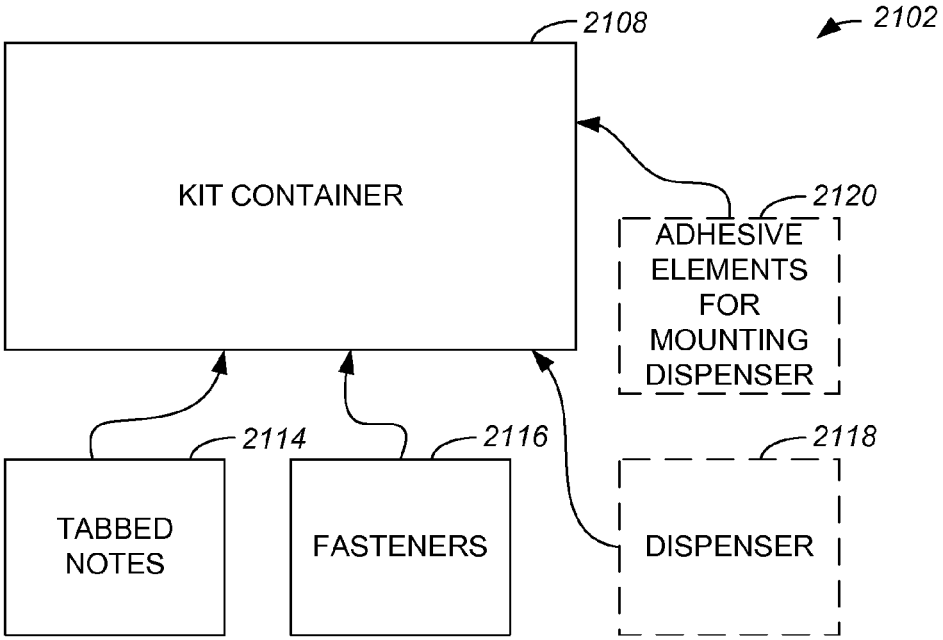
FIG. 21A is a block diagram representation of a second kit which contains tabbed notes and fasteners in accordance with an embodiment of the present invention.

FIG. 20C shows a kit container having a tabbed note assembly pages, dispenser, and adhesive in accordance with an embodiment of the present invention. The adhesive in such a kit may be optional. FIG. 21A is a block diagram representation of a kit which may include tabbed notes and separate fasteners in accordance with an embodiment of the present invention. A kit 2102 includes a kit container 2108 that is arranged to hold tabbed notes 2114 and fasteners 2116. Like kit container 2008 of FIG. 20A, kit 2102 may be formed to include a plurality of compartments, although kit container 2008 may instead include only a single compartment. Tabbed notes 2114 may be provided in a compartment of kit container 2108 that is sized to accommodate tabbed notes 2114, and fasteners 2116 may be provided in a compartment of kit container 2108 that is sized to accommodate fasteners 2116. The compartment that houses tabbed notes 2114 may utilize a spindle to hold tabbed notes 2114 securely in place.

Alternatively, tabbed notes 2114 may be covered with shrink wrap to hold them in a stack. Fasteners 2116 may be paper clips or binder clips. It should be appreciated that fasteners 2116 may generally include paper clips of a single size, binder clips of a single size, an assortment of paper clips of different sizes, an assortment of binder clips of different sizes, or a combination of both paper clips and binder clips. Similarly, tabbed notes 2114 may all be of the same shape and color, although differently sized, shaped, and colored tabbed notes 2114 may all be provided as a part of kit 2102.

Kit 2102 optionally includes at least one dispenser 2118. Dispenser 2118 may be arranged to dispense tabbed notes 2114 and, in one embodiment, fasteners 2116. Dispenser 2118 may be prefilled with tabbed notes and placed in a compartment that accommodates tabbed notes 2014. When dispenser 2118 is arranged to dispense fasteners 2116, dispenser 2118 may include a small cup or box portion in which fasteners 2116 may be placed. When dispenser 2118 is included in kit 2102, adhesive elements 2120 which may be utilized to allow dispenser 2118 to be mounted on a surface may also be included in kit 2102. The adhesive may be optional. Like kit 2002 of FIG. 20, kit 2102 may also include instructions (not shown) such as instructions which provide details on how tabbed notes 2114 and fasteners 2116 are to be assembled to form tabbed note assemblies.

Figure 21B:
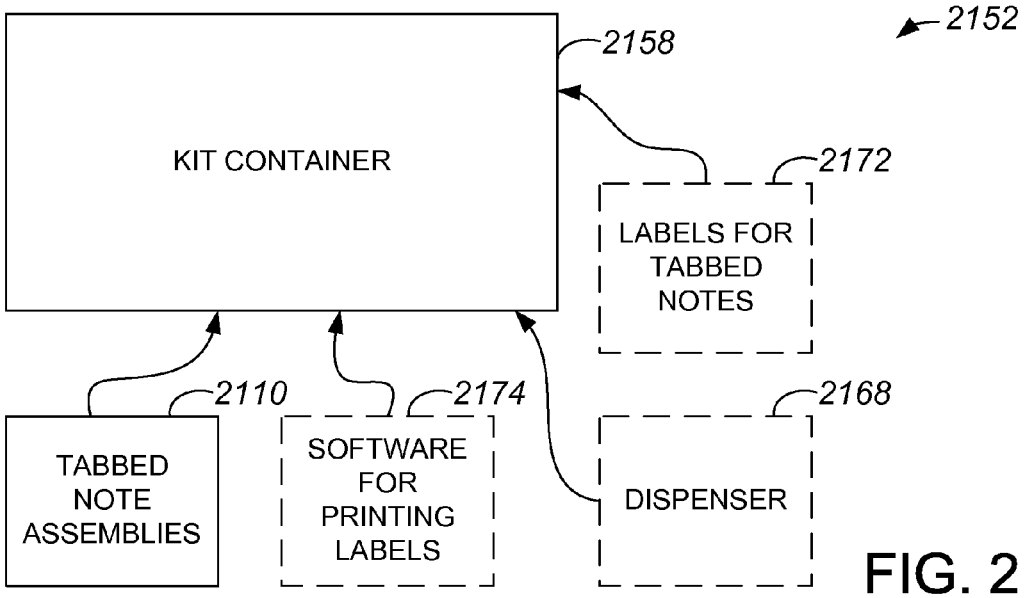
FIG. 21B is a block diagram representation of a kit which contains tabbed note assemblies, labels, and software for printing the labels in accordance with an embodiment of the present invention.

In one embodiment, a kit may include labels which may be printed, e.g., using a computing system, and then affixed to a tabbed note. When a kit includes labels, the kit may also include software that is used to print the labels. With reference to FIG. 21B, a kit which includes labels and software will be described in accordance with an embodiment of the present invention. A kit 2152 includes a kit container 2158 that is arranged to hold tabbed note assemblies 2110. Although tabbed note assemblies 2110 are shown, kit container 2158 may instead separately contain tabbed notes and fasteners. Also contained in kit container 2158 is a dispenser 2168 that may be arranged to dispense tabbed note assemblies 2110. Labels 2172, which may be clear or of substantially any color, shape, or size are contained in kit container 2158. In general, labels 2172 are arranged to fit on tab portions of tabbed note assemblies 2110, although labels may have a variety of different sizes. Software 2174 that enables labels 2172 to be printed may be provided in kit container 2158. The format in which software 2174 may be provided varies widely. By way of example, software 2174 may be embodied on a CD-ROM, a floppy disk, a DVD, or a flash memory. Further, software

2174 may be embodied as a printed web address that provides a link to a software downloading website.

There are further kit implementations of the invention. For example, a kit includes tabbed notes assemblies of the invention: (1) having multiple different widths of paper (i.e., varying widths of paper); (2) having multiple different lengths of paper (varying lengths of paper); (3) having multiple different colors of paper; (4) having different printing on paper; (5) where position of hole varies; (6) with different paper shapes; (7) where clip width is less than hole of paper; (8) where clip width is less than hole of paper up to a stop member; (9) with different colors of clips; (10) with different shapes of clips; (11) with more sheets of paper than clips; (12) where there are more clips than sheets of paper; (13) where hole is perforated, and will be punched out by customer; (14) where hole is perforated at various positions, and hole is selected by customer and punched out by customer; (15) with clips and colored marking tool (e.g., marker, pen, pencil, crayon, pen writing using metallic colors, pen have different gel colors); (16) including clips and adhesive stickers, including self-adhesive type, gummed type (stickers may have various shapes, colors, printing); (17) including clips being magnetic or having a magnet attached (e.g., useful for using as a refrigerator magnet as well as with paper); (18) including paper, hole punch, and clip; (19) where paper has perforated tear-off portions; (20) where paper has removable pull-off portions (different portions have clean writing surface, different color, different printing); (21) with various printed positions where hole may be punched, hole punch, and clip; (22) with paper with embedded computer chip (e.g., RFID) and software used to program computer (RFID) chip; (23) with paper or tab having embedded voice recording chip, so personal voice or other audio messages may be recorded (e.g., tabs may be programmed with a particular ringtone alarm—if copyrighted ringtone is used, then payment may be made to copyright owner); (24) with paper or tab having LED which is programmable to flash at certain rate on a certain time or day or after a certain elapsed time (e.g., useful as a reminder tab so the LED will flash when something becomes due, programmable by the user using software part of kit); or (25) with paper with built-in loop or reinforced hole, or combinations of these. There are many other implementations of kit off The invention further includes methods of using a kit. For example, a method may include accessing a kit such as discussed in this application. The method may further include: selecting a paper from a paper portion of the kit; selecting a clip from a clip portion of the kit; and inserting the clip through the hole of the invention paper. A method may include: accessing a kit such as listed above; selecting a paper from a paper portion of the kit; selecting a clip from a clip portion of the kit; punching a hole in the paper; and inserting the clip through the hole of the invention paper.

The edges of the invention may be rounded because this (a) increases service life of die used to cut the paper (discussed further below) and (b) eases insertion of invention into paperwork, without bending edges. The invention includes sheets of the invention for automated printing using sheet-feed printer or laser printer. A kit may include have software to print on this paper. Microperforations may be used in the sheets, so that when tabbed noted is removed for the sheet, the edges of the tabbed note resume is as if they were cut instead of being torn off. Tabbed notes of the invention may also include clear sleeve where the paper tab (or other material) is inserted into sleeve.

Figure 22A:
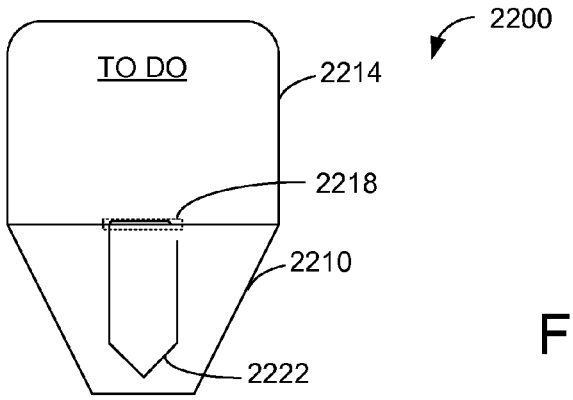
FIG. 22A is a diagrammatic representation of a front side of a tabbed note assembly with an extended tab area in accordance with an embodiment of the present invention.
Figure 22B:
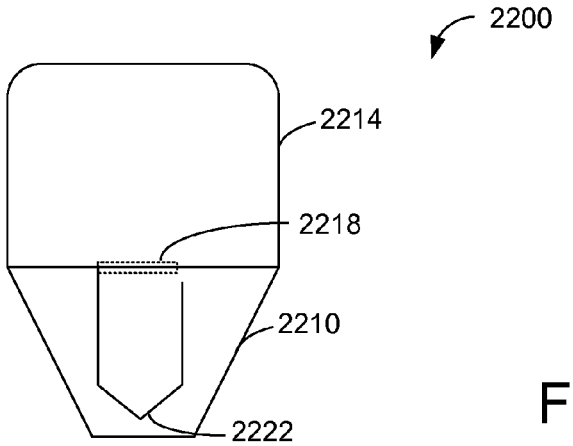
FIG. 22B is a diagrammatic representation of a back side of a tabbed note assembly, i.e., tabbed note assembly 2200 of FIG. 22A, in accordance with an embodiment of the present invention.

FIGS. 22A and 22B are a diagrammatic representation of a tabbed note assembly with a trapezoidally shaped note portion in accordance with an embodiment of the present invention. A tabbed note assembly 2200 includes a trapezoidally shaped note portion 2210 and a tab portion 2214. The trapezoidally shaped note portion is such that two opposite sides of the note portion are substantially parallel to one another, while the other two opposite sides are not parallel to one another. Although the size of note portion 2210 and tab portion 2214 may vary widely, tab portion 2214 may have a width of approximately 1.25 inches, a width of approximately 1.6 inches, and a width of approximately 2.5 inches. Note portion 2210 may be sized such that a bottom edge of note portion 2210 has a width that is at least slightly larger than a width of a fastener 2222 inserted through an opening 2218. In one embodiment, tab portion 2214 may be preprinted on a front side with a label such as a "To Do" label or message, as shown in FIG. 22A. Although a back side of tab portion 2214 is not preprinted with a label, as shown in FIG. 22B, it should be appreciated that back side may also be preprinted with a label.

Figure 22C:
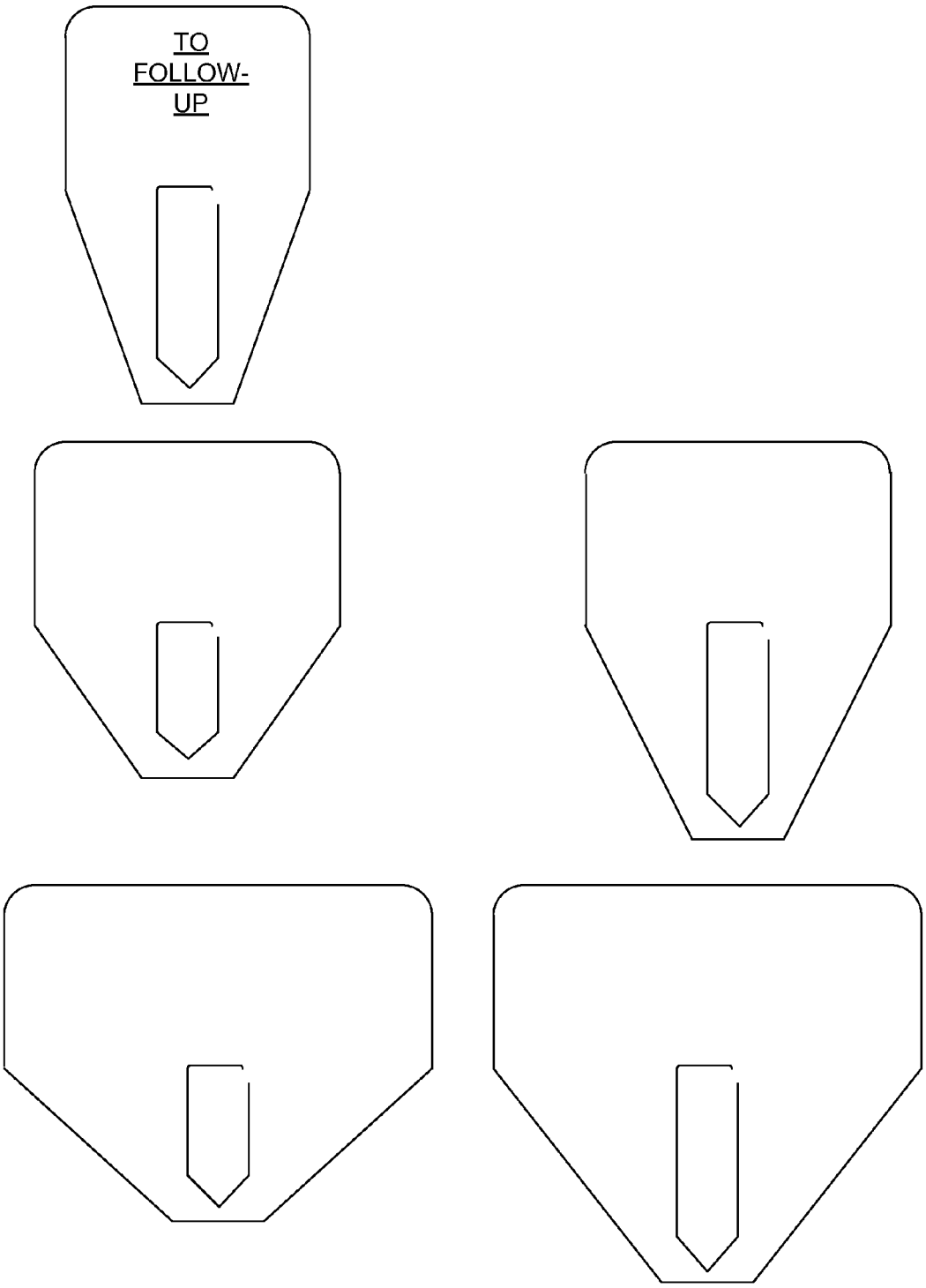
FIG. 22C shows embodiments of a tabbed note assembly with an extended tab and a slit opening in accordance with an embodiment of the present invention.
Figure 22D:
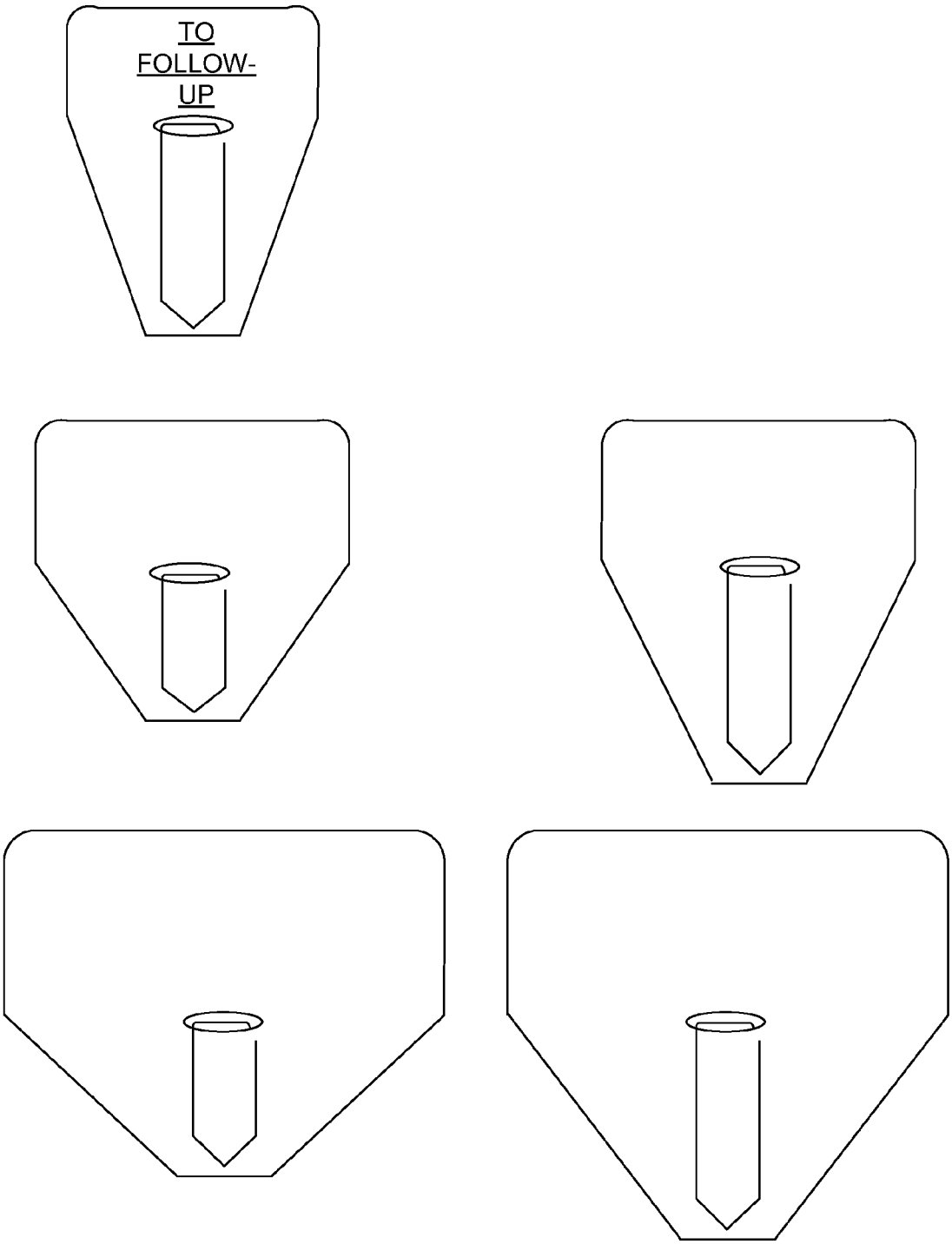
FIG. 22D shows embodiments of a tabbed note assembly with an extended tab and a rounded opening in accordance with an embodiment of the present invention.

FIG. 22C shows a variety of different tabbed note assemblies having trapezoidally shaped note portions and openings that are formed as narrow slits in accordance with embodiments of the present invention, while FIG. 22D shows a variety of different tabbed note assemblies having trapezoidally shaped note portions and openings that are formed with at least two rounded edges in accordance with an embodiment of the present invention As shown, tabbed portions of tabbed note assemblies may vary widely in size. Tabbed portions may have substantially any suitable label printed thereon, and may have rounded top edges. In general, the width of a bottom of a trapezoidally shaped note portion remains slightly larger than the width of a fastener, though a size of a top of the trapezoidally shaped note portion varies as the size of a tabbed portion varies. It should be appreciated that tabbed note assemblies having trapezoidally shaped note portions may have various optional features which include, but are not limited to, perforations which allow a tabbed portion to be removed. Further, in lieu of having an opening through which a fastener may be inserted, a tabbed note assembly with a trapezoidally shaped note portion may have a pocket into which a fastener may be partially inserted.

Figure 23A:
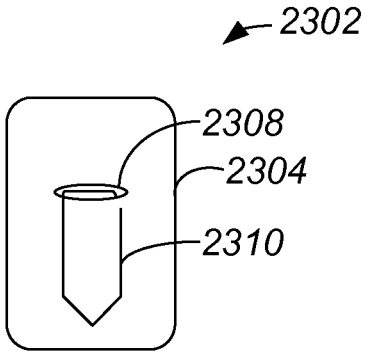
FIG. 23A is a diagrammatic representation of a front side of a tabbed note assembly that has a thin rectangular shape with rounded corners in accordance with an embodiment of the present invention.

As described above, the size and the shape of tabbed notes, as well as the size and the shape of openings through which fasteners may be inserted, may vary widely. Further, the size of a tab portion of a tabbed note relative to a note portion of the tabbed note may also vary. As shown in FIG. 23A, a tabbed note assembly 2302 may include an approximately rectangularly shaped tabbed note 2304 with rounded corners. An opening 2308 through which a fastener 2310 may be inserted may be approximately ovular in shape. It should be appreciated that although fastener 2310 is shown as effectively being a modified perfect gem paper clip, e.g., a perfect gem paper clip with a blunt point, fastener 2310 may be substantially any fastener.

In the embodiment shown, a height of tabbed note 2304 may be in the range of approximately 1.5 inches to approximately 2.5 inches, while a width may be substantially any width that is wider than a width of fastener 2310. In some embodiment, the height may be less than 1.5 inches, such as 1.25 to 1.625 inches, or the height may be greater than 2.5 inches. In a specific implementation, the width is about 2.25 inches. By way of example, width of fastener may be approximately 12.3 millimeters, and the width of tabbed note 2304 may be greater than approximately 0.5 inches. In a specific implementation, the width of the fastener is about 11.5 millimeters to 12.5 millimeters. In specific implementations, the width of the tabbed notes are about 1.25 inches, about 1.625 inches, and about 2.325 inches. In specific implementations, the height of the tabbed notes are about 2.25 inches and 2.75 inches. Opening 2308 is sized to accommodate fastener 2310.

In specific implementations, the height and width dimensions of the tabbed notes are about 2.25 by 1.25 inches (58 millimeters by 32 millimeters), 2.25 by 1.625 (58 millimeters by 41 millimeters), and 2.25 by 2.325 (58 millimeters by 60 millimeters). In specific embodiments where a larger fastener is used, the height and width dimensions of the tabbed notes are about 2.75 by 1.25 inches (71 millimeters by 32 millimeters), 2.75 by 1.625 (71 millimeters by 41 millimeters), and 2.75 by 2.325 (71 millimeters by 60 millimeters). A kit of the invention may include tabbed notes of different colors of a single dimension. A kit of the invention may include tabbed notes of different dimensions. For example, there may be tabbed notes having dimension of 2.25 by 1.25 inches and 2.75 by 1.25 inches in a single package with a container or dispenser to hold these tabbed notes. In other kits, there may tabbed notes of two or more different widths.

Figure 23B:
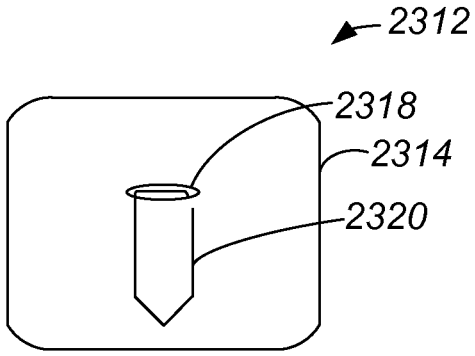
FIG. 23B is a diagrammatic representation of a front side of a tabbed note assembly that has a thick rectangular shape with rounded corners and a rounded opening in accordance with an embodiment of the present invention.

FIG. 23B shows a tabbed note assembly 2312 that is similar to tabbed note assembly 2302 of FIG. 23A. Tabbed note assembly 2312, however, has a tabbed note 2314 that is wider than tabbed note assembly 2302 of FIG. 23A.

Figure 23C:
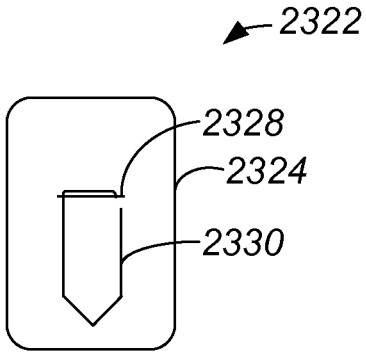
FIG. 23C is a diagrammatic representation of a front side of a tabbed note assembly that has a thin rectangular shape with rounded corners and a slit opening in accordance with an embodiment of the present invention.
Figure 23D:
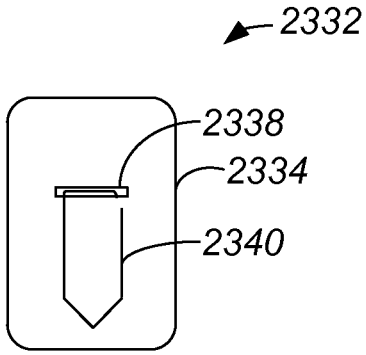
FIG. 23D is a diagrammatic representation of a front side of a tabbed note assembly that has a thin rectangular shape with rounded corners and a rectangular opening in accordance with an embodiment of the present invention.

The shape of an opening in a tabbed note assembly through which a fastener may be inserted may vary widely, as previously discussed. As shown in FIG. 23C, a tabbed note assembly 2322 may include a tabbed note 2324 with a slit opening 2328 that accommodates a fastener 2330. Alternatively, as shown in FIG. 23D, a tabbed note assembly 2332 includes a tabbed note 2334 with an approximately rectangular opening 2338 through which a fastener 2340 may be inserted.

Figure 23E:
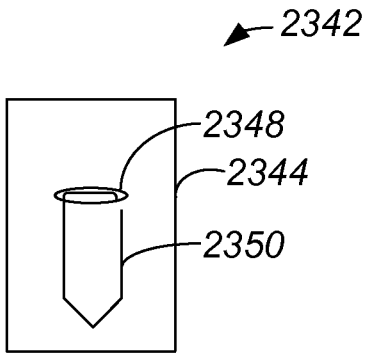
FIG. 23E is a diagrammatic representation of a front side of a tabbed note assembly that has a thin rectangular shape with squared corners and a rounded opening in accordance with an embodiment of the present invention.
Figure 23F:
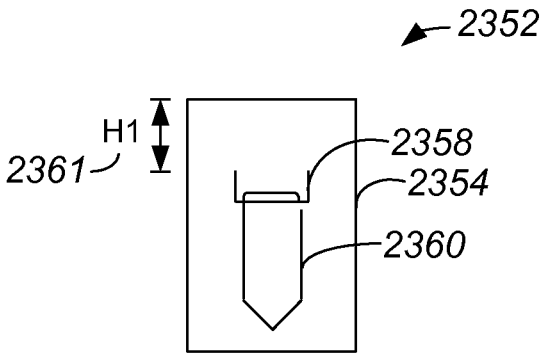
FIG. 23F is a diagrammatic representation of a front side of a tabbed note assembly that has a thin rectangular shape with squared corners and an extended slit opening in accordance with an embodiment of the present invention.

FIG. 23E is a diagrammatic representation of a tabbed note assembly which is approximately rectangularly shaped with squared corners in accordance with an embodiment of the present invention. A tabbed note assembly 2342 includes a rectangular tabbed note 2344 with an approximately ovular opening 2348 through which a fastener 2350 may be inserted. The shape of opening 2348 may vary, however. By way of example, an opening may be rectangular in shape or may be a narrow slit. Alternatively, an opening may be a slit that has two bends. As shown in FIG. 23F, a tabbed note assembly 2354 is composed of a rectangular tabbed note 2354 with an squared approximately U-shaped slit 2358 through which a fastener 2360 may be inserted. To prevent slit 2358 from ripping into a tab portion of tabbed note 2354, a distance H1 2361 between a top section of slit 2358 and a top of a tab portion is specified. Distance H1 2361 may be at least approximately 0.5 inches. In a specific implementation, distance H1 is about 0.875 inches.

Figure 23G:
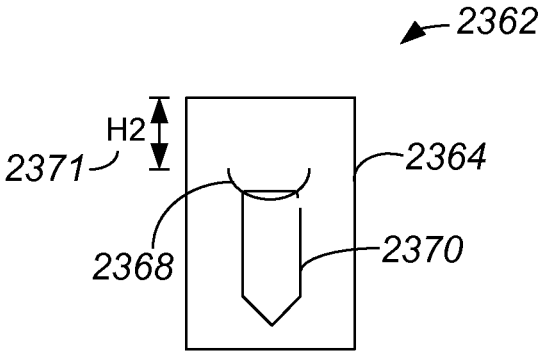
FIG. 23G is a diagrammatic representation of a front side of a tabbed note assembly that has a thin rectangular shape with squared corners and a curved slit opening in accordance with an embodiment of the present invention.

As shown in FIG. 23G, in lieu of having a squared approximately U-shaped slit, a tabbed note assembly 2362 may include a tabbed note 2364 that has a rounded approximately U-shaped slit 2368 through which a fastener 2370 may be inserted. A top section of slit 2368 and a top of a tab portion of tabbed note 2364 may have a distance H2 2371 that is at least approximately 0.75 inches.

Figure 24A:
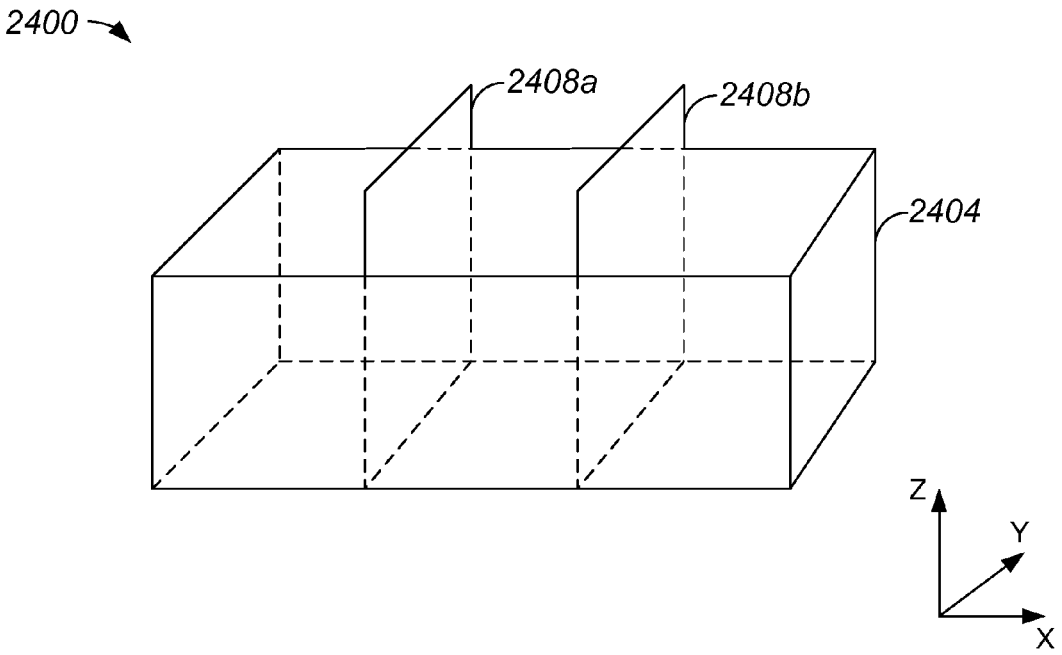
FIG. 24A is a diagrammatic representation of a kit box with a plurality of partitions in accordance with an embodiment of the present invention.

Kits that contain tabbed notes or tabbed note assemblies have been described as including a kit container. FIG. 24A is a diagrammatic representation of one kit container in accordance with an embodiment of the present invention. A kit container 2400 includes a 5-sided box 2404. Box 2404 effectively does not have a top, i.e., has an open side. Although box 2404 may be formed from any suitable material, in one embodiment, box 2404 is formed from a plastic material, e.g., a clear plastic.

Dividers 2408*a* and 2408*b* that extend above the top of box 2404 define rows in box 2404 that may contain tabbed notes or tabbed note assemblies (not shown). The orientation of tabbed note assemblies (not shown) in box 2404 will be described below with reference to FIGS. 25A, 25B. Dividers 2408*a* and 2408*b* may be formed from the same material as box 2404. Box 2404 may include guides (not shown) that allow dividers 2408*a* and 2408*b* to be held in place, e.g., removably held in place. Alternatively, divider 2408*a* and 2408*b* may include a bottom portion (not shown) that may be attached to box 2404 to hold dividers 2408*a* and 2408*b* in place.

Figure 24B:
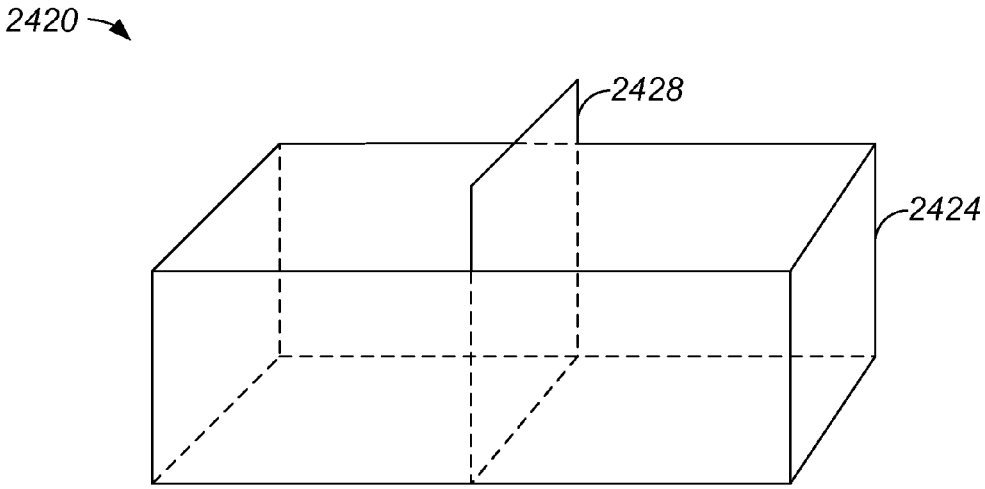
FIG. 24B is a diagrammatic representation of a kit box with a single partition in accordance with an embodiment of the present invention.

The number of dividers 2408*a* and 2408*b* in box 2404 may vary widely. By way of example, more dividers may be used to create more rows or compartments within box 2404. Alternatively, one divider may be used in a box to create two rows. As shown in FIG. 24B, a kit container 2420 may include a box 2424 that is arranged to accommodate one divider 2428 that creates two compartments in box 2424. A dispenser of the invention may include no dividers (in the case where there is a single tabbed note compartment) or one or more dividers (in the case where there are multiple tabbed note compartments). There will be n+1 tabbed note compartment for n dividers. In one compartment, there may be tabbed notes of one or more dimensions. For example, one compartment may include tabbed notes have the same width by different height.

Each row in kit container 2420 may contain different colors of tabbed note assemblies. By way of example, one row may contain tabbed note assemblies of one color scheme and another row may contain tabbed note assemblies of another color scheme. For an embodiment in which tabbed note assemblies are such that a tab portion of a tab is one shade of a color while a note portion is another shade of substantially the same color, one row may contain tabbed note assemblies which each have two shades of the same color while another row may contain tabbed note assemblies which each have two shads of a different color.

Figure 25A:
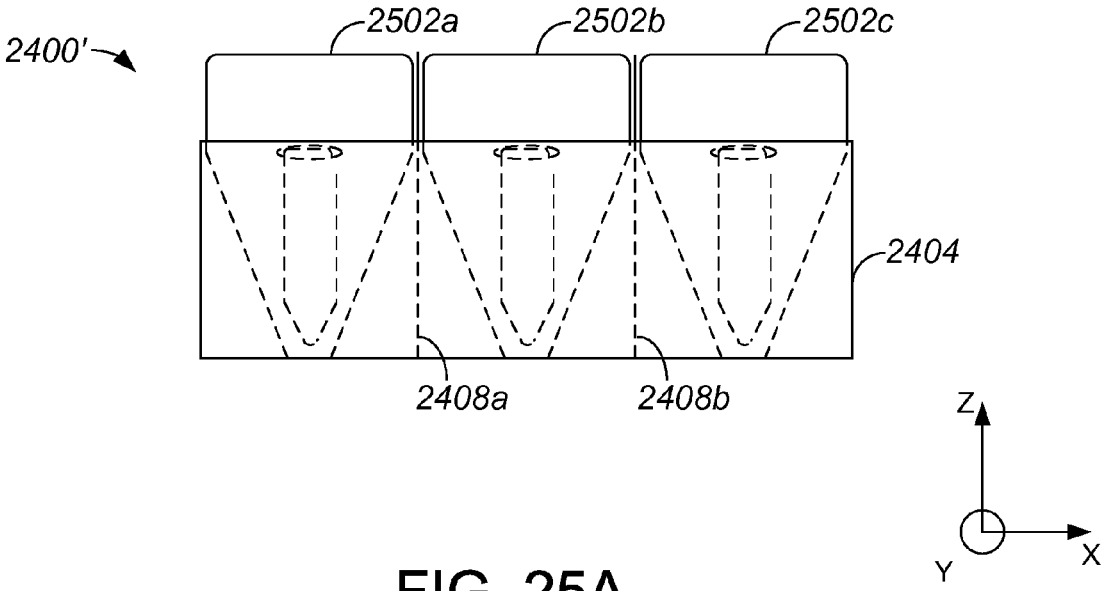
FIG. 25A is a diagrammatic representation of a front side of a kit box, e.g., kit box 2400 of FIG. 24A, that contains tabbed note assemblies in accordance with an embodiment of the present invention.
Figure 25B:
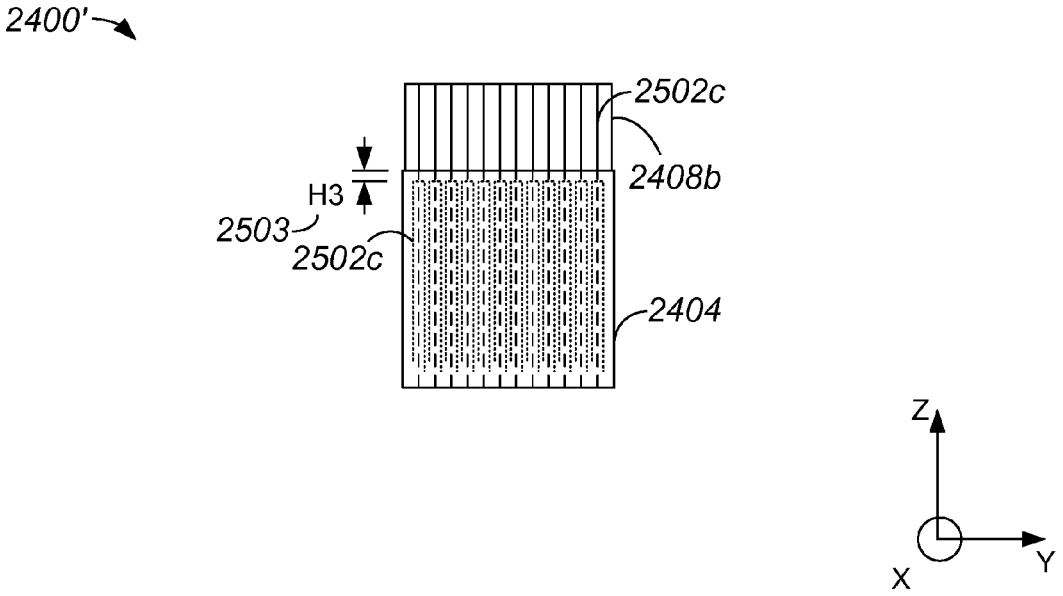
FIG. 25B is a diagrammatic representation of a side of a kit box, e.g., kit box 2400' of FIG. 25A, that contains tabbed note assemblies in accordance with an embodiment of the present invention.

FIG. 25A is a diagrammatic representation of a front side of a kit box, e.g., kit box 2400 of FIG. 24A, that contains tabbed note assemblies, and FIG. 25B is a diagrammatic representation of a side of the kit box in accordance with an embodiment of the present invention. A kit assembly 2400' includes box 2404, dividers 2408*a* and 2408*b* and tabbed note assemblies 2502*a-c*. As box 2404 is partitioned into three rows or compartments by dividers 2408*a*, 2408*b*, tabbed note assemblies 2502*a-c* are divided into three rows. Dividers 2408*a*, 2408*b* are sized such that tabbed note assemblies 2502*a-c* are held in an upright orientation and prevented from tilting sideways. Similarly, sides of box 2404 may be sized to prevent tilting of tabbed note assemblies 2502*a*, 2502*c*. By way of example, sides of box 2404 may be sized such that they extend a distance H3 2503 above a bottom edge of tab portions of note assemblies 2502*a*, 2502*c*. Distance H3 2503 may be approximately 2 millimeters or more. In one embodiment, the top edges of dividers 2408*a*, 2408*b* are substantially level with the top edges of tabbed note assemblies 2502*a-c*.

Figure 25C:
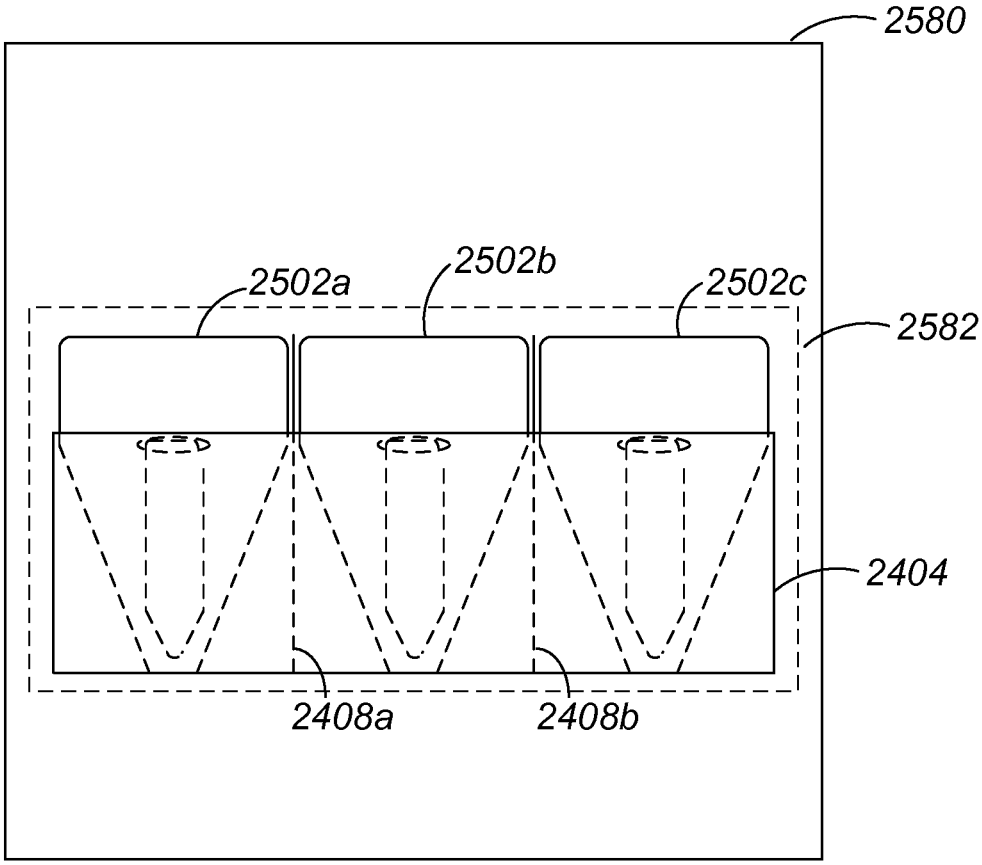
FIG. 25C is a diagrammatic representation of a kit package that contains a kit box, e.g., kit box 2400 of FIG. 24A, that contains tabbed note assemblies, e.g., tabbed note assemblies 2502*a-c* of FIGS. 25A and 25B, in accordance with an embodiment of the present invention.
Figure 25C:
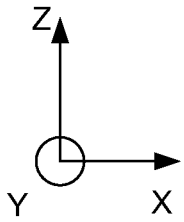

Kit assembly 2400' may be packaged such that an overall kit that may be sold to consumers. As shown in FIG. 25C, box 2404 which contains dividers 2408*a*, 2408*b* and tabbed note assemblies 2502*a-c* may be substantially held against a backing 2580 using a cage 2582 to form an overall kit. Cage 2582 may be a substantially transparent blister pack which is secured to backing 2580. In one embodiment, backing 2580 may be printed with instructions on how to utilize tabbed note assemblies 2502*a-c*. Tabbed note assemblies 2502*a-c* may be such that tabbed note assemblies 2502*a* are of a first color scheme, tabbed note assemblies 2502*b* are of a second color scheme, and tabbed note assemblies 2502*c* are of a third color scheme. Although tabbed note assemblies 2502*a-c* are shown as being substantially the same size, it should be appreciated that tabbed note assemblies 2502*a-c* contained in box 2404 may be of different sizes.

When tabbed note assemblies 2502*a-c* are positioned in compartments defined by dividers 2408*a*, 2408*b*, fasteners inserted through openings in the tabbed note assemblies are contained within the compartments in box 2404. That is, the fasteners associated with tabbed note assemblies 2502*a-c* are positioned such that the fasteners remain substantially below a top edge of box 2404. In one embodiment, while most of the tab portions of tabbed note assemblies 2502*a-c* are positioned substantially above the top edge of box 2404, the lower edges of the tab portions are positioned below the top edge of box 2404.

Figure 26A:
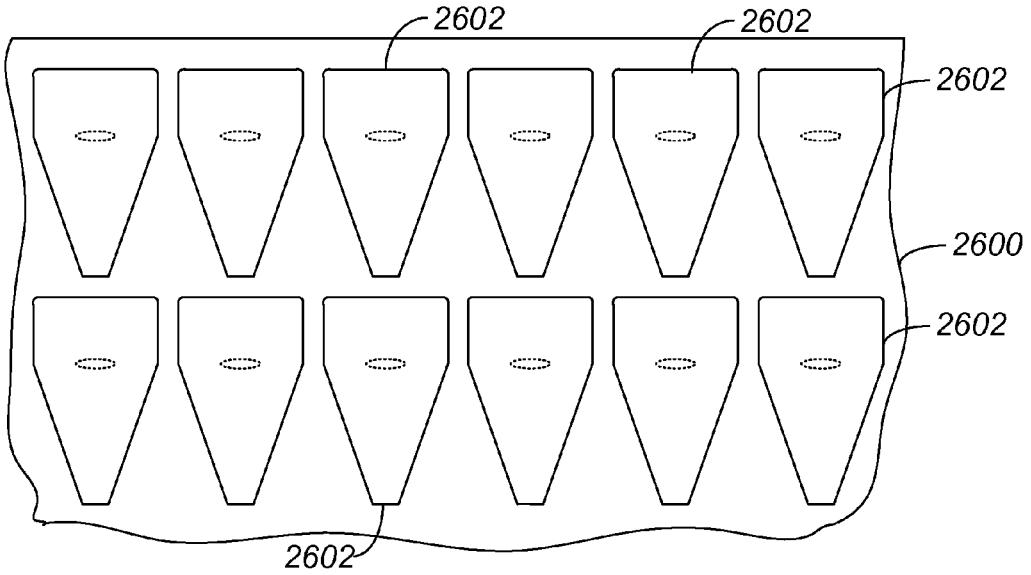
FIG. 26A is a diagrammatic representation of a sheet of material from which a plurality of tabbed notes is to be formed in accordance with an embodiment of the present invention.

To form tabbed notes, outlines of tabbed notes may be defined on a sheet of material to effectively maximize the number of tabbed notes that may be formed on the sheet. In one embodiment, the sheet is a sheet of cardstock paper that has a similar thickness as a standard manila folder. FIG. 26A is a diagrammatic representation of a portion of a sheet of material onto which outlines of tabbed notes are imposed in accordance with an embodiment of the present invention. A portion 2600 of a sheet, e.g., a sheet of cardstock paper, has tabbed notes 2602 imposed thereon. Tabbed notes 2602 may be spaced with separations that are sufficient to allow for cutting or stamping tolerances. In other words, adjacent tabbed notes 2602 typically have space between them to compensate for any inaccuracies in a process to create tabbed notes 2602 from portion 2600. The number of tabbed notes 2602 that may be formed on portion 2600 may vary widely depending upon the size and shape of tabbed notes 2602.

A sheet of material from which multiple tabbed notes are formed may be colored on one or both sides. The number of colors used to color the sheet of material may vary widely. By way of example, at least two colors may be used on each side of the sheet of material such that a tab portion of a tabbed note may have one shade of color and a note portion of the tabbed note may have a different shade of color. The methods used to provide at least one shade of color to a sheet of material may vary widely. In one embodiment, color may be printed onto the sheet of material in bands. Alternatively, color may be dyed onto the sheet of material. It should be appreciated that a base color, e.g., a color corresponding to a note portion, may be dyed onto a sheet of material, and then the sheet of material may be printed on in bands such that the shade of the color that corresponds to a tab portion may be slightly different from the base color.

Figure 26B:
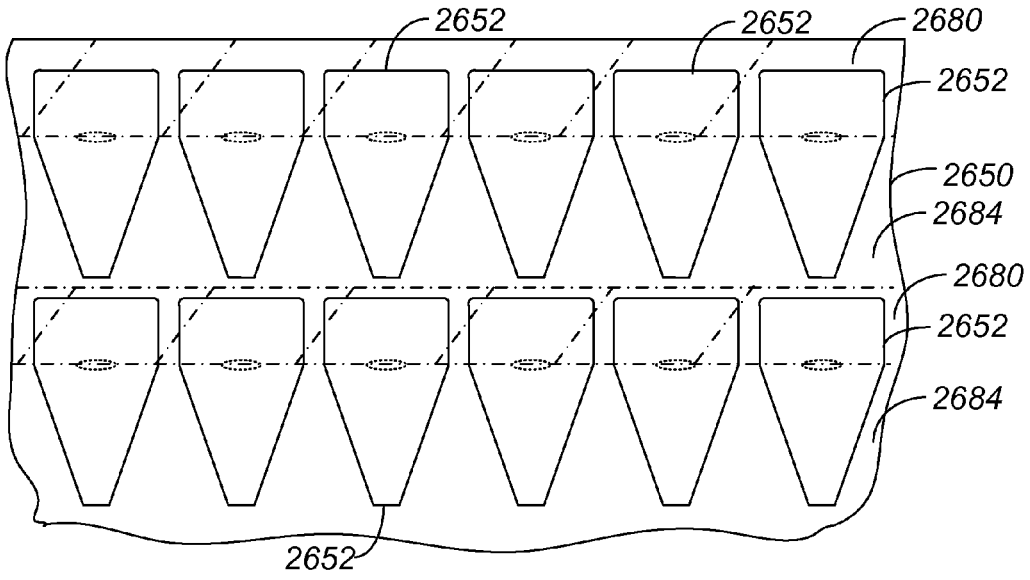
FIG. 26B is a diagrammatic representation of a multi-toned sheet of material from which a plurality of tabbed notes is to be formed in accordance with an embodiment of the present invention.

With reference to FIG. 26B, the imposition of tabbed notes onto a portion of a sheet of material with colored bands will be described in accordance with an embodiment of the present invention. A portion 2650 of a sheet of material has bands 2680, 2684 of color. Bands 2680 may all be approximately a same shade of color, while bands 2684 may all be approximately a same shade of color. In one embodiment, there may be a band (not shown) between a bottom of bands 2684 and a top of bands 2680 that is not a part of any tabbed notes 2652. Bands 2684 are arranged to be the shade of color of note portions of tabbed notes 2652, while bands 2652 are arranged to be the shade of color of the tab portions of tabbed notes 2652.

Figure 27:
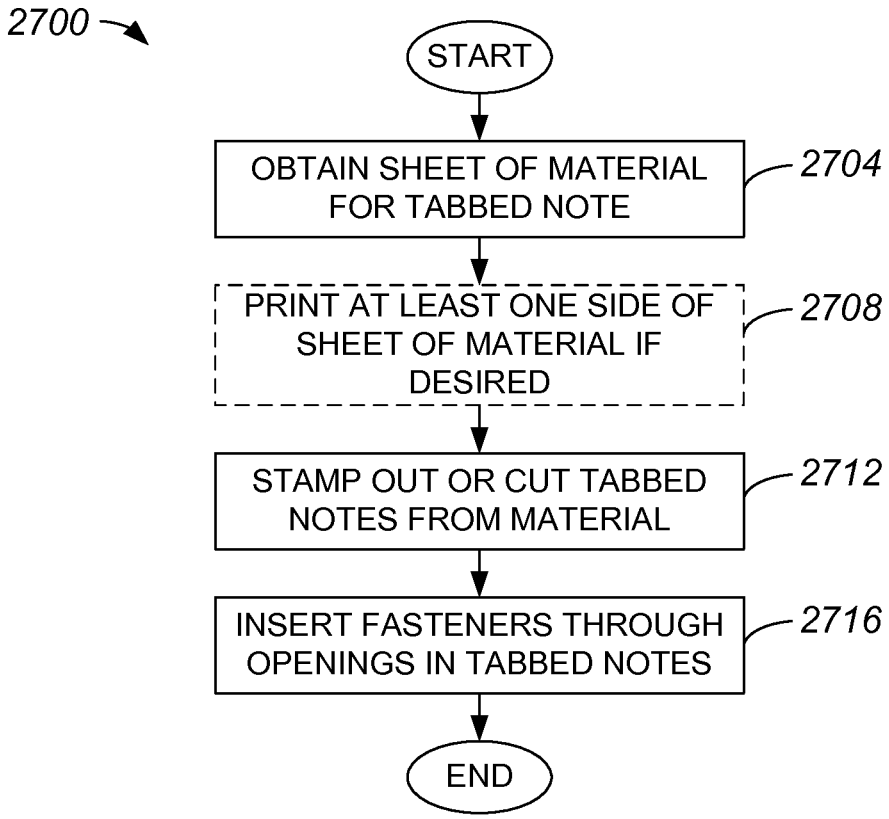
FIG. 27 is a process flow diagram which illustrates one method of forming tabbed note assemblies in accordance with an embodiment of the present invention.
Figure 28A:
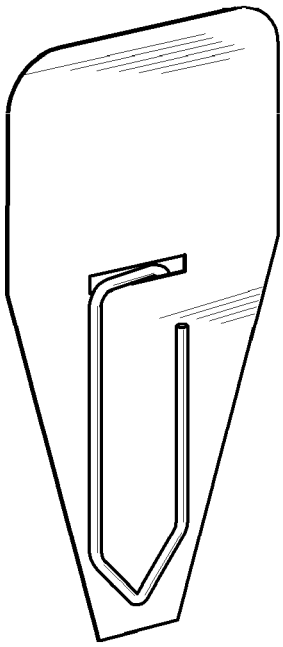
FIGS. 28A to 28E show an additional embodiment of the invention.
Figure 28B:
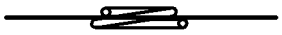
Figure 28C:
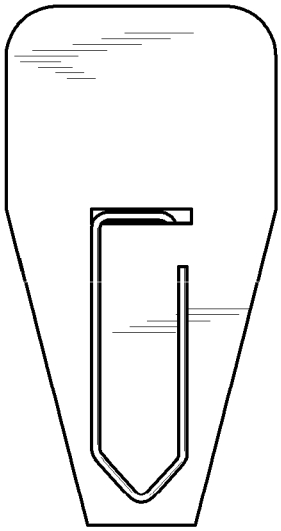
Figure 28D:
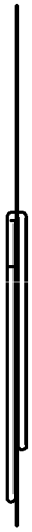
Figure 28E:
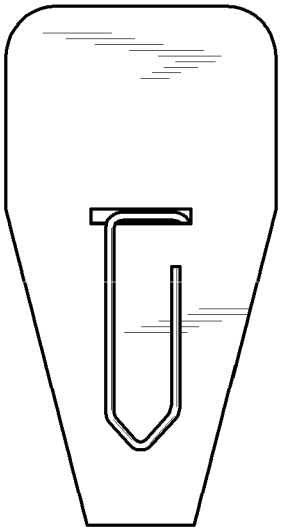
Figure 29A:
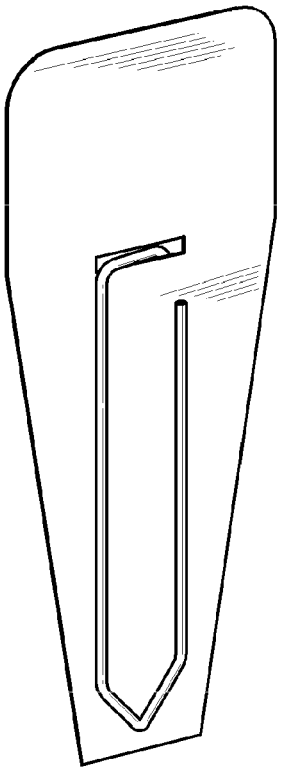
FIGS. 29A to 29E show an additional embodiment of the invention.
Figure 29E:
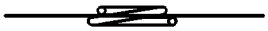
Figure 29B:
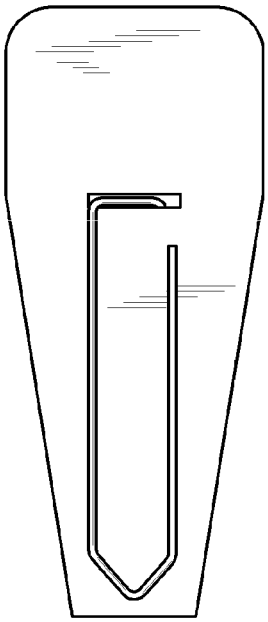
Figure 29C:
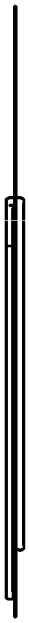
Figure 29D:
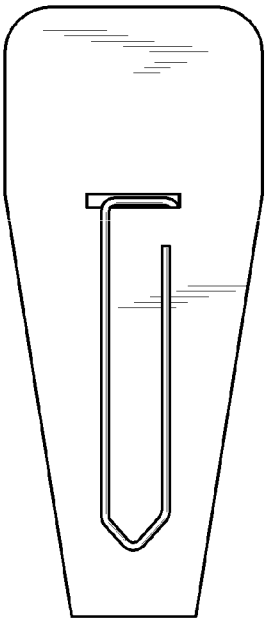
Figure 30A:
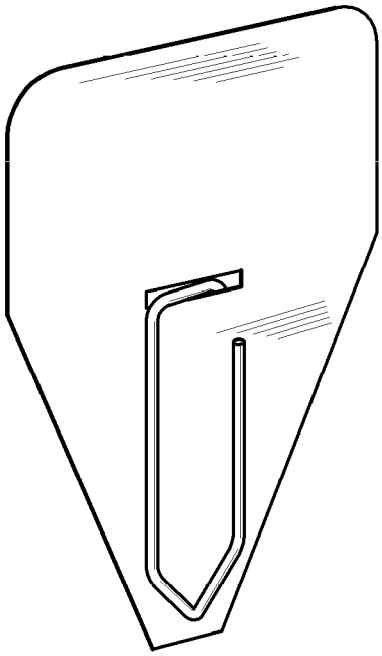
FIGS. 30A to 30E show an additional embodiment of the invention.
Figure 30E:
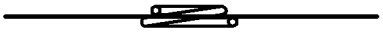
Figure 30B:
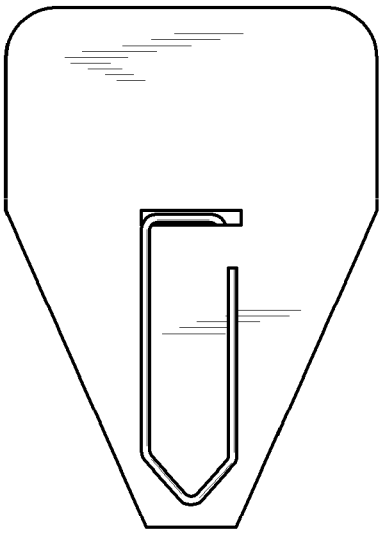
Figure 30C:
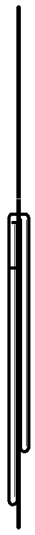
Figure 30D:
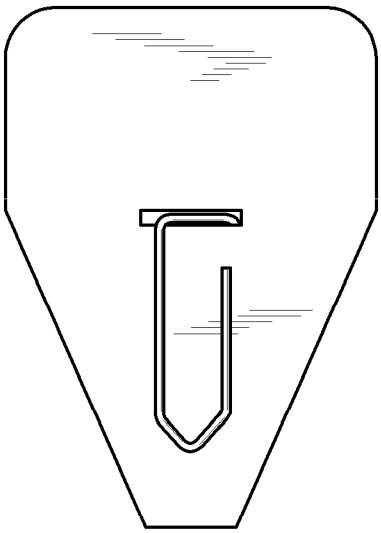
Figure 31A:
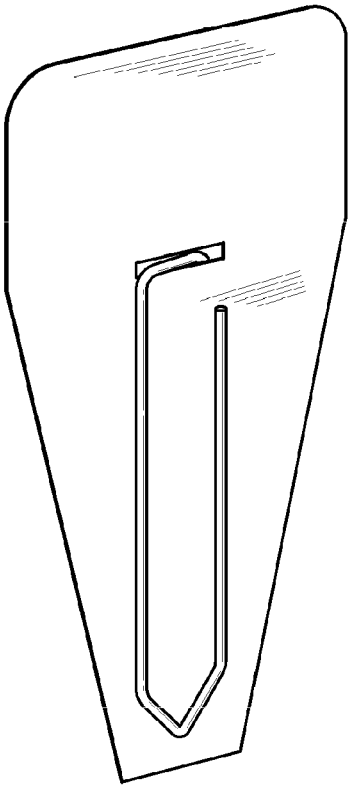
FIGS. 31A to 31E show an additional embodiment of the invention.
Figure 31E:
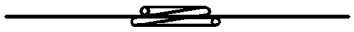
Figure 31B:
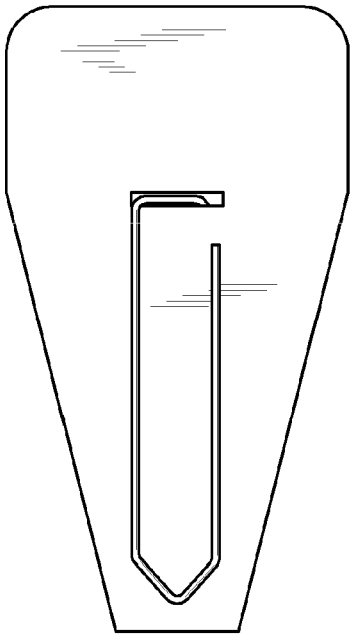
Figure 31C:
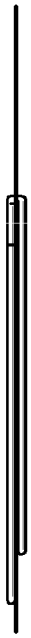
Figure 31D:
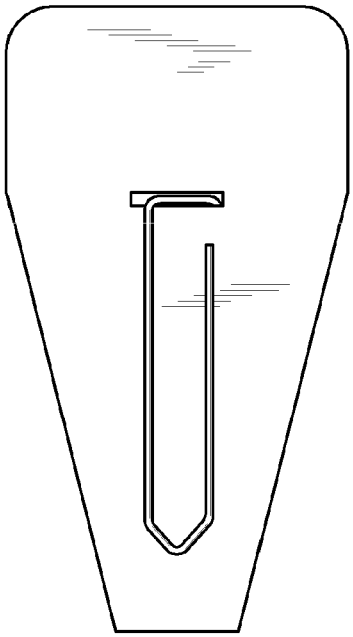
Figure 32A:
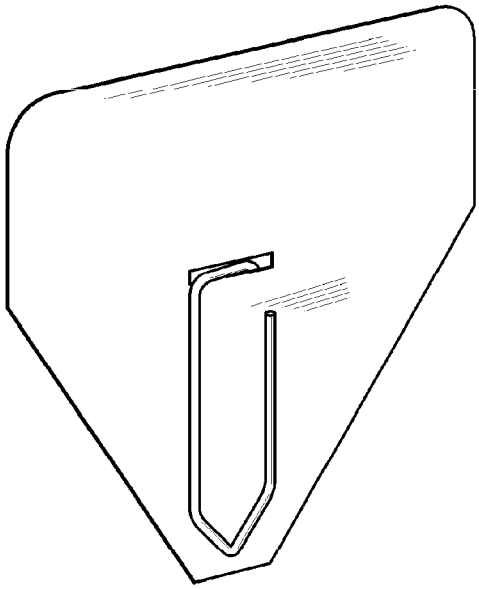
FIGS. 32A to 32E show an additional embodiment of the invention.
Figure 32E:
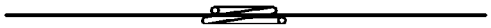
Figure 32B:
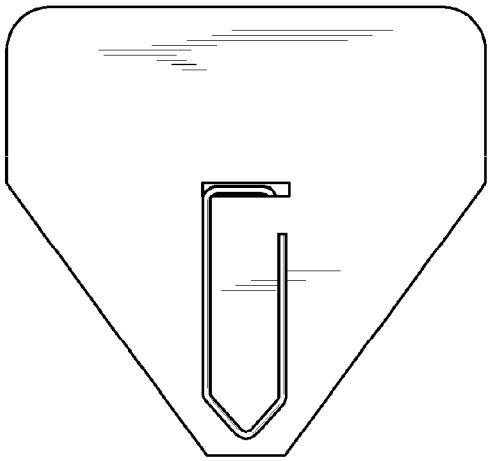
Figure 32C:
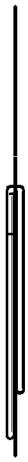
Figure 32D:
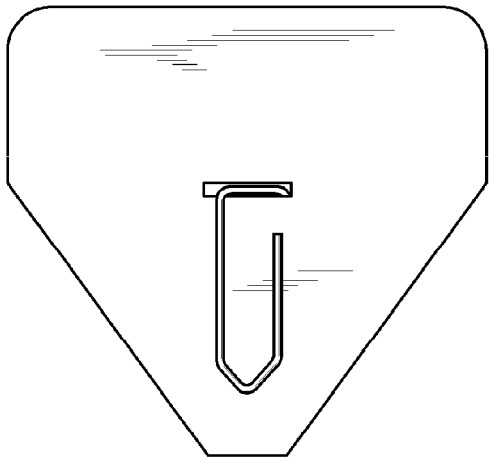
Figure 33A:
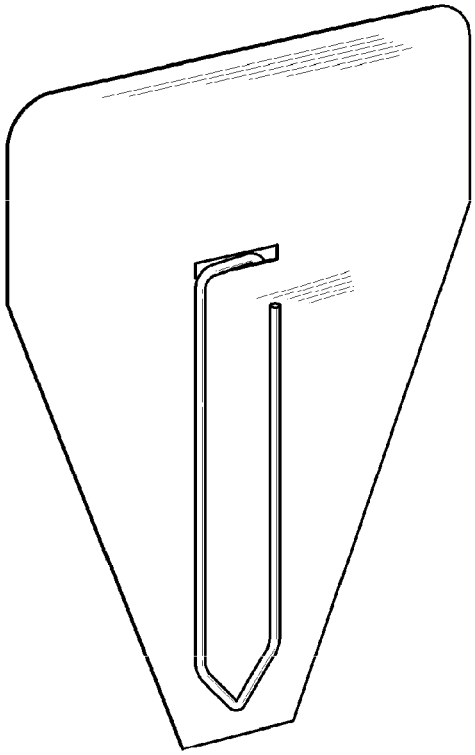
FIGS. 33A to 33E show an additional embodiment of the invention.
Figure 33E:
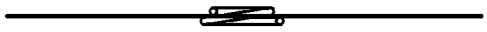
Figure 33B:
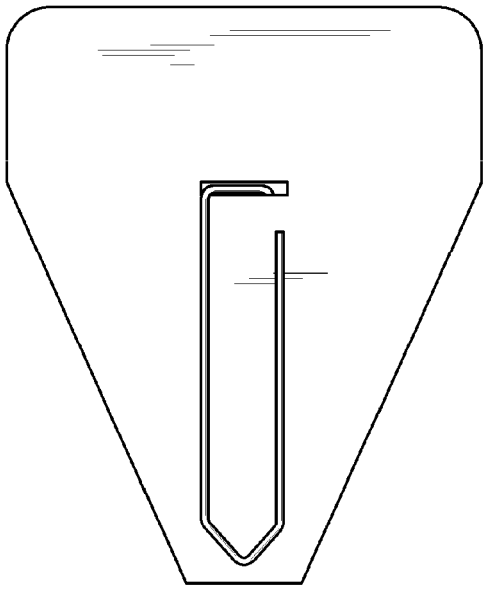
Figure 33C:
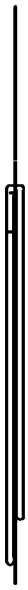
Figure 33D:
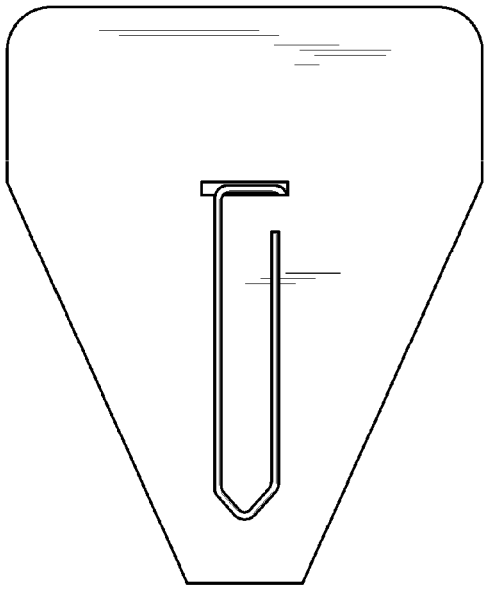

Referring next to FIG. 27, one method of creating tabbed note assemblies starting with a sheet of material will be described in accordance with an embodiment of the present invention. A process 2700 of forming tabbed note assemblies begins at step 2704 in which a sheet of material is obtained. In one embodiment, at least one side of the sheet of material is printed or dyed if desired in step 2708. It should be appreciated that step 2708 is an optional step, as the obtained sheet of material may already be printed or dyed, or the sheet of material may not require coloration.

In a further specific embodiment, the material is dyed first. Then the material is printed on. There dyed material may be printed on multiple times. Using such an approach, the tabbed note assemblies may have multiple colors in any desired scheme. For example, the material may be dyed blue (such as baby blue) and then a different shade of blue (such as Brazilian blue—see national flag of Brazil for an example) is printed at the writing portion of the tabbed note assembly. Alternatively, the material may be dyed a shade of yellow and then a different shade of yellow is printed on a portion of the tabbed note assembly above the opening.

In step 2712, tabbed notes are stamped out of or cut out of the sheet of material. A custom die may be used to cut the sheet of material. It should be appreciated that in some instances, multiple sheets of material, e.g., approximately 40 sheets of cardstock, may be cut substantially simultaneously. After the tabbed notes are stamped out of or cut of the sheet of material, fasteners may be inserted through openings in the tabbed notes to form tabbed note assemblies in step 2716, and the process of forming tabbed note assemblies is completed.

Although only a few embodiments of the present invention have been described, it should be understood that the present invention may be embodied in many other specific forms without departing from the spirit or the scope of the present invention. By way of example, the shape of a tabbed note may widely. Suitable shapes may include, but are not limited to, heart shapes, circular shapes, polygonal shapes, shapes with straight sides and rounded corners, and irregular shapes such as crescent shapes. In one embodiment, when a tabbed note is substantially only a tab, the tabbed note may be shaped as an arrow such that the tab has a triangular shape while the remainder of the tabbed note, which effectively serves to support a fastener, may have a substantially rectangular shape.

A tabbed note assembly may generally be securely affixed or coupled to a sheet that is to be tabbed. However, in some instances, at least one area of the tabbed note assembly, e.g., an area that comes into contact with the sheet that is to be tabbed, may have adhesive applied thereon. Such adhesive may be a relatively weak adhesive that allows a user to readily remove and reattach a tabbed note assembly.

The material from which a tabbed note is formed may also vary. A tabbed note may be formed from substantially any material which may be printed or written on, or any material which may be treated to allow printing or writing thereon. Suitable materials include paper products such as sheets of paper of varied thicknesses, cards, Mylar products, and vellum products. Such paper products may also be laminated, in some instances. In one embodiment, a tabbed note may be formed from a smear-proof paper product, so grease-based or other ink will not smear when rubbed by a finger or another item.

The sheets to which a tabbed note assembly may be fastened have generally been described as being sheets of paper. The sheets, however, are not limited to being sheets of paper and may be sheets formed from substantially any suitable type of material. For instance, sheets may be formed from Mylar, vellum, plastic, cloth, aluminum, cardboard, or card stock.

Further, tabbed note assemblies are not limited to being fastened to sheets of any type. In one embodiment, tabbed note assemblies may be fastened to substantially any object on which a tab may be desired. Objects may generally be any items to which a fastener may be attached, e.g., mirrors or glass plates. That is, objects may be substantially any object with a profile that is thin enough to be encompassed by a fastener. It should be appreciated that the design of the fastener used in a tabbed note assembly may vary to accommodate different objects and, hence, different widths, about which the tabbed note assembly is to be fastened.

The number of sheets to which a tabbed note assembly may be fastened may vary widely. By way of example, larger fasteners such as binder clips may generally be fastened to a thicker stack of sheets than smaller fasteners such as paper clips. However, smaller fasteners such as paper clips may be used to tab relatively thick stacks of sheets when the smaller fastener is fastened to one sheet of a stack of sheets, while a separate fastener is used to hold the stack of sheets together. In other words, while tabbed note assemblies with larger fasteners may hold and tab relatively thick stacks of sheets, tabbed note assemblies with smaller fasteners may be used to tab relatively thick stacks of sheets when separate fasteners are used to actually hold the relatively thick stacks of sheets.

Fasteners used in tabbed note assemblies that are paper clips have generally been shown as being disposed such that a small loop of a paper clip is positioned in contact with a front side of a tabbed note, while a large loop of a paper clip is positioned in contact with a back side of a tabbed note. It should be appreciated that the large loop of a paper clip, or a large clamping leg arrangement, may instead be positioned in contact with a front side of a tabbed note while a small loop, or a small clamping leg arrangement, is positioned in contact with the back side of the tabbed note. Additionally, the side of the tabbed note which comes into contact with a sheet to which it is fastened may vary. In other words, both sides of a tabbed note may be used as a front side of the tabbed note without departing from the spirit or the scope of the present invention.

While fasteners used in a tabbed note assembly have been described as being gem paper clips, perfected gem or perfect paper clips, and binder clips, any suitable fasteners may generally be included in a tabbed note assembly. Other suitable fasteners include, but are not limited to, spiral paper clips, owl paper clips, ideal paper clips, universal paper clips, and bobby-pin-type clip. It should be appreciated that fasteners may be formed from a variety of different methods. The methods include, but are not limited to, injection molding, metal stamping, and metal or wire bending.

A fastener that is used as a part of a tabbed note assembly may be reusable. For example, tabbed notes may be provided either without fasteners or separately from fasteners such that a user may simply obtain more tabbed notes for use as needed. A user may simply insert a fastener into a tabbed note when a new or clean tabbed note is needed. When the user no longer needs a used tabbed note, the user may extricate the fastener from the used tabbed node, and discard the tabbed note. Providing tabbed notes without fasteners allows a user to effectively recycle fasteners.

Openings within a tabbed note may be reinforced to prevent tearing of the tabbed note. By way of example, reinforcement tape or laminate may be applied around openings to strengthen the areas around openings. The shape of openings through which fasteners are inserted may also be varied to provide strength, or simply for variety. For instance, an opening may be shaped as an oval to substantially eliminate corners, thereby reducing the likelihood of tearing. Similarly, any edges of a tabbed note may be reinforced to provide strength. A seam or a border between a tab and a note of a tabbed note may also be reinforced. In addition, a tab may be reinforced to provide strength to the tab, as the tab is generally exposed and may be subject to bending.

Further, the position of an opening within a tabbed note may vary widely. In one embodiment, an opening may be oriented such that substantially all of the opening is below a tab portion of a tabbed note. However, the opening may also be positioned such that the opening is only partially in a note portion of a tabbed note, or not in the note portion at all without departing from the spirit or the scope of the present invention.

An opening in a tabbed note is typically created before a fastener is inserted through the opening using a process such as a cutting process, a punching process, or a stamping process. In other words, a fastener typically does not create an opening in a tabbed note. However, in some instances, a fastener may be used to at least partially create the opening. By way of example, perforations that define an opening may be present in a tabbed note, but the opening may not actually be created until a fastener is used to effectively punch out the area defined by the perforations.

Figure 17D:
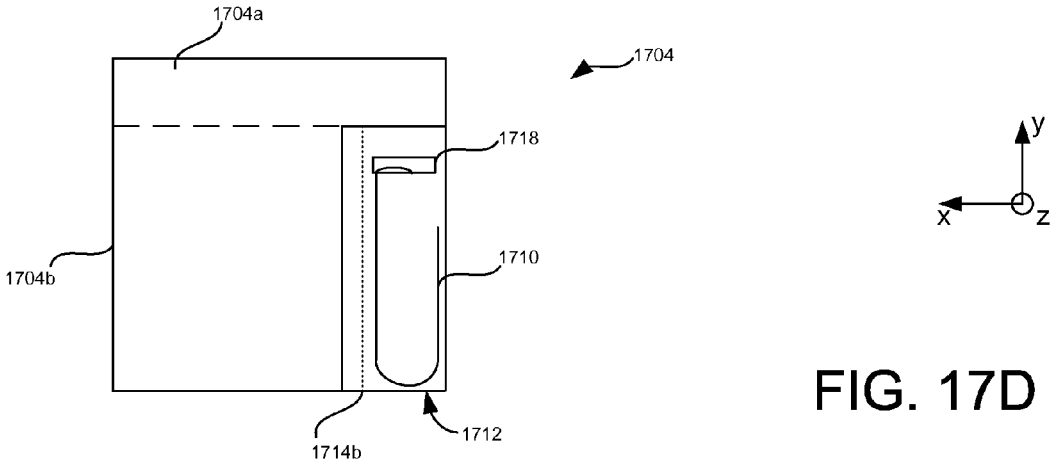
FIG. 17D is a diagrammatic representation of a back side of a third tabbed note, i.e., tabbed note 1704 of FIG. 17A, with a pocket portion, i.e., pocket portion 1712 of FIG. 17B, that defines an opening through which a fastener is at least partially inserted in accordance with an embodiment of the present invention.

Tabbed notes which include pockets have generally been described as being formed using an adhesive, tape, or a mechanical coupler. While pockets have generally been described as having two open ends, it should be appreciated that pockets may have fewer open ends. For instance, although a pocket such as pocket 1512 of FIG. 15D has effectively been described as having a top opening and a bottom opening, a pocket may instead have only one opening through which a fastener may be at least partially inserted. Alternatively, all edges of a pocket such as pocket 1712 of FIG. 17D may be substantially sealed when the pocket includes an opening such as opening 1718 through which a fastener may be at least partially inserted.

Tabbed notes, e.g., paper or plastic from which tabbed notes are formed, may come in a wide array of colors. By way of example, a user may select to use a red tabbed note for urgent matters and a green tabbed note for less urgent matters. A kit which contains tabbed notes may supply tabbed notes in colors including, but not limited to, blue, yellow, pink, purple, brown, cream, gold, silver, green, red, black, white, orange, and gray. The tabbed note may include a combination of two or more different colors, or same color but different shade or tonality. In one embodiment, a tabbed note that is formed from plastic may be substantially clear. Tabbed notes may also have a wide variety of thicknesses. Thicker sheets will typically be stiffer than thinner sheets. Stiffer sheets will generally be more durable and may be easier to see in a stack. For example, the sheets may be 18-pound paper, 20-pound paper, 24-pound paper, 40-pound paper, 85-pound paper, 90-pound paper, 120-pound paper, or heavier weight paper. Thicker sheets are generally associated with relatively higher cost than thinner sheets.

As described above, tabbed notes may be arranged to have one color for a tab portion and another color, or a different shade of the same color, for a note portion. It should be appreciated that a tabbed note may include any number of colors. Further, while different colors have generally been described as being printed onto a sheet, the different colors may instead be dyed or painted onto a sheet without departing from the spirit or the scope of the present invention. In one embodiment, a front side of a tabbed note may have a different color or different colors than a back side of the tabbed note.

A kit may come in any combination of components and variations of what is described in this application. For example, a kit may contain fasteners and tabbed notes of various sizes and shapes, which a user may assemble to form a tabbed note assembly. That is, a kit may include tabbed notes of different types, sizes, colors, but all being capable of being used in conjunction with a fastener that is also provided in the kit.

Using a tabbed note assembly, in addition to allowing at least one sheet of paper or the like to be tabbed, substantially prevents a fastener from leaving marks on the front of the sheet it is being attached to. Typical fasteners, e.g., paper clips, are made from iron which oxidizes readily. Hence, these fasteners sometimes leave unsightly marks such as rust residue or other discoloring, on sheets they come in contact with. A tabbed note assembly prevents a fastener from coming into contact with a front of a sheet to which the tabbed note assembly is coupled, thereby preventing the fastener from leaving marks on the front of the sheet.

Tabbed note assemblies, or tabbed notes alone, may be dispensed through a dispenser that is arranged to hold the tabbed note assemblies or tabbed notes alone. A dispenser may effectively be a box that allows a top tabbed note assembly in a pile of tabbed note assemblies to be removed for use. Alternatively, a dispenser may include mechanisms which facilitate the dispensing of tabbed note assemblies. By way of example, may include a mechanism that holds a first tabbed note assembly above a stack of assemblies such that the first tabbed note assembly may be readily removed for use. Once the first tabbed note assembly is removed, the mechanism may substantially "grab" another tabbed note assembly from the stack of tabbed note assemblies and hold that tabbed note assembly above the stack of tabbed note assemblies. In one embodiment, when tabbed notes are dispensed alone in the dispenser, the dispenser may include a separate compartment or holder for holding fasteners.

An overall tabbed note assembly is generally reusable because the construction of the tabbed note assembly is durable. The tabbed note assembly is durable enough so that it may be used many times before it is too worn to be used again. Also, the tabbed note assembly is double-sided, so that the tabbed note assembly may be used again after the first side has been used. A user simply needs to turn the tabbed note assembly around to use it again.

Further, a user may simply erase writing from any tabbed note assembly to render the tabbed note assembly reusable. Moreover, additional or replacement tabbed notes may be provided by way of multiple pages. These multiple pages may be a stack of paper pages in the writing portion of the tabbed note assembly. Such a tabbed note assembly may be considered to be reusable because the writing portion of the tabbed note assembly may effectively be replenished.

In one embodiment, a pad of Post-it™-like notes may be attached to a writing or note portion of a tabbed note assembly to enable notes to be repeatedly written and discarded. Therefore, the present examples are to be considered as illustrative and not restrictive, and the invention is not to be limited to the details given herein, but may be modified within the scope of the appended claims.

Figure 40A:
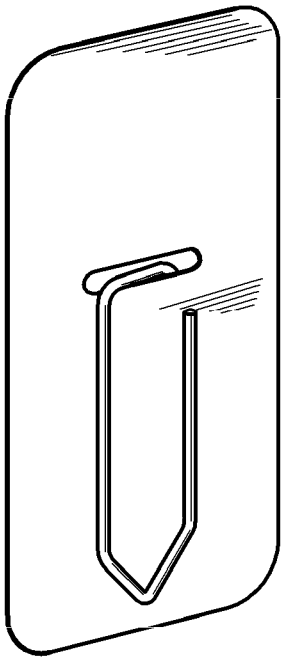
FIGS. 40A to 40E show an additional embodiment of the invention.
Figure 40E:
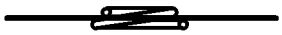
Figure 40B:
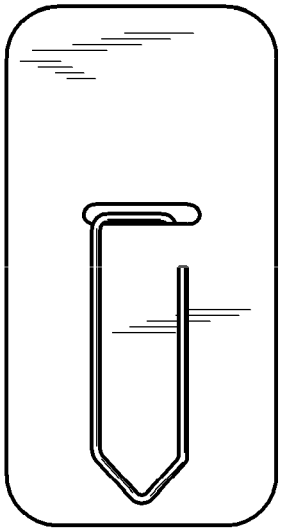
Figure 40C:
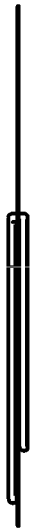
Figure 40D:
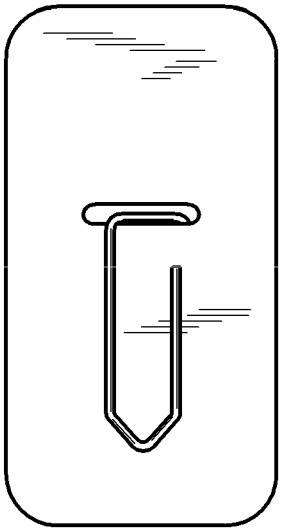
Figure 41A:
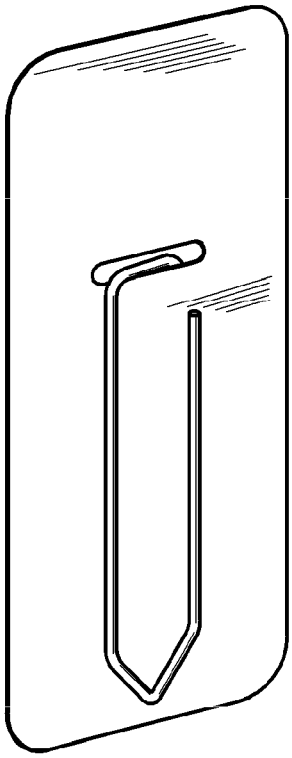
FIGS. 41A to 41E show an additional embodiment of the invention.
Figure 41E:
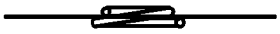
Figure 41B:
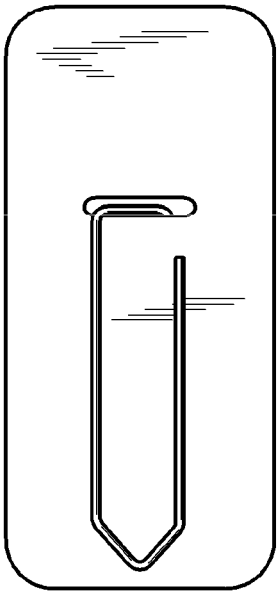
Figure 41C:
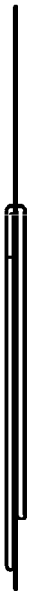
Figure 41D:
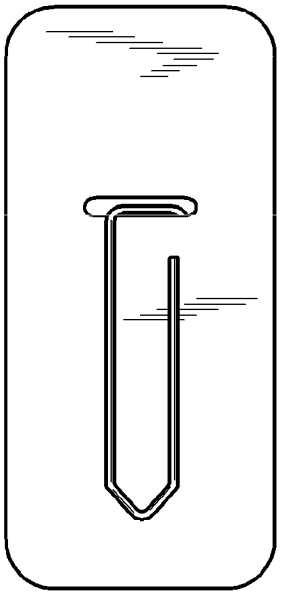
Figure 42A:
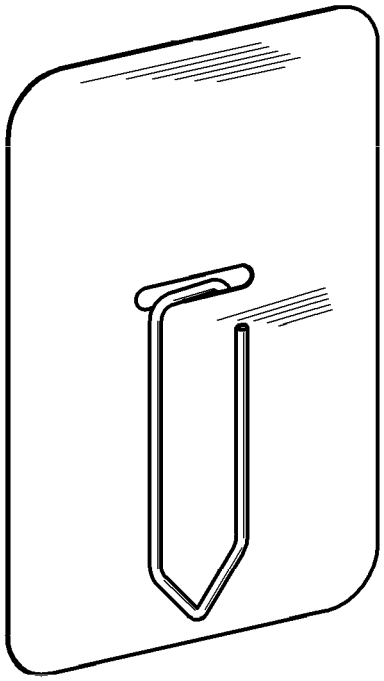
FIGS. 42A to 42E show an additional embodiment of the invention.
Figure 42E:
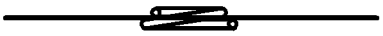
Figure 42B:
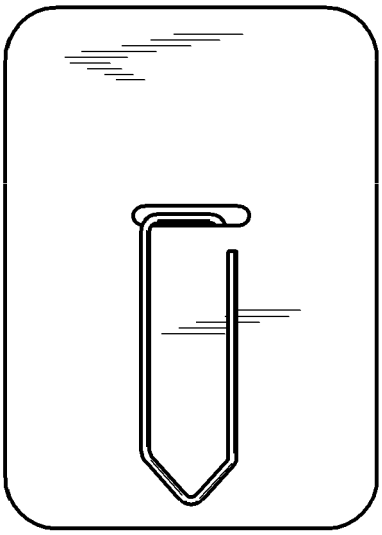
Figure 42C:
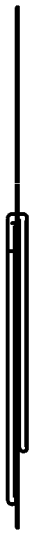
Figure 42D:
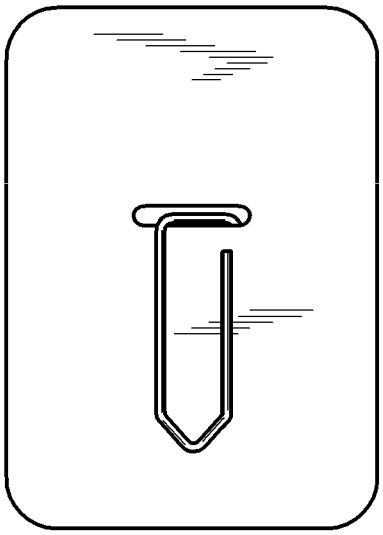
Figure 43A:
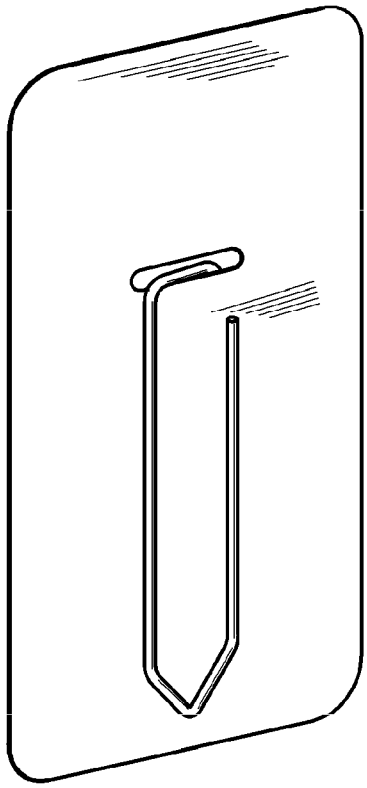
FIGS. 43A to 43E show an additional embodiment of the invention.
Figure 43E:
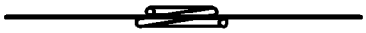
Figure 43B:
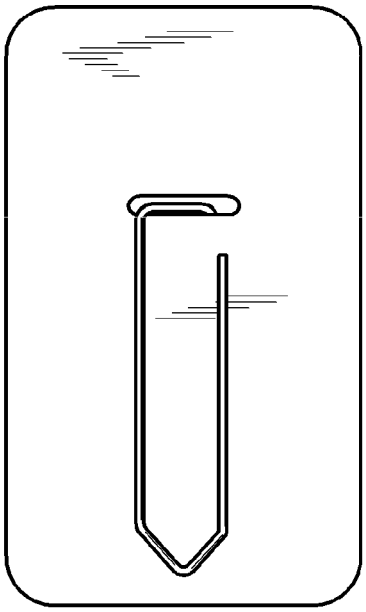
Figure 43C:
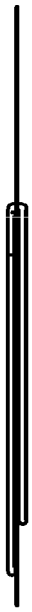
Figure 43D:
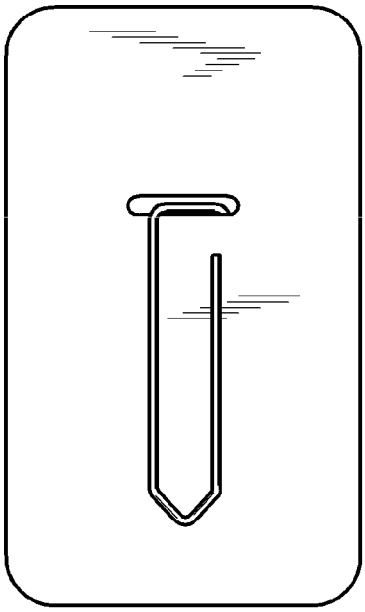
Figure 44A:
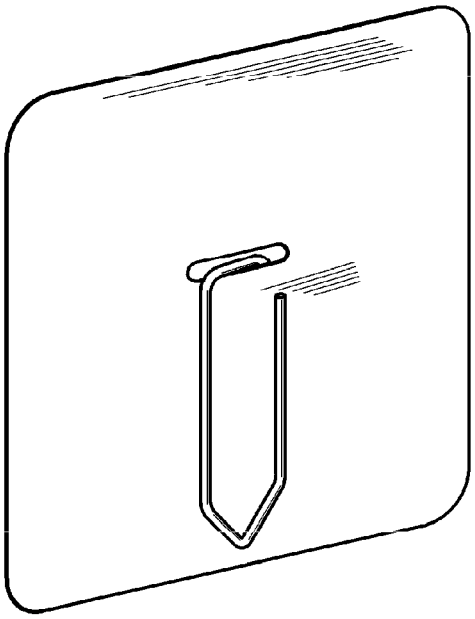
FIGS. 44A to 44E show an additional embodiment of the invention.
Figure 44E:
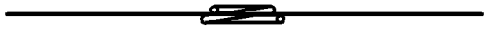
Figure 44B:
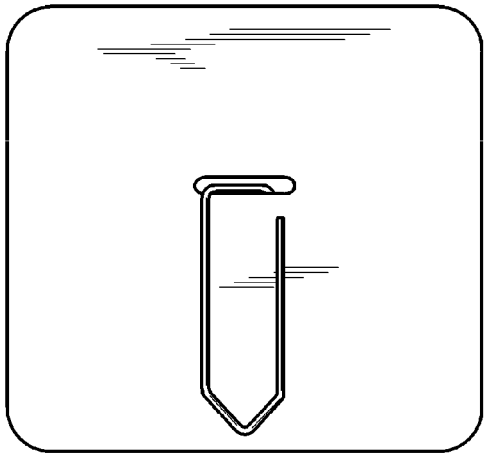
Figure 44C:
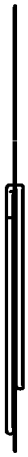
Figure 44D:
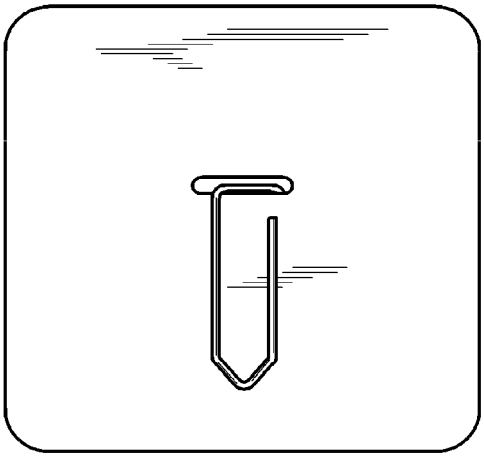
Figure 45A:
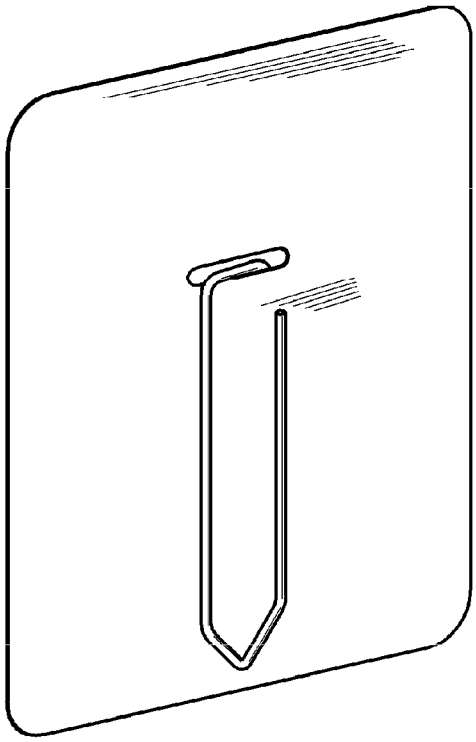
FIGS. 45A to 45E show an additional embodiment of the invention.
Figure 45E:
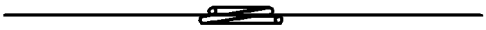
Figure 45B:
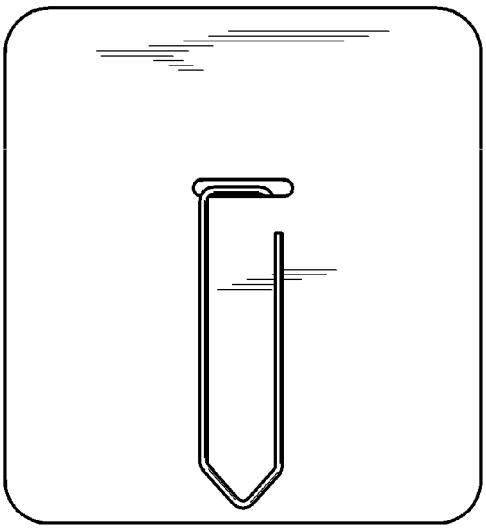
Figure 45C:
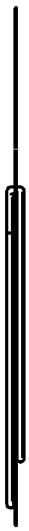
Figure 45D:
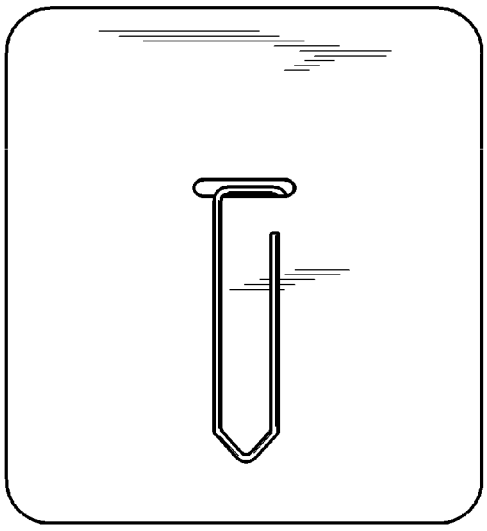
Figure 46A:
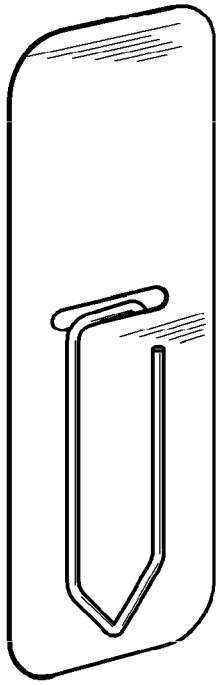
FIGS. 46A to 46E show an additional embodiment of the invention.
Figure 46E:
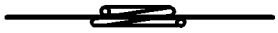
Figure 46B:
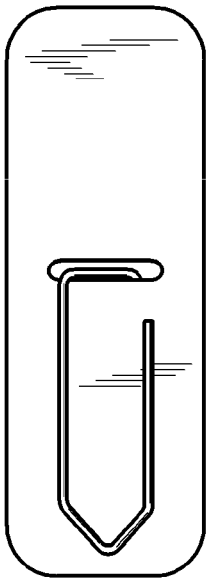
Figure 46C:
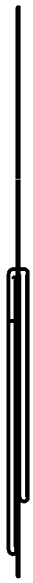
Figure 46D:
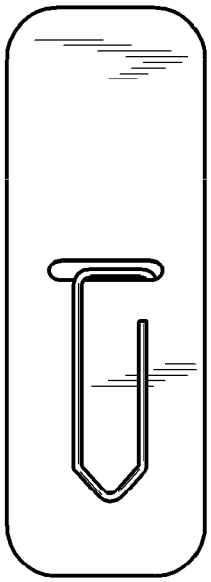
Figure 47A:
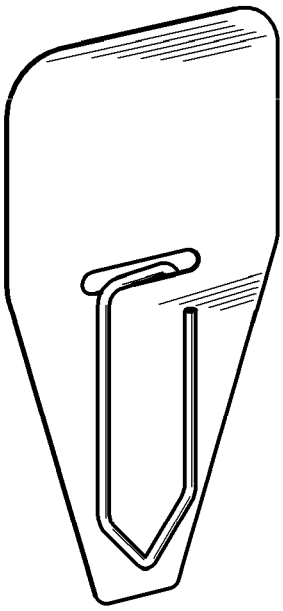
FIGS. 47A to 47E show an additional embodiment of the invention.
Figure 47E:
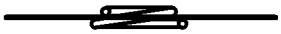
Figure 47B:
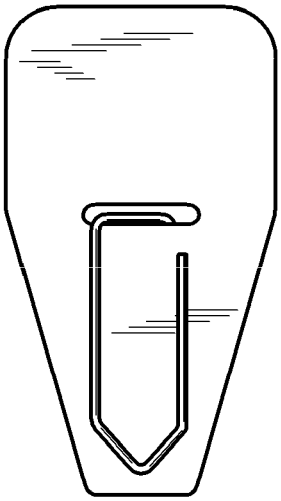
Figure 47C:
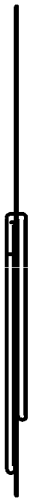
Figure 47D:
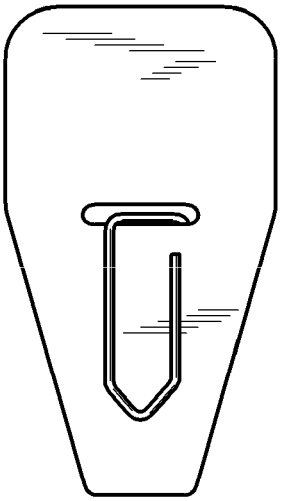
Figure 48A:
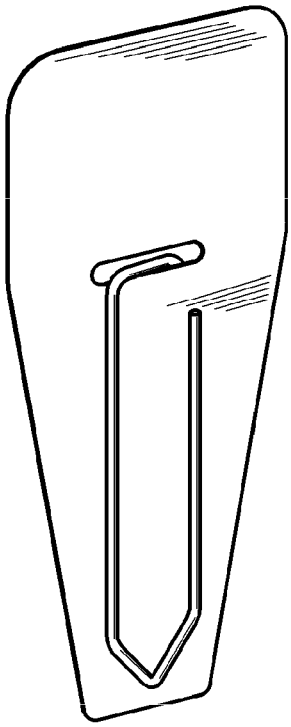
FIGS. 48A to 48E show an additional embodiment of the invention.
Figure 48E:
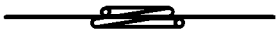
Figure 48B:
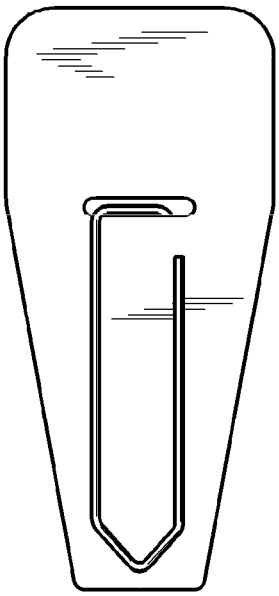
Figure 48C:
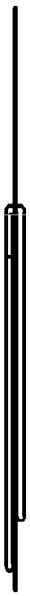
Figure 48D:
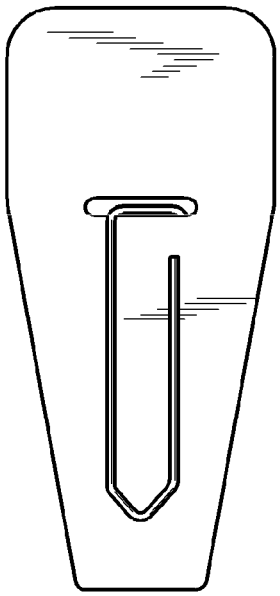
Figure 49A:
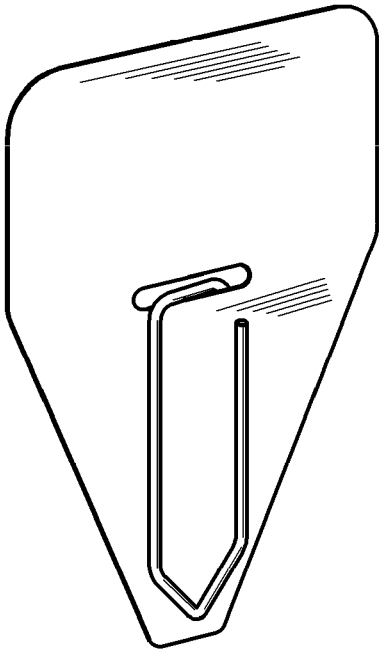
FIGS. 49A to 49E show an additional embodiment of the invention.
Figure 49E:
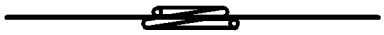
Figure 49B:
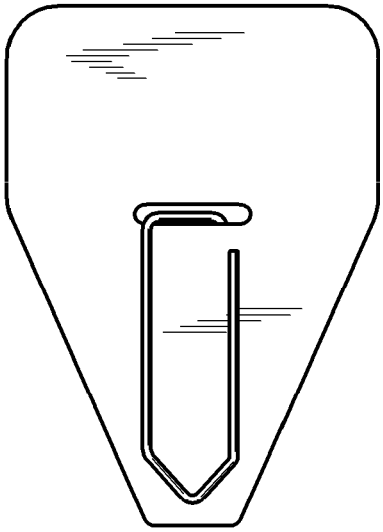
Figure 49C:
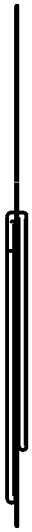
Figure 49D:
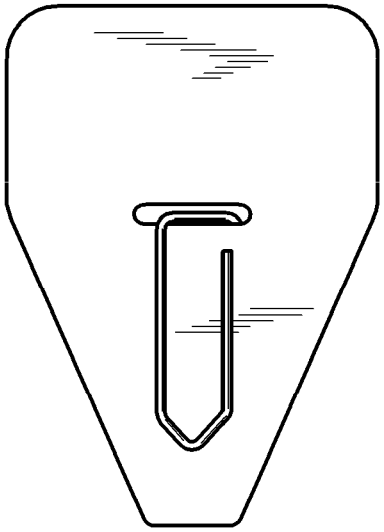
Figure 50A:
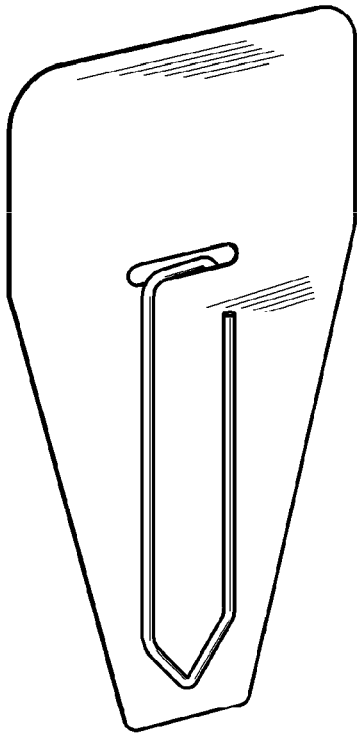
FIGS. 50A to 50E show an additional embodiment of the invention.
Figure 50E:
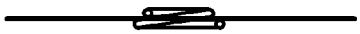
Figure 50B:
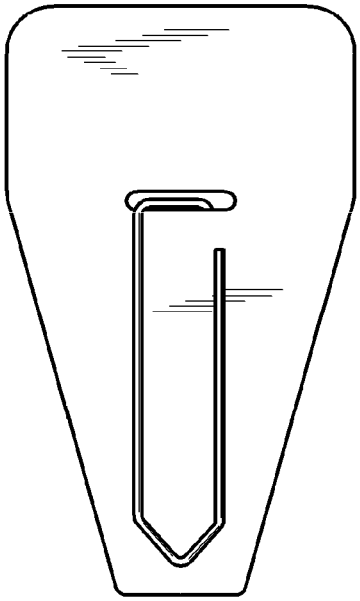
Figure 50C:
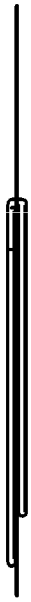
Figure 50D:
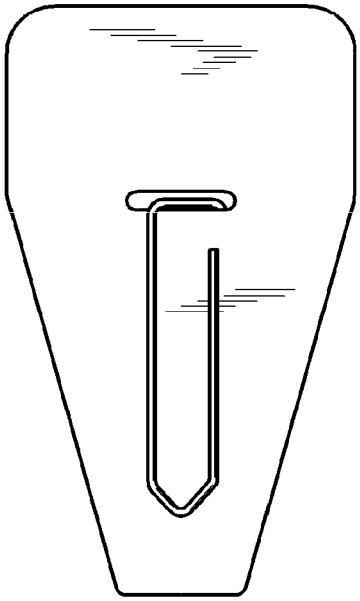
Figure 51A:
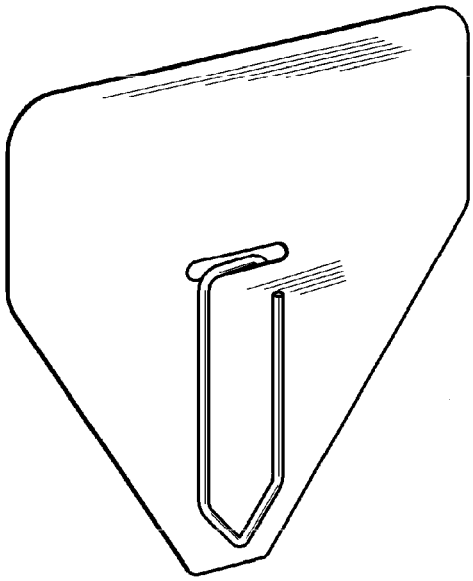
FIGS. 51A to 51E show an additional embodiment of the invention.
Figure 51E:
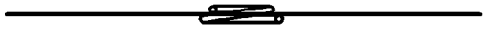
Figure 51B:
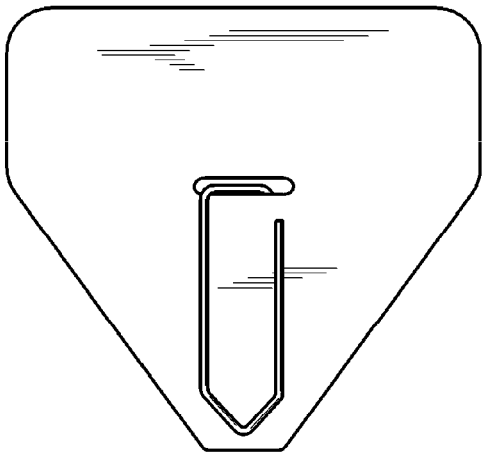
Figure 51C:
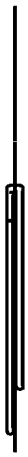
Figure 51D:
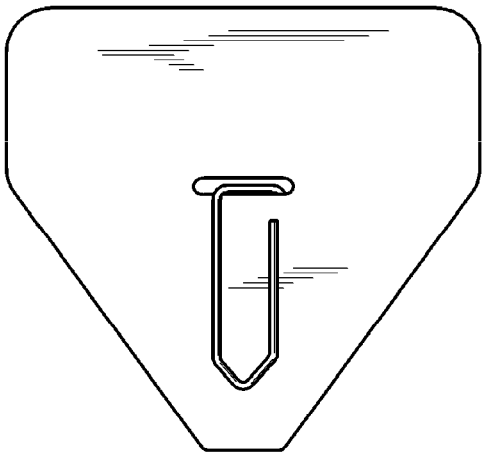
Figure 52A:
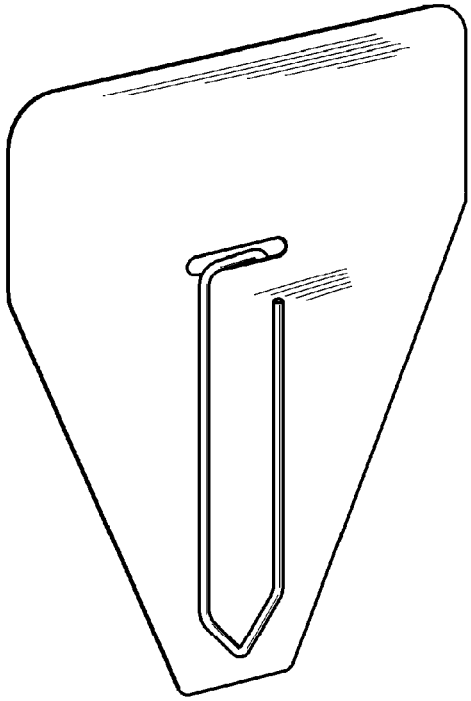
FIGS. 52A to 52E show an additional embodiment of the invention.
Figure 52E:
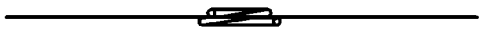
Figure 52B:
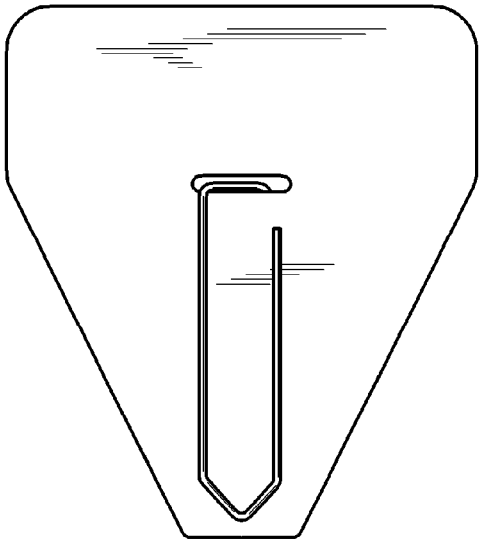
Figure 52C:
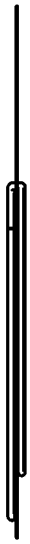
Figure 52D:
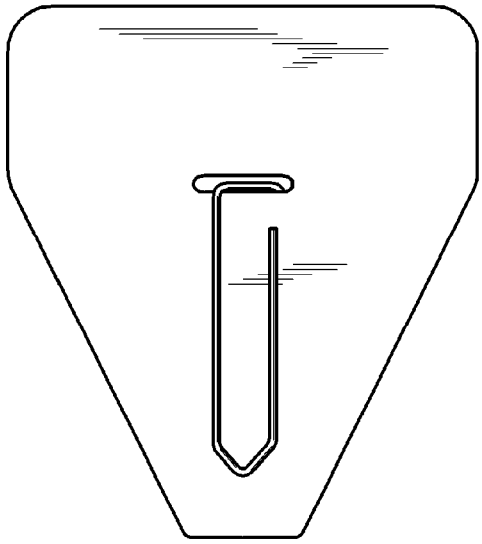
Figure 59A:
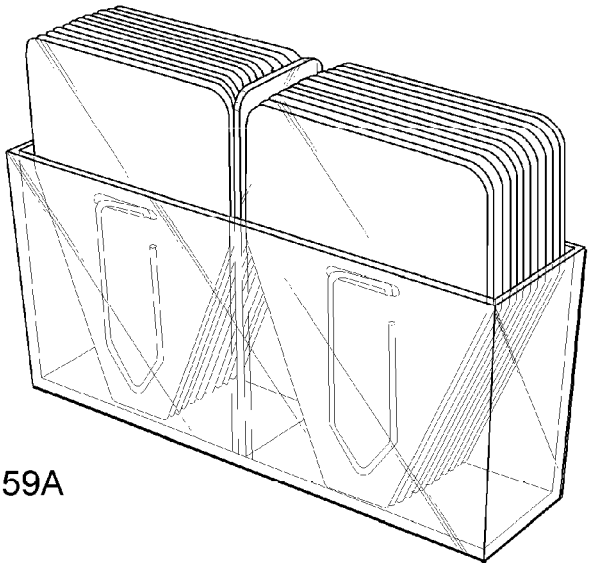
Figure 59B:
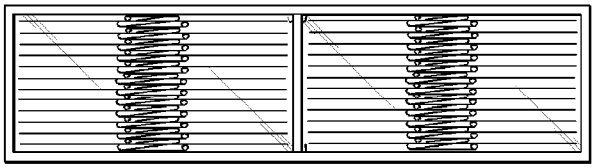
Figure 59C:
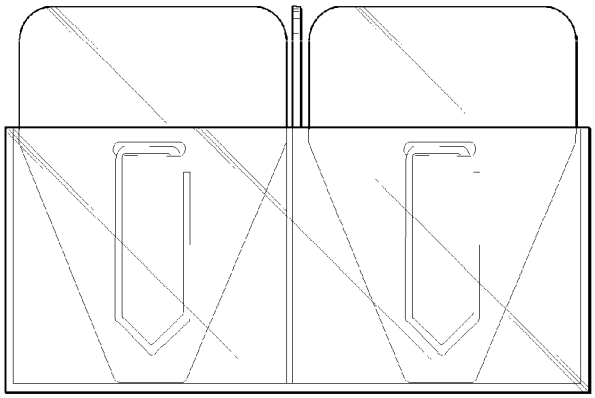
Figure 59D:
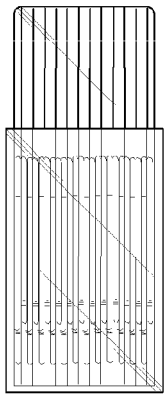

The tables below provide dimensions, areas, and ratios for various embodiments of the invention. The top part refers to the tab portion or portion above the opening of a note. This portion may be defined by a straight line drawn across the note, where the straight line touches a top edge of the opening. The bottom part is the portion below the opening or below the straight line. The values provided below are in centimeters. The areas are provided in square centimeters. There is table A and table B. Table A is for the V-shape design (see for example, FIG. 47A), which is a design where the side edges of the bottom portion are tapered. Table B is for a T-shape design (see for example, FIG. 4F). Table C is for a block design (see for example, FIG. 40A). Various implementations for each are provided.

TABLE A

| | V-SHAPE DESIGN | | | | | | |
|---|---|---|---|---|---|---|---|
| | TOP PART | | | BOTTOM PART | | | RATIO OF TOP TO BOTTOM Area 1/Area 2 |
| | Width 1 | Height 1 | Area 1 | Width 2 | Height 2 | Area 2 | ($cm^2$) |
| Dimension: Product as is where height 1 and height 2 is as shown below (regular paper clip size) | | | | | | | |
| Extra Small | 1.5 | 2.2 | 3.3 | 1.25 | 3.5 | 4.4 | 0.75 |
| Small | 3.2 | 2.2 | 7.0 | 2.15 | 3.5 | 7.5 | 0.94 |
| Medium | 4.1 | 2.2 | 9.0 | 2.6 | 3.6 | 9.4 | 0.96 |
| Large | 6 | 2.2 | 13.2 | 3.55 | 3.6 | 12.8 | 1.03 |
| X-Large | 8 | 2.2 | 17.6 | 4.55 | 3.6 | 16.4 | 1.07 |
| Dimension: Product as is where height 1 and height 2 is as shown below (large paper clip size) | | | | | | | |
| Extra Small | 1.5 | 2.2 | 3.3 | 1.25 | 4.9 | 4.0 | 0.83 |
| Small | 3.2 | 2.2 | 7.0 | 2.15 | 4.9 | 10.5 | 0.67 |
| Medium | 4.1 | 2.2 | 9.0 | 2.6 | 4.9 | 12.7 | 0.71 |
| Large | 6 | 2.2 | 13.2 | 3.55 | 4.9 | 17.4 | 0.76 |
| X-Large | 8 | 2.2 | 17.6 | 4.55 | 4.9 | 22.3 | 0.79 |
| Dimension: Height 1 low with height 2 low | | | | | | | |
| Extra Small | 1.5 | 1.5 | 2.3 | 1.25 | 3 | 3.8 | 0.60 |
| Small | 3.2 | 1.5 | 4.8 | 2.15 | 3 | 6.5 | 0.74 |
| Medium | 4.1 | 1.5 | 6.2 | 2.6 | 3 | 7.8 | 0.79 |
| Large | 6 | 1.5 | 9.0 | 3.55 | 3 | 10.7 | 0.85 |
| X-Large | 8 | 1.5 | 12.0 | 4.55 | 3 | 13.7 | 0.88 |
| Dimension: Height 1 low with height 2 high | | | | | | | |
| Extra Small | 1.5 | 1.5 | 2.3 | 1.25 | 5.3 | 6.6 | 0.34 |
| Small | 3.2 | 1.5 | 4.8 | 2.15 | 5.3 | 11.4 | 0.42 |
| Medium | 4.1 | 1.5 | 6.2 | 2.6 | 5.3 | 13.8 | 0.45 |

TABLE A-continued

| | V-SHAPE DESIGN | | | | | | |
|---|---|---|---|---|---|---|---|
| | TOP PART | | | BOTTOM PART | | | RATIO OF TOP TO BOTTOM Area 1/Area 2 |
| | Width 1 | Height 1 | Area 1 | Width 2 | Height 2 | Area 2 | ($cm^2$) |
| Large | 6 | 1.5 | 9.0 | 3.55 | 5.3 | 18.8 | 0.48 |
| X-Large | 8 | 1.5 | 12.0 | 4.55 | 5.3 | 24.1 | 0.50 |
| Dimension: Height 1 high with height 2 low | | | | | | | |
| Extra Small | 1.5 | 4 | 6.0 | 1.25 | 3 | 3.8 | 1.60 |
| Small | 3.2 | 4 | 12.8 | 2.15 | 3 | 6.5 | 1.98 |
| Medium | 4.1 | 4 | 16.4 | 2.6 | 3 | 7.8 | 2.10 |
| Large | 6 | 4 | 24.0 | 3.55 | 3 | 10.7 | 2.25 |
| X-Large | 8 | 4 | 32.0 | 4.55 | 3 | 13.7 | 2.34 |
| Dimension: Height 1 high with height 2 high | | | | | | | |
| Extra Small | 1.5 | 4 | 6.0 | 1.25 | 5.3 | 6.6 | 0.91 |
| Small | 3.2 | 4 | 12.8 | 2.15 | 5.3 | 11.4 | 1.12 |
| Medium | 4.1 | 4 | 16.4 | 2.6 | 5.3 | 13.8 | 1.19 |
| Large | 6 | 4 | 24.0 | 3.55 | 5.3 | 18.8 | 1.28 |
| X-Large | 8 | 4 | 32.0 | 4.55 | 5.3 | 24.1 | 1.33 |

TABLE B

| | T-DESIGN | | | | | | |
|---|---|---|---|---|---|---|---|
| | TOP PART | | | BOTTOM PART | | | RATIO OF TOP TO BOTTOM Area 1/Area 2 |
| | Width 1 | Height 1 | Area 1 | Width 2 | Height 2 | Area 2 | ($cm^2$) |
| Dimension: Product as is where height 1 and height 2 is as shown below (regular paper clip size) | | | | | | | |
| Extra Small | 1.5 | 2.2 | 3.3 | 1.5 | 3.5 | 5.3 | 0.63 |
| Small | 3.2 | 2.2 | 7.0 | 1.7 | 3.5 | 6.0 | 1.18 |
| Medium | 4.1 | 2.2 | 9.0 | 1.7 | 3.6 | 6.1 | 1.47 |
| Large | 6 | 2.2 | 13.2 | 1.7 | 3.6 | 6.1 | 2.16 |
| X-Large | 8 | 2.2 | 17.6 | 1.7 | 3.6 | 6.1 | 2.88 |
| Dimension: Product as is where height 1 and height 2 is as shown below (large paper clip size) | | | | | | | |
| Extra Small | 1.5 | 2.2 | 3.3 | 1.5 | 4.9 | 7.4 | 0.45 |
| Small | 3.2 | 2.2 | 7.0 | 1.7 | 4.9 | 8.3 | 0.85 |
| Medium | 4.1 | 2.2 | 9.0 | 1.7 | 4.9 | 8.3 | 1.08 |
| Large | 6 | 2.2 | 13.2 | 1.7 | 4.9 | 8.3 | 1.58 |
| X-Large | 8 | 2.2 | 17.6 | 1.7 | 4.9 | 8.3 | 2.11 |
| Dimension: Height 1 low with height 2 low | | | | | | | |
| Extra Small | 1.5 | 1.5 | 2.3 | 1.5 | 3 | 4.5 | 0.50 |
| Small | 3.2 | 1.5 | 4.8 | 1.7 | 3 | 5.1 | 0.94 |
| Medium | 4.1 | 1.5 | 6.2 | 1.7 | 3 | 5.1 | 1.21 |
| Large | 6 | 1.5 | 9.0 | 1.7 | 3 | 5.1 | 1.76 |
| X-Large | 8 | 1.5 | 12.0 | 1.7 | 3 | 5.1 | 2.35 |
| Dimension: Height 1 low with height 2 high | | | | | | | |
| Extra Small | 1.5 | 1.5 | 2.3 | 1.5 | 5.3 | 8.0 | 0.28 |
| Small | 3.2 | 1.5 | 4.8 | 1.7 | 5.3 | 9.0 | 0.53 |
| Medium | 4.1 | 1.5 | 6.2 | 1.7 | 5.3 | 9.0 | 0.68 |
| Large | 6 | 1.5 | 9.0 | 1.7 | 5.3 | 9.0 | 1.00 |
| X-Large | 8 | 1.5 | 12.0 | 1.7 | 5.3 | 9.0 | 1.33 |
| Dimension: Height 1 high with height 2 low | | | | | | | |
| Extra Small | 1.5 | 4 | 6.0 | 1.5 | 3 | 4.5 | 1.33 |
| Small | 3.2 | 4 | 12.8 | 1.7 | 3 | 5.1 | 2.51 |
| Medium | 4.1 | 4 | 16.4 | 1.7 | 3 | 5.1 | 3.22 |
| Large | 6 | 4 | 24.0 | 1.7 | 3 | 5.1 | 4.71 |
| X-Large | 8 | 4 | 32.0 | 1.7 | 3 | 5.1 | 6.27 |

TABLE B-continued

| | T-DESIGN | | | | | | |
|---|---|---|---|---|---|---|---|
| | TOP PART | | | BOTTOM PART | | | RATIO OF TOP TO BOTTOM Area 1/Area 2 |
| | Width 1 | Height 1 | Area 1 | Width 2 | Height 2 | Area 2 | ($cm^2$) |
| Dimension: Height 1 high with height 2 high | | | | | | | |
| Extra Small | 1.5 | 4 | 6.0 | 1.5 | 5.3 | 8.0 | 0.75 |
| Small | 3.2 | 4 | 12.8 | 1.7 | 5.3 | 9.0 | 1.42 |
| Medium | 4.1 | 4 | 16.4 | 1.7 | 5.3 | 9.0 | 1.82 |
| Large | 6 | 4 | 24.0 | 1.7 | 5.3 | 9.0 | 2.66 |
| X-Large | 8 | 4 | 32.0 | 1.7 | 5.3 | 9.0 | 3.55 |

TABLE C

| | BLOCK DESIGN | | | | | | |
|---|---|---|---|---|---|---|---|
| | TOP PART | | | BOTTOM PART | | | RATIO OF TOP TO BOTTOM Area 1/Area 2 |
| | Width 1 | Height 1 | Area 1 | Width 2 | Height 2 | Area 2 | ($cm^2$) |
| Dimension: Product as is where height 1 and height 2 is as shown below (regular paper clip size) | | | | | | | |
| Extra Small | 1.5 | 2.2 | 3.3 | 1.5 | 3.5 | 5.3 | 0.63 |
| Small | 3.2 | 2.2 | 7.0 | 3.2 | 3.5 | 11.2 | 0.63 |
| Medium | 4.1 | 2.2 | 9.0 | 4.1 | 3.6 | 14.8 | 0.61 |
| Large | 6 | 2.2 | 13.2 | 6 | 3.6 | 21.6 | 0.61 |
| X-Large | 8 | 2.2 | 17.6 | 8 | 3.6 | 28.8 | 0.61 |
| Dimension: Height 1 low with height 2 low | | | | | | | |
| Extra Small | 1.5 | 1.5 | 2.3 | 1.5 | 3 | 4.5 | 0.50 |
| Small | 3.2 | 1.5 | 4.8 | 3.2 | 3 | 9.6 | 0.50 |
| Medium | 4.1 | 1.5 | 6.2 | 4.1 | 3 | 12.3 | 0.50 |
| Large | 6 | 1.5 | 9.0 | 6 | 3 | 18.0 | 0.50 |
| X-Large | 8 | 1.5 | 12.0 | 8 | 3 | 24.0 | 0.50 |
| Dimension: Height 1 low with height 2 high | | | | | | | |
| Extra Small | 1.5 | 1.5 | 2.3 | 1.5 | 5.3 | 8.0 | 0.28 |
| Small | 3.2 | 1.5 | 4.8 | 3.2 | 5.3 | 17.0 | 0.28 |
| Medium | 4.1 | 1.5 | 6.2 | 4.1 | 5.3 | 21.7 | 0.28 |
| Large | 6 | 1.5 | 9.0 | 6 | 5.3 | 31.8 | 0.28 |
| X-Large | 8 | 1.5 | 12.0 | 8 | 5.3 | 42.4 | 0.28 |
| Dimension: Height 1 high with height 2 low | | | | | | | |
| Extra Small | 1.5 | 4 | 6.0 | 1.5 | 3 | 4.5 | 1.33 |
| Small | 3.2 | 4 | 12.8 | 3.2 | 3 | 9.6 | 1.33 |
| Medium | 4.1 | 4 | 16.4 | 4.1 | 3 | 12.3 | 1.33 |
| Large | 6 | 4 | 24.0 | 6 | 3 | 18.0 | 1.33 |
| X-Large | 8 | 4 | 32.0 | 8 | 3 | 24.0 | 1.33 |
| Dimension: Height 1 high with height 2 high | | | | | | | |
| Extra Small | 1.5 | 4 | 6.0 | 1.5 | 5.3 | 8.0 | 0.75 |
| Small | 3.2 | 4 | 12.8 | 3.2 | 5.3 | 17.0 | 0.75 |
| Medium | 4.1 | 4 | 16.4 | 4.1 | 5.3 | 21.7 | 0.75 |
| Large | 6 | 4 | 24.0 | 6 | 5.3 | 31.8 | 0.75 |
| X-Large | 8 | 4 | 32.0 | 8 | 5.3 | 42.4 | 0.75 |

FIGS. 28A to 28E show an additional embodiment of the invention.

FIGS. 29A to 29E show an additional embodiment of the invention.

FIGS. 30A to 30E show an additional embodiment of the invention.

FIGS. 31A to 31E show an additional embodiment of the invention.

FIGS. 32A to 32E show an additional embodiment of the invention.

FIGS. 33A to 33E show an additional embodiment of the invention.

FIGS. 34A to 34D show an additional embodiment of the invention.

FIGS. 35A to 35D show an additional embodiment of the invention.

FIGS. 36A to 36D show an additional embodiment of the invention.

FIGS. 37A to 37D show an additional embodiment of the invention.

FIGS. 38A to 38D show an additional embodiment of the invention.

FIGS. 39A to 39D show an additional embodiment of the invention.

FIGS. 40A to 40E show an additional embodiment of the invention.

FIGS. 41A to 41E show an additional embodiment of the invention.

FIGS. 42A to 42E show an additional embodiment of the invention.

FIGS. 43A to 43E show an additional embodiment of the invention.

FIGS. 44A to 44E show an additional embodiment of the invention.

FIGS. 45A to 45E show an additional embodiment of the invention.

FIGS. 46A to 46E show an additional embodiment of the invention.

FIGS. 47A to 47E show an additional embodiment of the invention.

FIGS. 48A to 48E show an additional embodiment of the invention.

FIGS. 49A to 49E show an additional embodiment of the invention.

FIGS. 50A to 50E show an additional embodiment of the invention.

FIGS. 51A to 51E show an additional embodiment of the invention.

FIGS. 52A to 52E show an additional embodiment of the invention.

FIGS. 53A to 53D show an additional embodiment of the invention.

FIGS. 54A to 53D show an additional embodiment of the invention.

FIGS. 55A to 55D show an additional embodiment of the invention.

FIGS. 56A to 56D show an additional embodiment of the invention.

FIGS. 57A to 57D show an additional embodiment of the invention.

FIGS. 58A to 58D show an additional embodiment of the invention.

FIGS. 59A to 59D show an additional embodiment of the invention.

Figure 60A:
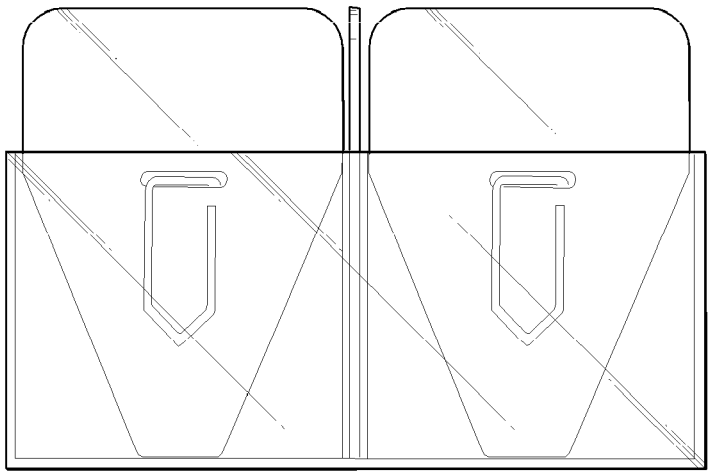
Figure 60B:
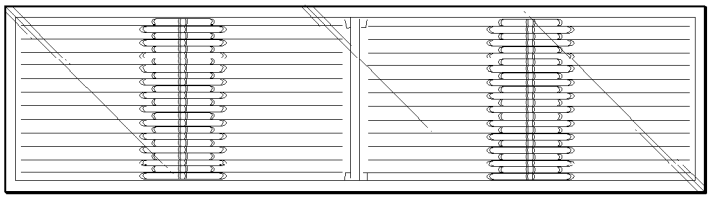
Figure 61A:
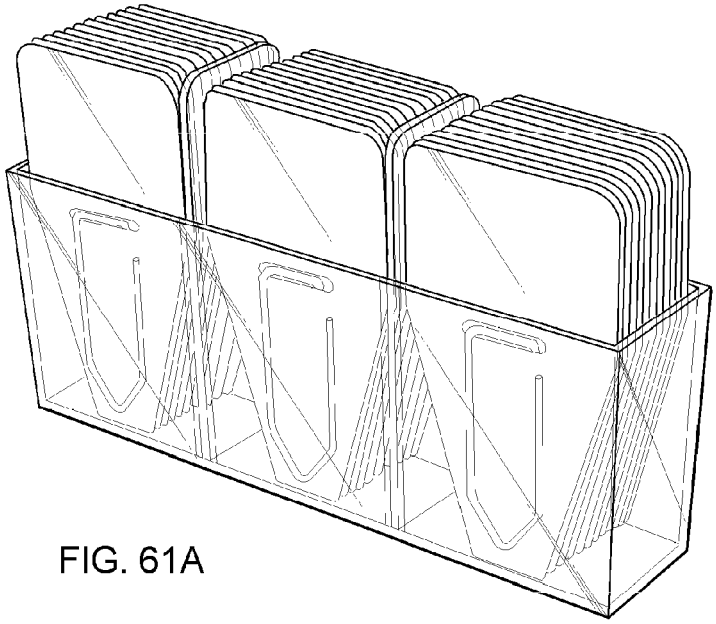
Figure 61B:
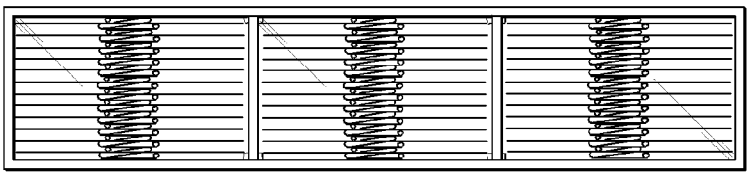
Figure 61C:
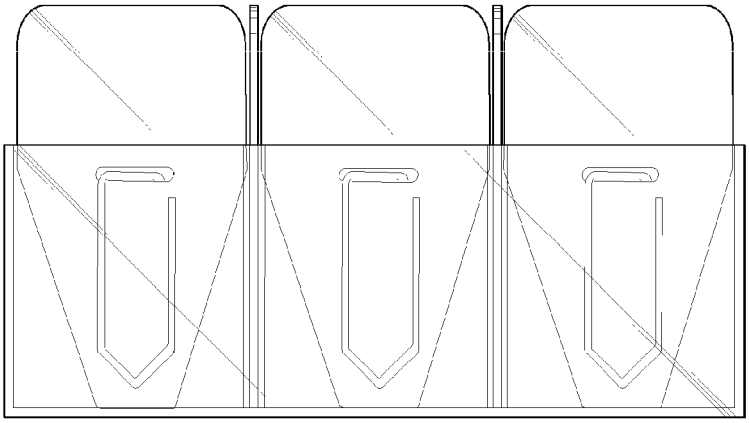
Figure 61D:
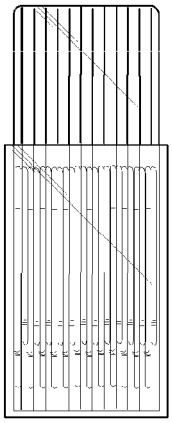

FIGS. 60A to 60B show further views of an additional embodiment of the invention.

FIGS. 61A to 61D show an additional embodiment of the invention.

Figure 62A:
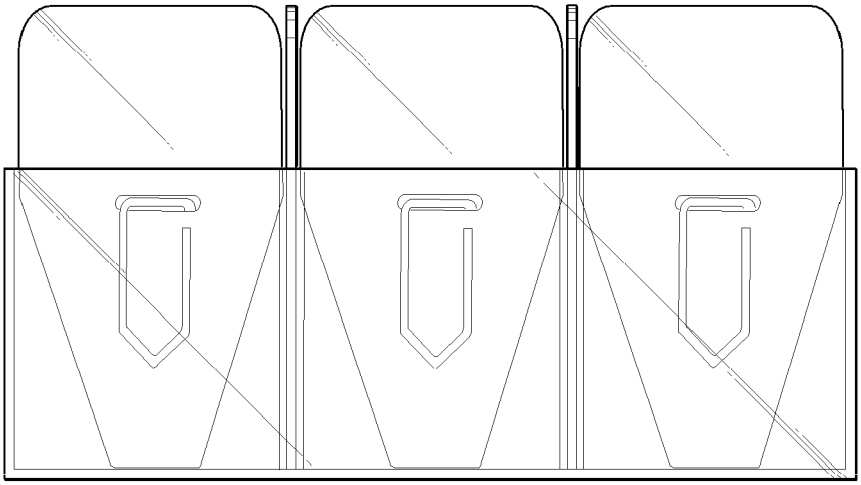
Figure 62B:
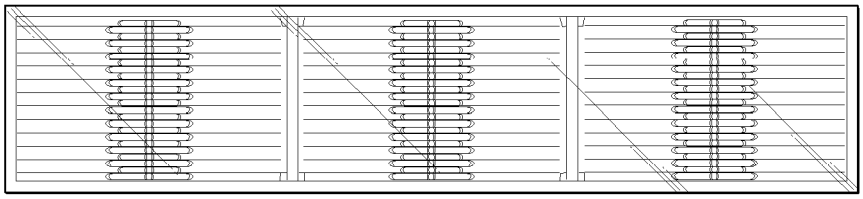

FIGS. 62A to 62B show further views of an additional embodiment of the invention.

Figure 63A:
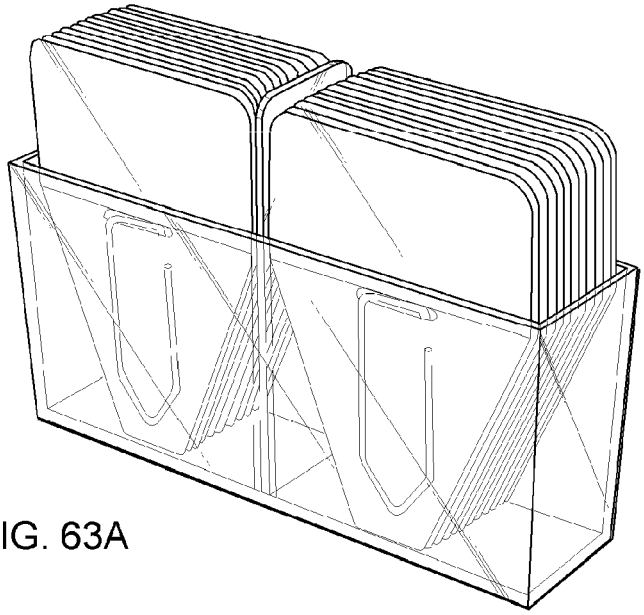
Figure 63B:
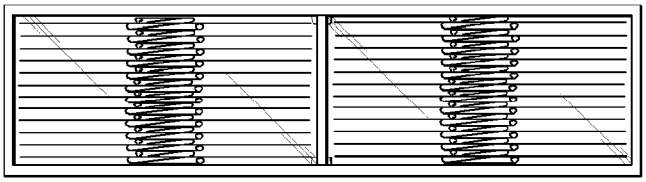
Figure 63C:
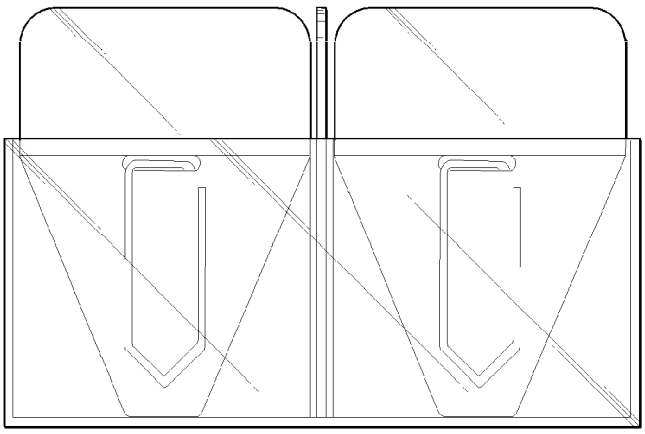
Figure 63D:
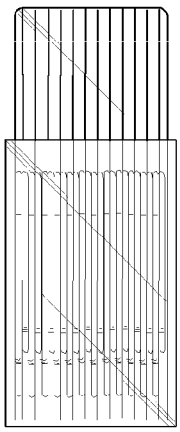

FIGS. 63A to 63D show an additional embodiment of the invention. These kits of the invention have a container and tabbed notes with different color schemes. The color scheme of a tabbed note in a first compartment of the container is different from the color scheme of tabbed notes in other compartments. FIG. 63A is a two-compartment version with two compartments side by side. In a specific implementation, there are two color schemes of tabbed notes, one color scheme in each compartment. A color scheme may be a single color or a multiplicity of colors on the same note. One color scheme may have completely different colors such as blue and gold on the same tab note. Other examples include yellow and green, red and blue, blue and orange, green and pink, and many others. A color scheme for a note may include different shades of the same colors. Other colors schemes are discussed elsewhere in this application.

Figure 64A:
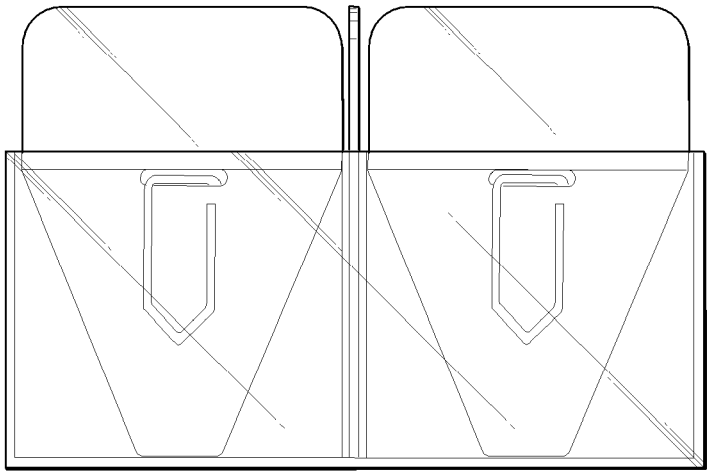
Figure 64B:
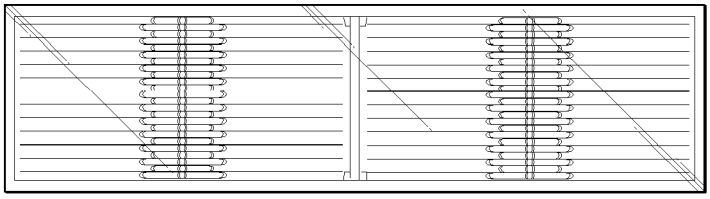
Figure 65A:
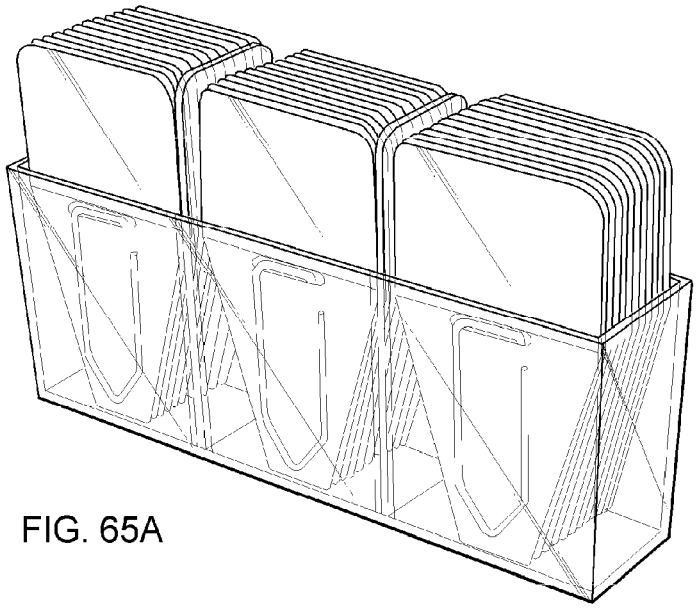
Figure 65B:
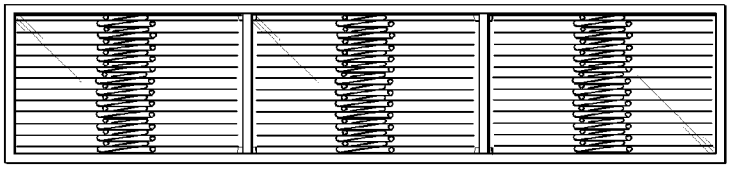
Figure 65C:
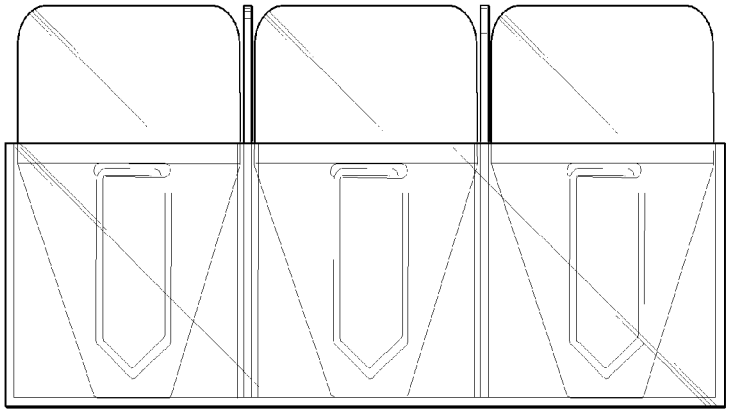
Figure 65D:
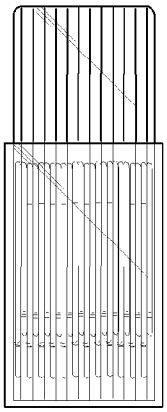

FIGS. 64A to 64B show further views of an additional embodiment of the invention.

FIGS. 65A to 65D show an additional embodiment of the invention.

Figure 66A:
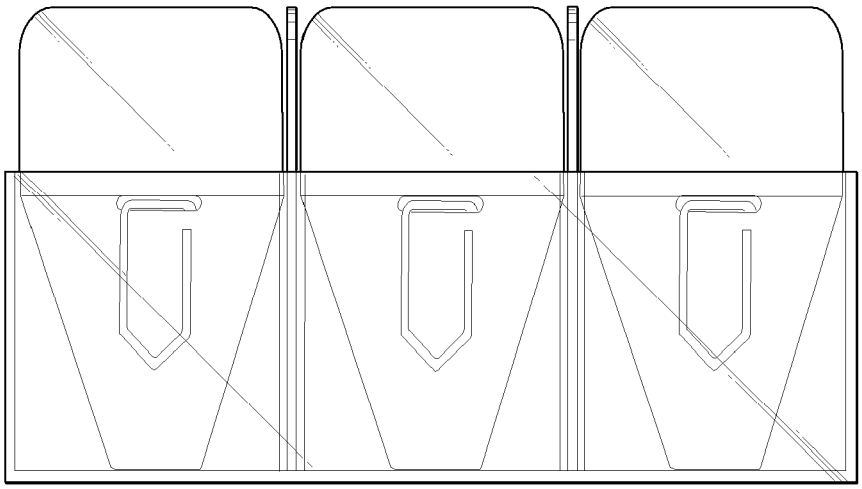
Figure 66B:
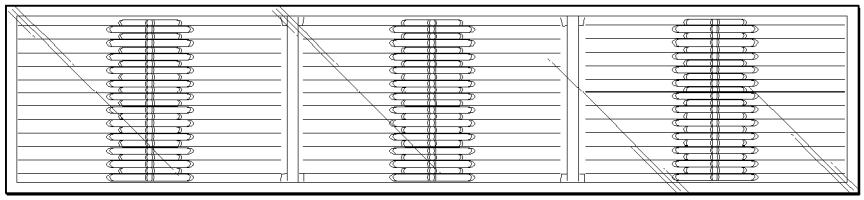

FIGS. 66A to 66B show further views of an additional embodiment of the invention.

Figure 67A:
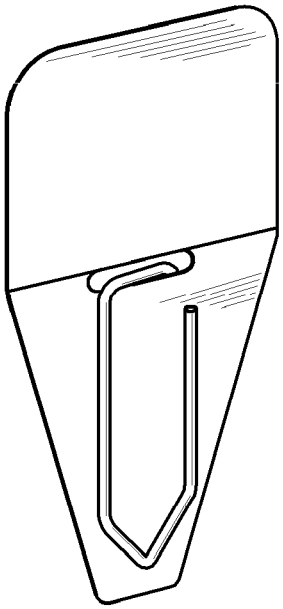
Figure 67E:
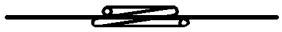
Figure 67F:
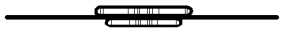
Figure 67B:
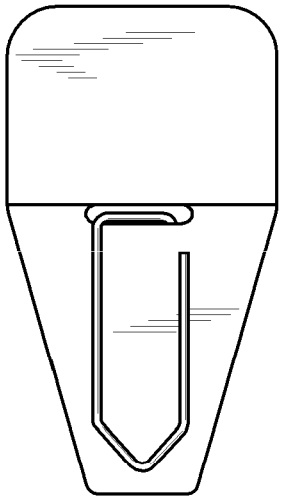
Figure 67C:
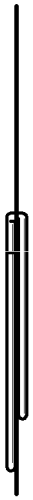
Figure 67D:
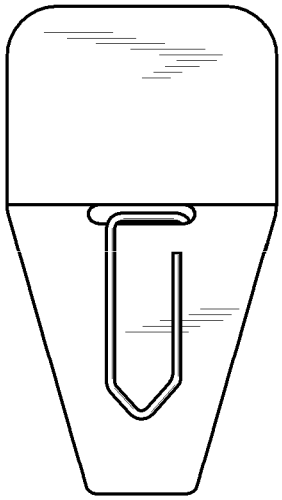
Figure 68A:
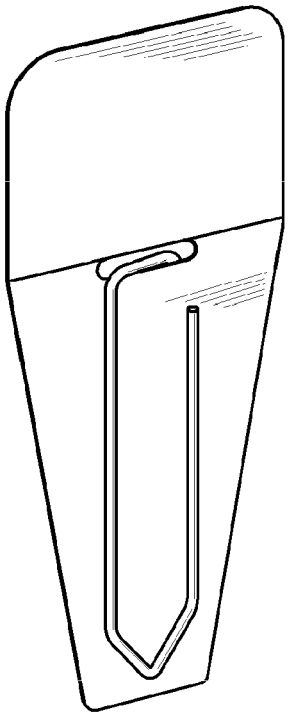
Figure 68E:
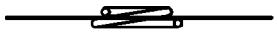
Figure 68F:
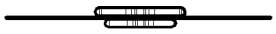
Figure 68B:
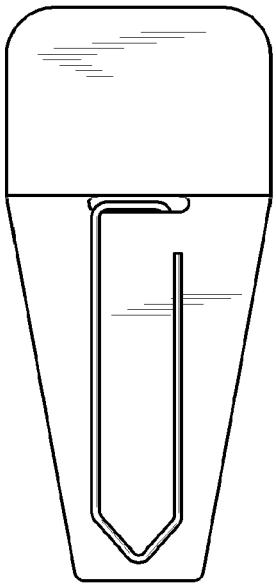
Figure 68C:
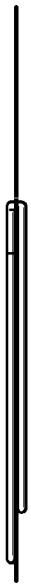
Figure 68D:
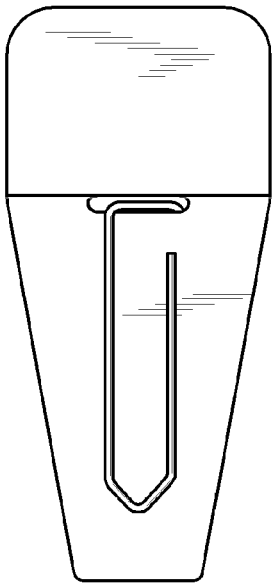
Figure 69A:
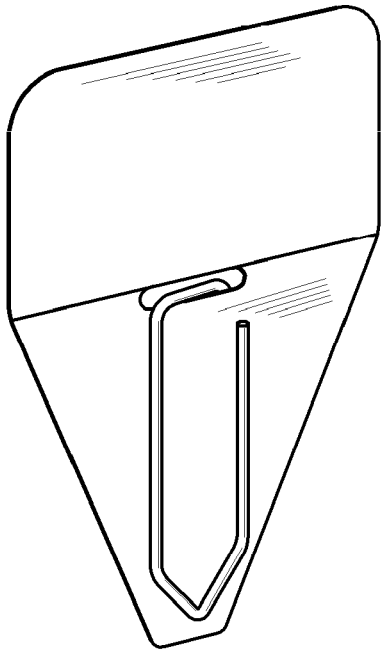
Figure 69E:
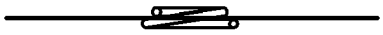
Figure 69F:
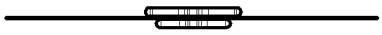
Figure 69B:
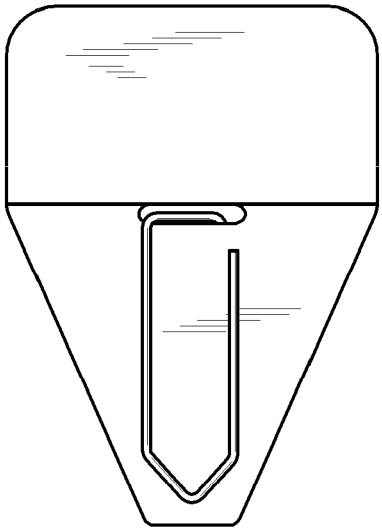
Figure 69C:
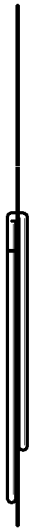
Figure 69D:
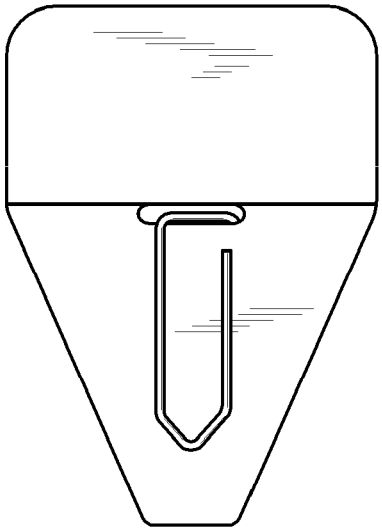
Figure 70A:
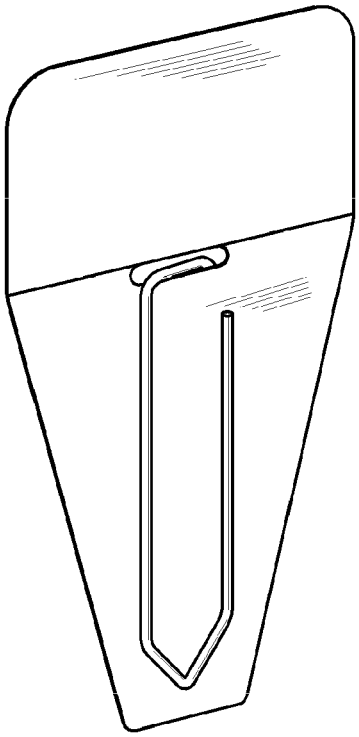
Figure 70E:
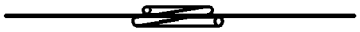
Figure 70F:
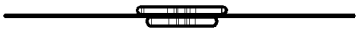
Figure 70B:
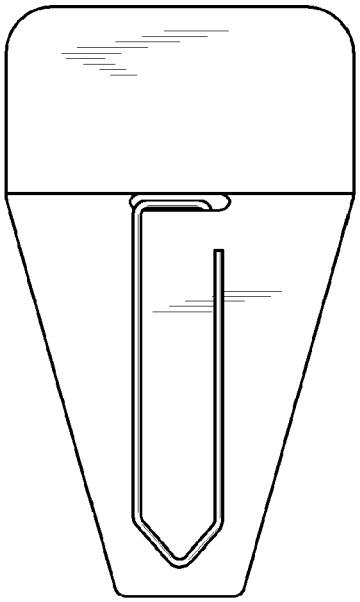
Figure 70C:
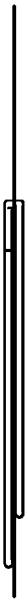
Figure 70D:
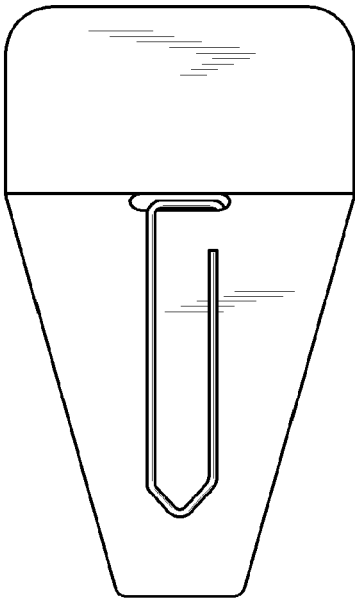
Figure 71A:
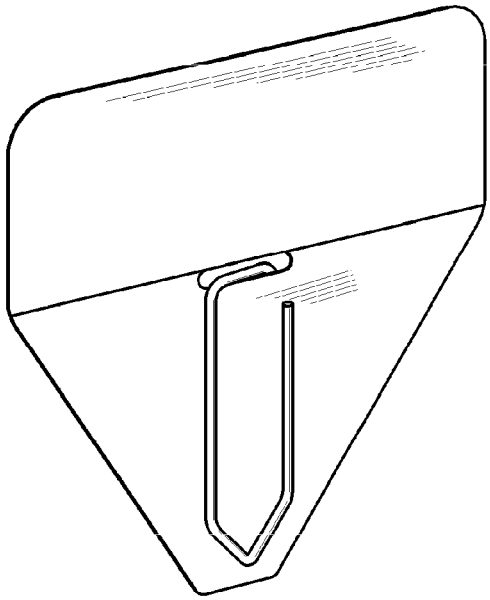
Figure 71E:
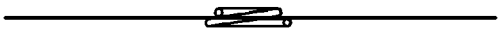
Figure 71F:
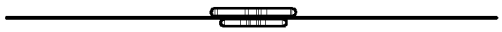
Figure 71B:
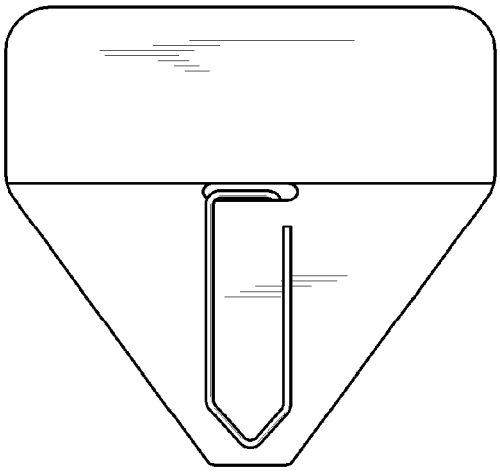
Figure 71C:
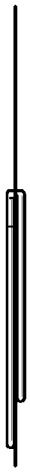
Figure 71D:
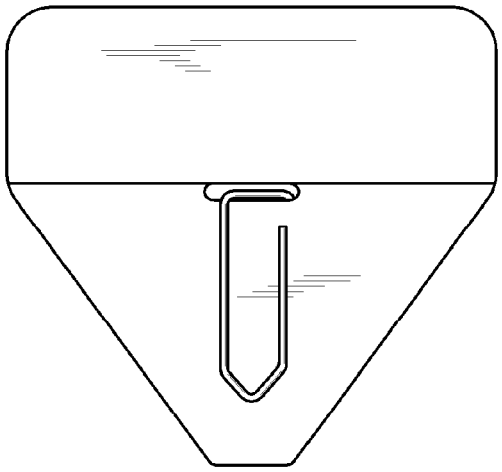
Figure 72A:
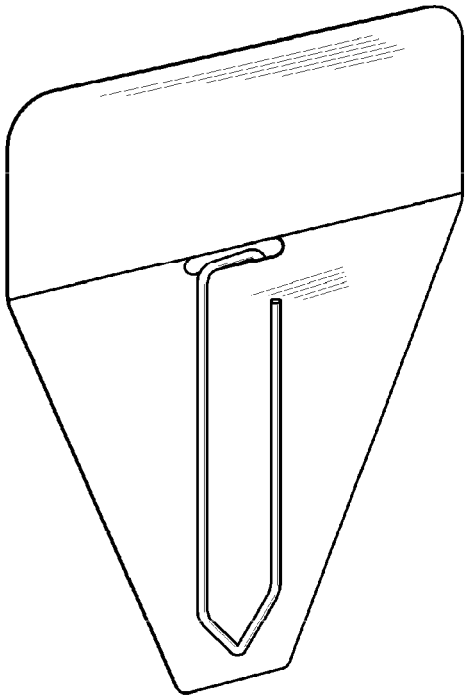
Figure 72E:
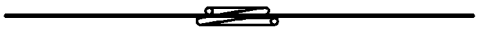
Figure 72F:
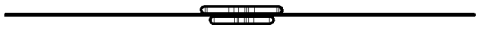
Figure 72B:
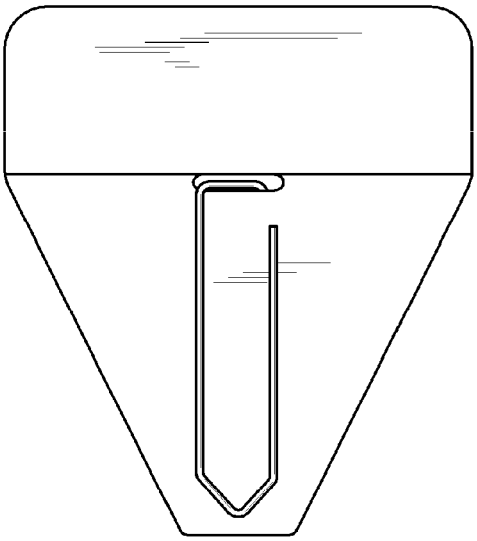
Figure 72C:
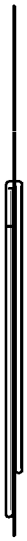
Figure 72D:
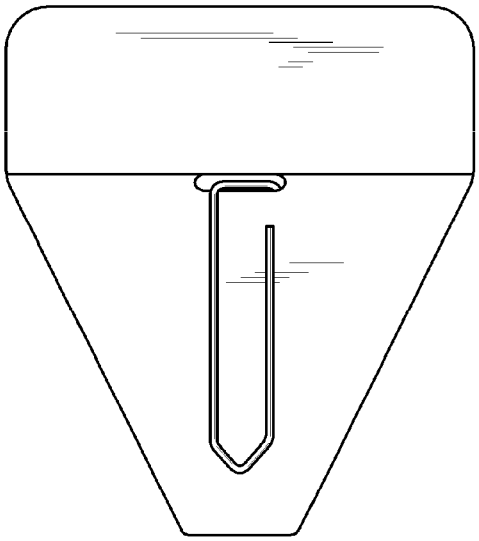
Figure 73A:
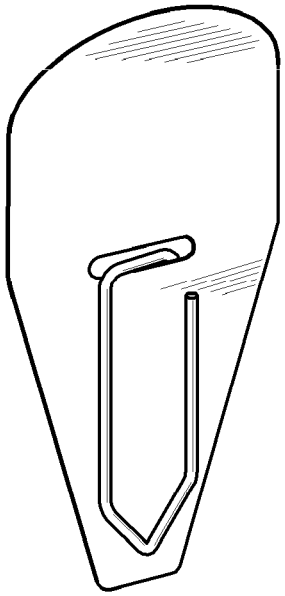
Figure 73E:
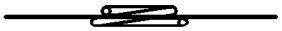
Figure 73F:
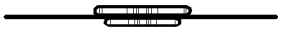
Figure 73B:
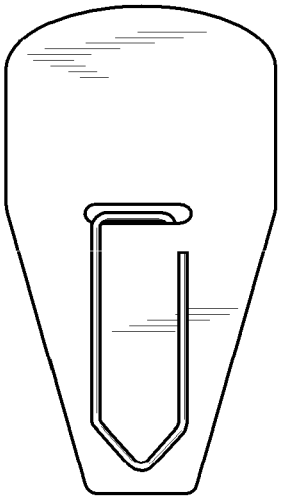
Figure 73C:
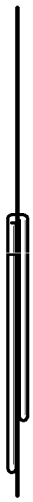
Figure 73D:
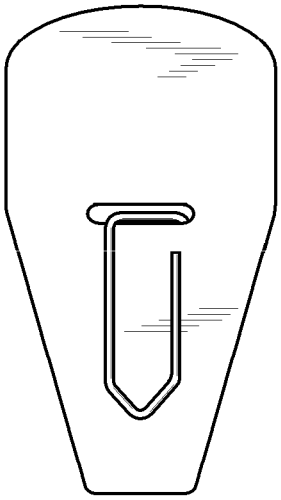
Figure 74A:
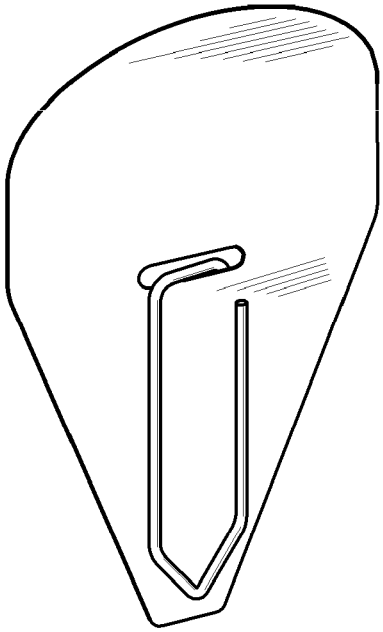
Figure 74E:
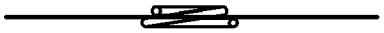
Figure 74F:
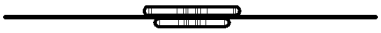
Figure 74B:
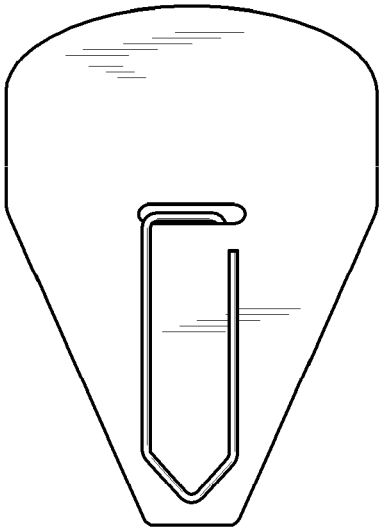
Figure 74C:
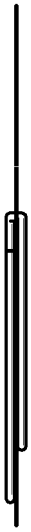
Figure 74D:
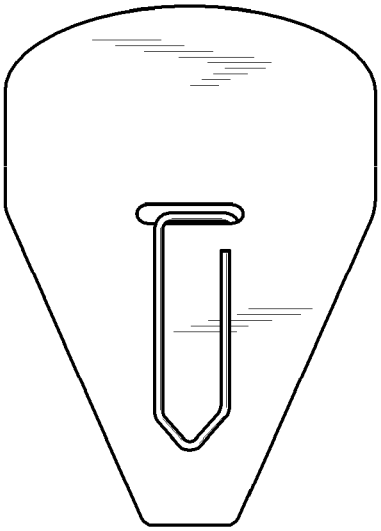
Figure 75A:
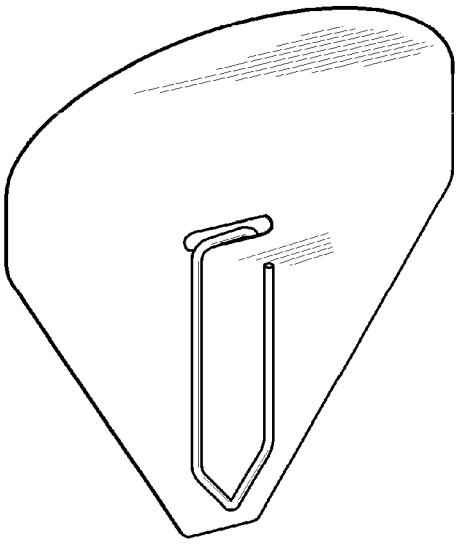
Figure 75E:
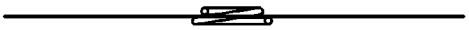
Figure 75F:
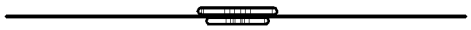
Figure 75B:
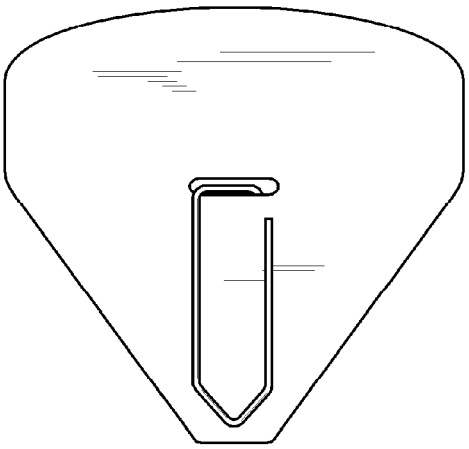
Figure 75C:
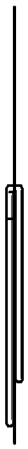
Figure 75D:
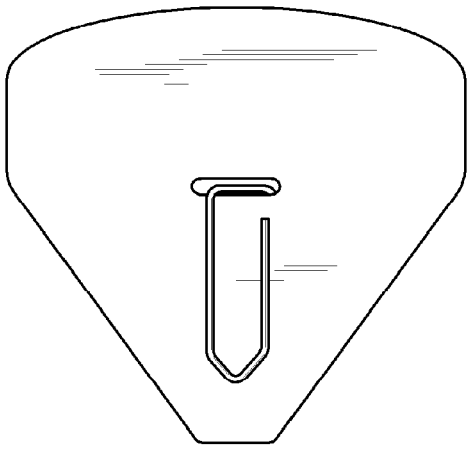

FIGS. 67A to 67F show an additional embodiment of the invention. These figures show a tab note implementation of the invention where the top portion (portion above straight line at top edge of opening) has a different color than a bottom portion, below the line. This straight line may not be printed on the tab note, but defined by colors scheme. This straight line may be an imaginary guide line that is used for defining different portions of the tab. In some embodiments, the straight line may be printed on the tab note. The colors used may be any color or shade. In a specific implementation, the top portion color is a first shade of a color while the bottom portion is a second shade of the same color. The first shade is darker than the second shade. In another implementation, the top portion has a color, but the bottom portion is uncolored or white. In other color schemes, portions of the note may translucent or see through. For example, the bottom portion may be clear, translucent, milky, frosted, or other, so that when attached, a user can see through or partially see through the tab note bottom portion. In another implementation, the color of the top portion is printed, but the color of the bottom portion is dyed. Tabbed notes such as shown in FIG. 67A may be part of a kit having a container. See FIGS. 63A to 63D, 64A to 64B, 65A to 65D, and 66A and 66B.

FIGS. 68A to 68F show an additional embodiment of the invention.

FIGS. 69A to 69F show an additional embodiment of the invention.

FIGS. 70A to 70F show an additional embodiment of the invention.

FIGS. 71A to 71F show an additional embodiment of the invention.

FIGS. 72A to 72F show an additional embodiment of the invention.

FIGS. 73A to 73F show an additional embodiment of the invention.

FIGS. 74A to 74F show an additional embodiment of the invention.

FIGS. 75A to 75F show an additional embodiment of the invention.

Figure 76A:
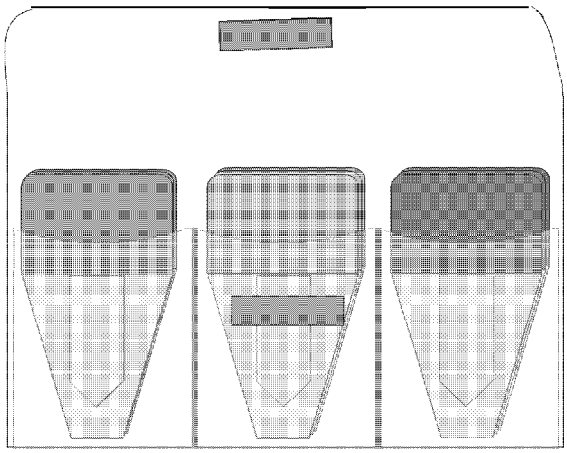
Figure 76B:
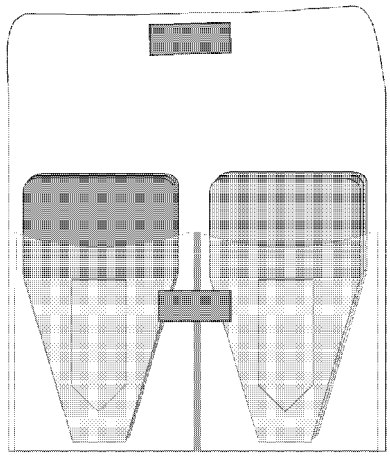
Figure 76C:
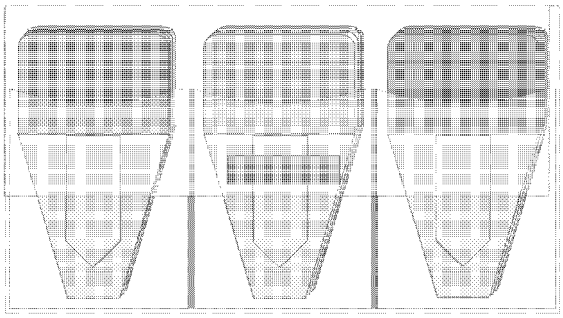
Figure 76D:
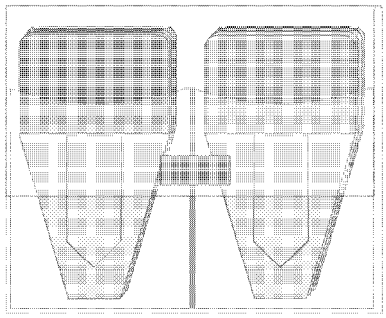
Figure 76E:
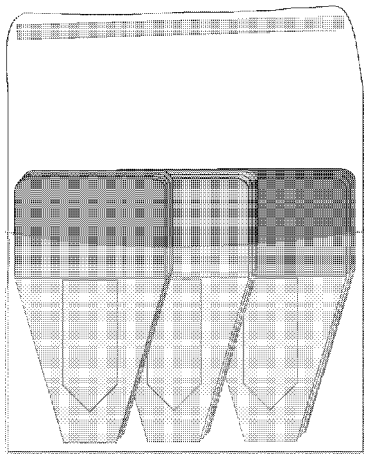
Figure 76F:
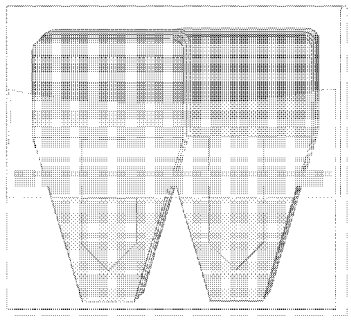

FIGS. 76A to 76F show an additional embodiment of the invention. These figures show a soft container of the invention. In FIG. 76A, there are three compartments which the notes slide into. The tab portions of the notes are still visible when inserted into the compartments. A flap folds over to close and secure the notes in the compartments. The flap holds into place using Velcro, button snap, removable adhesive, or other. See FIG. 76C for a closed soft container. FIGS. 76B and 76D show open and closed soft containers with two compartments. The soft container may be made of any type of material or fabric, such as cotton, polyester, nylon, or plastic. The material may be translucent or see through. FIGS. 76E and 76F show an alternative implementation of the soft container where the tabs are inserted in a louvered fashion, thus reducing a width of the entire package.

The containers have notes having multiple color schemes. In a three compartment version, there are three different color schemes. As has been discussed, the color schemes may be different colors or different shades of the same color.

Figure 77A:
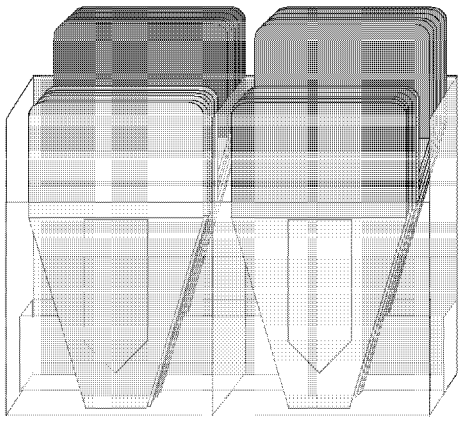
Figure 77B:
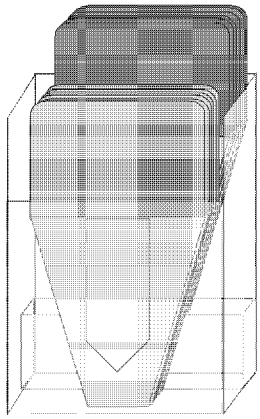
Figure 77C:
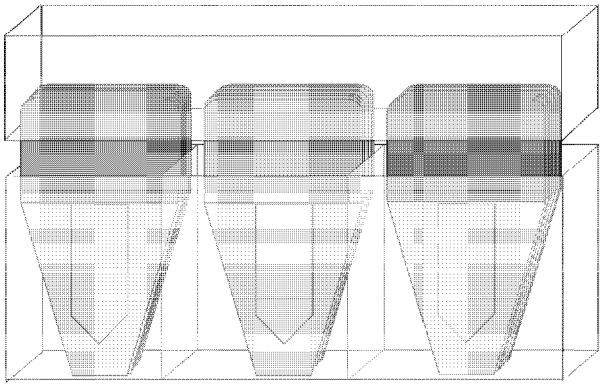
Figure 77D:
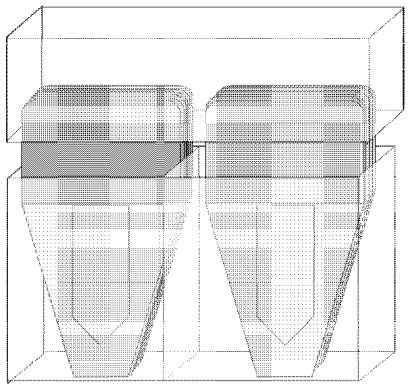

FIGS. 77A to 77D show an additional embodiment of the invention. FIG. 77A shows a container with front and back compartments, where the back compartments are elevated compared to the front compartment. There are a total of four compartments, two side by side, and two front and back. In further implementations of the invention, there may be any number of compartments side by side and front and back. For example, they may be an array of 2 by 3, 2 by 4, 3 by 2, 2 by 1, and so forth. FIG. 77B shows an implementation of a compartment with front and back compartments, where the back is elevated. FIG. 77C shows a container with three compartments and a removable cover. FIG. 77D shows a container with two compartments and a removable cover.

Figure 78A:
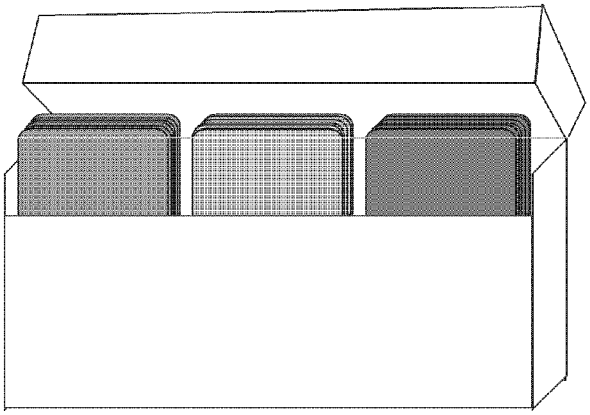
Figure 78B:
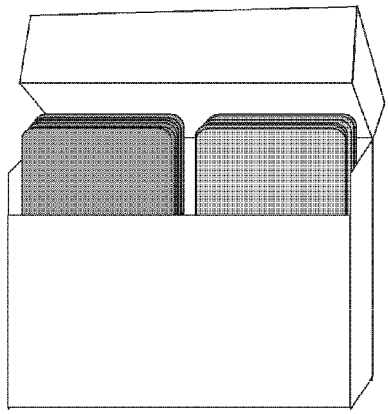
Figure 78C:
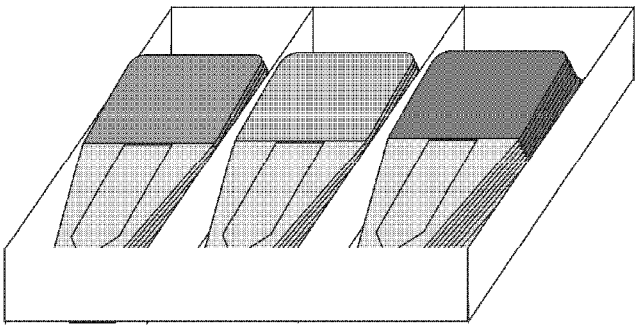
Figure 78D:
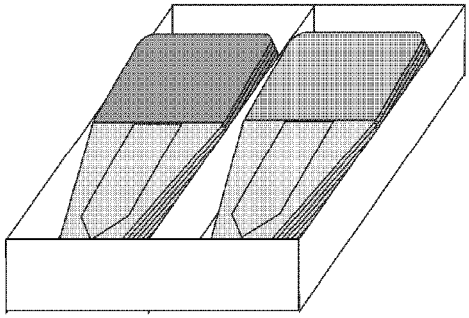
Figure 79A:
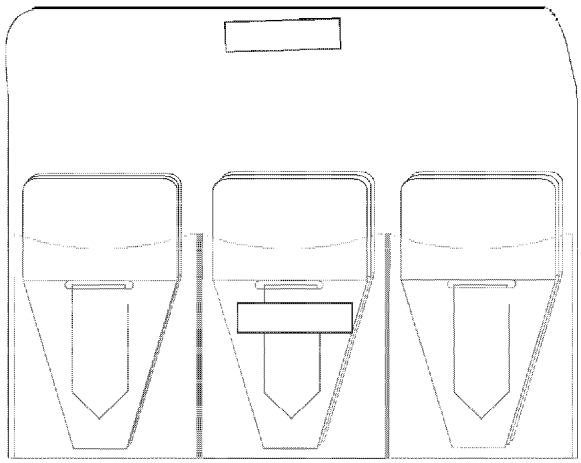
Figure 79B:
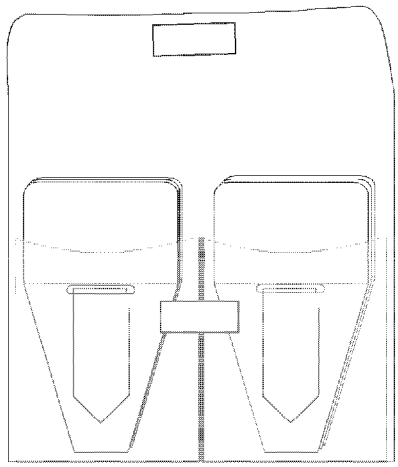
Figure 79C:
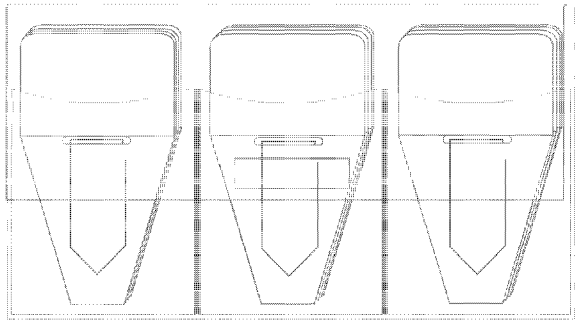
Figure 79D:
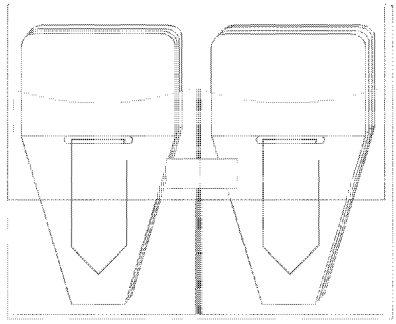
Figure 79E:
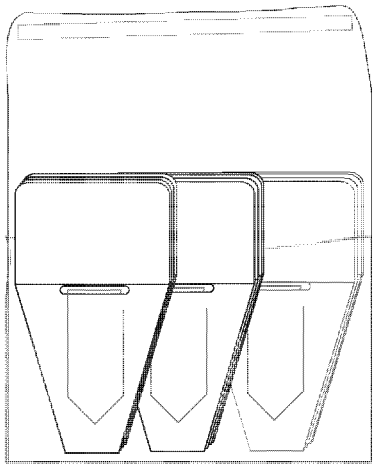
Figure 79F:
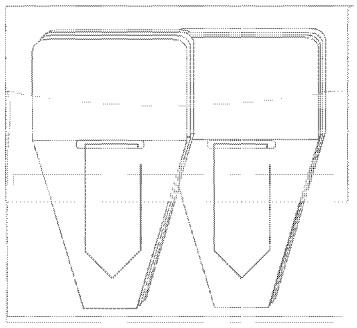
Figure 80A:
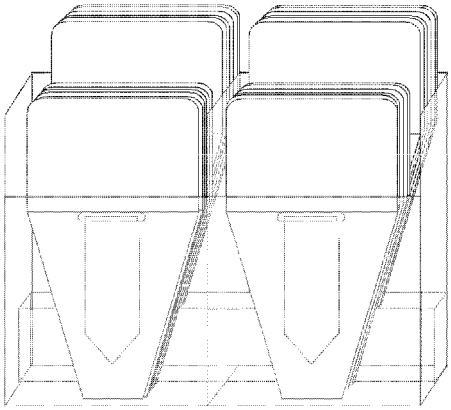
Figure 80B:
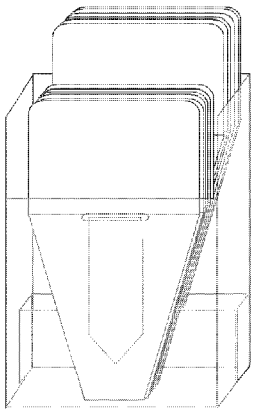
Figure 80C:
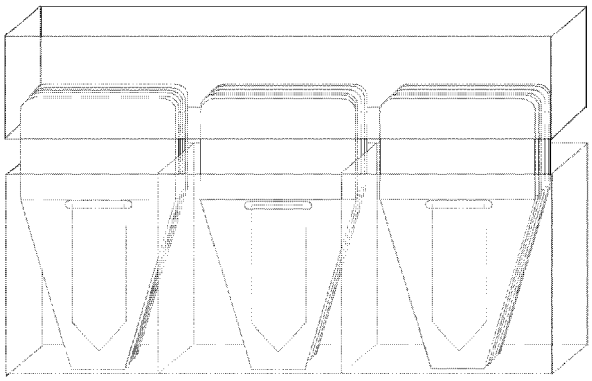
Figure 80D:
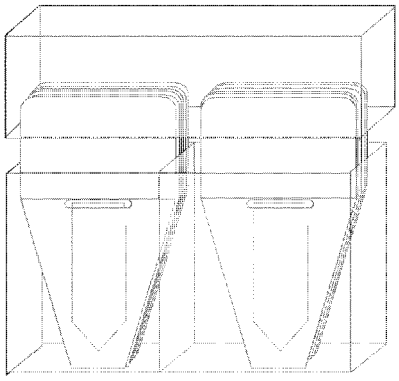
Figure 81A:
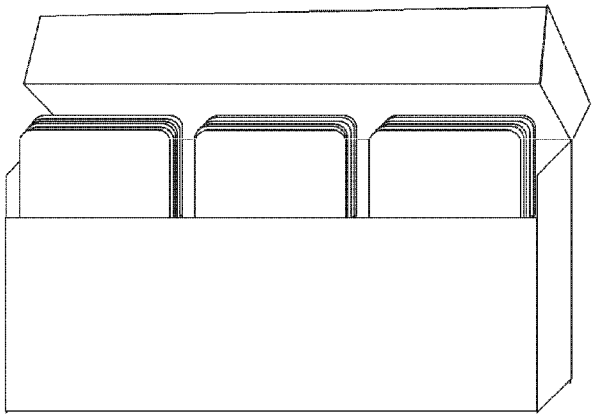
Figure 81B:
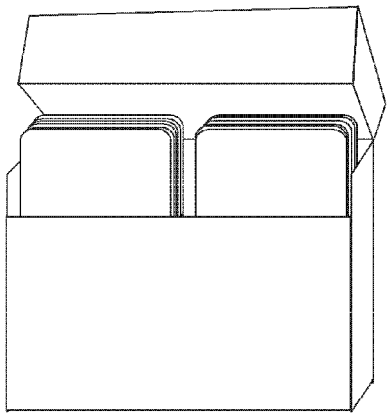
Figure 81C:
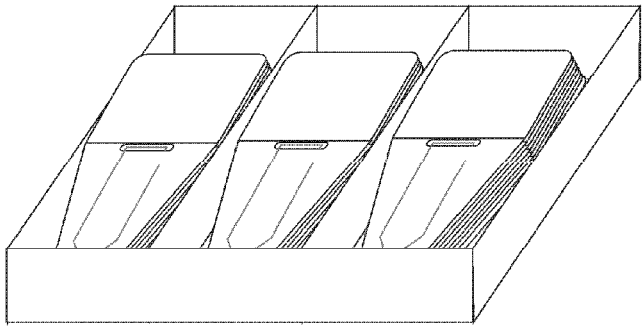
Figure 81D:
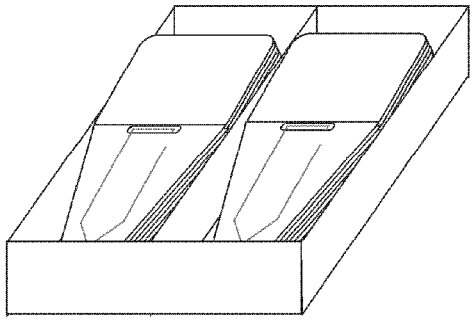

FIGS. 78A to 78D show an additional embodiment of the invention. FIG. 78A shows a container with three compartments and a hinged cover. FIG. 78B shows a container with two compartments and a hinged cover. The tab portions are visible when the tab notes are inserted into the containers. FIGS. 78C and 78D shows another container embodiment where the notes lie flat in a compartment. FIG. 78C has two compartments and FIG. 78D has three compartments.

FIGS. 79A to 79F show an additional embodiment of the invention.

FIGS. 80A to 80D show an additional embodiment of the invention.

FIGS. 81A to 81D show an additional embodiment of the invention.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A kit comprising:

a package comprising at least two compartments separated by a divider;

in a first compartment of the package, a first plurality of single-sheet tab notes, each note comprising a single opening and a fastener inserted through the opening, where a first portion of the fastener is on a first side of the note and a second portion of the fastener is on a second side of the note, and the first plurality of single-sheet tab notes has a first color scheme; and in a second compartment of the package, a second plurality of single-sheet tab notes, substantially the same as the first plurality of single sheet tab notes, except that the second plurality of single-sheet tab notes has a second color scheme, different from the first color scheme.

2. The kit of claim 1 further comprising:

in the first compartment, a third plurality of single-sheet tab notes, substantially the same as the first plurality of single sheet tab notes, except that the third plurality of single-sheet tab notes has a third color scheme, different from the first and second color schemes, wherein the first plurality of single-sheet tab notes are arranged together in a first single group in a first portion of the first compartment and the third plurality of single-sheet tab notes are arranged together in a second single group in a first portion of the second compartment; and in the second compartment, a fourth plurality of single-sheet tab notes, substantially the same as the first plurality of single sheet tab notes, except that the fourth plurality of single-sheet tab notes has a fourth color scheme, different from the first, second, and third color schemes, wherein the second plurality of single-sheet tab notes are arranged together in a first single group in a first portion of the second compartment and the fourth plurality of single-sheet tab notes are arranged together in a second single group in a second portion of the second compartment.

3. The kit of claim 1 wherein the first color scheme comprises:

a first color applied to a portion of a note defined by a straight line above the opening; and a second color applied to a portion of a note below the straight line, wherein the first and second colors are different.

4. The kit of claim 3 wherein the straight line touches the opening.

5. The kit of claim 3 wherein the second color scheme comprises:

a third color applied to a portion of a note defined by a straight line above the opening; and a fourth color applied to a portion of a note below the straight line, wherein the third and fourth colors are different.

6. The kit of claim 3 wherein the second color is applied by dying the note and the first color is printed on the note after the note has been dyed.

7. The kit of claim 4 wherein two side edges of the note above the straight line are substantially parallel as these side edges extend toward a top edge of the note, and two side edges of the note below the straight line are tapered as these side edges extend toward a bottom edge of the note.

8. The kit of claim 1 wherein the packaging comprises a translucent material and the single-sheet tab notes are visible through the translucent material.

9. The kit of claim 1 wherein the fastener is a paper clip.

10. The kit of claim 1 wherein the fastener is a binder clip.

11. A kit comprising:

a package comprising at least two compartments separated by a divider;

in a first compartment of the package, a first plurality of single-sheet tab notes, each note comprising a single slit and a fastener inserted through the slit, where a first portion of the fastener is on a first side of the note and a second portion of the fastener is on a second side of the note, and the first plurality of single-sheet tab notes has a first color scheme; and in a second compartment of the package, a second plurality of single-sheet tab notes, substantially the same as the first plurality of single sheet tab notes, except that the second plurality of single-sheet tab notes has a second color scheme, different from the first color scheme.

12. The kit of claim 11 further comprising:

in the first compartment, a third plurality of single-sheet tab notes, substantially the same as the first plurality of single sheet tab notes, except that the third plurality of single-sheet tab notes has a third color scheme, different from the first and second color schemes, wherein the first plurality of single-sheet tab notes are arranged together in a first single group in a first portion of the first compartment and the third plurality of single-sheet tab notes are arranged together in a second single group in a first portion of the second compartment; and in the second compartment, a fourth plurality of single-sheet tab notes, substantially the same as the first plurality of single sheet tab notes, except that the fourth plurality of single-sheet tab notes has a fourth color scheme, different from the first, second, and third color schemes, wherein the second plurality of single-sheet tab notes are arranged together in a first single group in a first portion of the second compartment and the fourth plurality of single-sheet tab notes are arranged together in a second single group in a second portion of the second compartment.

13. The kit of claim 11 wherein the first color scheme comprises:

a first color applied to a portion of a note defined by a straight line above the slit; and a second color applied to a portion of a note below the straight line, wherein the first and second colors are different.

14. The kit of claim 13 wherein the straight line touches the slit.

15. The kit of claim 13 wherein the second color scheme comprises:

a third color applied to a portion of a note defined by a straight line above the slit; and a fourth color applied to a portion of a note below the straight line, wherein the third and fourth colors are different.

16. The kit of claim 13 wherein the second color is applied by dying the note and the first color is printed on the note after the note has been dyed.

17. The kit of claim 14 wherein two side edges of the note above the straight line are substantially parallel as these side edges extend toward a top edge of the note, and two side edges of the note below the straight line are tapered as these side edges extend toward a bottom edge of the note.

18. The kit of claim 11 wherein the packaging comprises a translucent material and the single-sheet tab notes are visible through the translucent material.

19. The kit of claim 11 wherein the fastener is a paper clip.

20. The kit of claim 11 wherein the fastener is a binder clip.

21. A kit comprising:

a packaging comprising at least a first divider;

in the packaging, in a first section separated by the first divider, a first plurality of single-sheet tab notes, each note comprising a single opening and a fastener inserted through the opening, where a first portion of the fastener is on a first side of the note and a second portion of the fastener is on a second side of the note, and the first plurality of single-sheet tab notes has a first color scheme; and in the packaging, in a second section separated by the first divider, a second plurality of single-sheet tab notes, substantially the same as the first plurality of single sheet tab notes, except that the second plurality of single-sheet tab notes has a second color scheme, different from the first color scheme.

22. The kit of claim 21 wherein the packaging comprises at least a second divider, and the kit comprises:

in the packaging, in a third section separated by the second divider, a third plurality of single-sheet tab notes, substantially the same as the first plurality of single sheet tab notes, except that the third plurality of single-sheet tab notes has a third color scheme, different from the first color scheme.

23. The kit of claim 21 wherein the single opening comprises a slit.

24. The kit of claim 21 wherein the single opening comprises a cut.

25. The kit of claim 21 wherein in the packaging, the first section is arranged to be in front of the second section.

26. The kit of claim 21 wherein in the packaging, the first plurality of single-sheet tab notes is arranged to be in front the second plurality of single-sheet tab notes.

* * * * *